US005694793A

United States Patent [19]

Nishimura et al.

[11] Patent Number: 5,694,793

[45] Date of Patent: Dec. 9, 1997

[54] WASHING MACHINE WITH OPERATION PANEL INCLUDING DISPLAY DEVICE AND OPERATION SWITCHES

[75] Inventors: Nobuichi Nishimura, Ichinomiya; Masahiro Imai, Tajimi; Kazutoshi Tani, Seto; Yoshiyuki Makino, Seto; Satoru Matsumoto, Seto; Toru Imai, Tajimi, all of Japan

[73] Assignee: Kabushiki Kaisha Toshiba, Kanagawa-Ken, Japan

[21] Appl. No.: 551,738

[22] Filed: Nov. 1, 1995

[30] Foreign Application Priority Data

| | | | |
|---|---|---|---|
| Nov. 18, 1994 | [JP] | Japan | 6-284747 |
| Jan. 30, 1995 | [JP] | Japan | 7-012767 |
| Feb. 28, 1995 | [JP] | Japan | 7-040712 |

[51] Int. Cl.[6] ..... D06F 33/02

[52] U.S. Cl. ..... 68/12.27

[58] Field of Search ..... 68/12.27; 349/60, 349/69, 149, 86

[56] References Cited

U.S. PATENT DOCUMENTS

| | | | |
|---|---|---|---|
| 4,233,522 | 11/1980 | Grummer et al. | 307/116 |
| 4,699,470 | 10/1987 | McLaughlin et al. | 350/334 |
| 4,763,493 | 8/1988 | Nishite et al. | 68/12.27 |
| 4,789,858 | 12/1988 | Fergason et al. | 340/784 |
| 5,243,453 | 9/1993 | Kawaguchi et al. | 359/74 |
| 5,272,892 | 12/1993 | Janutka et al. | 68/12.22 |
| 5,279,134 | 1/1994 | Nonogaki et al. | 68/12.27 |
| 5,283,563 | 2/1994 | Allen et al. | 345/102 |

*Primary Examiner*—Philip R. Coe

*Attorney, Agent, or Firm*—Limbach & Limbach, LLP

[57] ABSTRACT

A full automatic washing machine includes in an operation panel a display device together with power ON and OFF switches and a light-emitting diode serving as a pilot lamp. The display device is formed into the shape of a rectangular flat plate and has elasticity. The display device is constituted by a nematic curvilinear aligned phase (NCAP) liquid crystal panel and a reflecting plate. The display device includes a plurality of display sections for displaying a plurality of pieces of information about the washing operation. A membrane switch is disposed on the back of the display device. The membrane switch is turned on when the display device is depressed. The membrane switch has a plurality of key switches positioned so as to correspond to the display sections of the display device.

7 Claims, 49 Drawing Sheets

WASHING MACHINE WITH OPERATION PANEL INCLUDING DISPLAY DEVICE AND OPERATION SWITCHES

BACKGROUND OF THE INVENTION

1. Field of the Invention

The present invention relates to a washing machine provided with a display device for displaying information about a washing operation.

2. Description of the Prior Art

Full automatic washing machines sequentially execute steps of wash, rinse, and dehydration, thereby performing a washing operation, for example. Furthermore, one of a plurality of washing courses including a standard course is selected and automatically executed in such washing machines. In such full automatic washing machines, an operation panel is mounted on the front top of an outer cabinet, and a display device is provided in the operation panel for displaying a plurality of washing courses, a step being currently executed, and so on. The display device comprises a combination of light-emitting diodes, a combination of fluorescent character display tubes, or a liquid crystal display panel. Operation switches for switching the washing course, for selecting a wash water level, and for other purposes are disposed in the operation panel so as to be adjacent to the display device.

The thickness of the display device is increased when the display device comprises the light-emitting diodes or the fluorescent character display tubes. Accordingly, a large mounting space for the display device needs to be ensured in the operation panel. This reduces the degree of freedom in the design of the washing machine. Furthermore, since the light-emitting diodes or the fluorescent character display tubes consume a relatively large amount of electric power, the display device disadvantageously consumes a large amount of electric power. On the other hand, in the display device comprising an ordinary liquid crystal display panel, an angle of visibility is narrow. Furthermore, since the liquid crystal display panel has no light source, it is inferior in the visibility. The visibility of the liquid crystal display panel can be improved partially by the provision of a back light. However, the thickness of the display device is again increased, whereupon the degree of freedom in the design of the washing machine is reduced and an amount of electric power consumed in the operation panel is increased as described above.

Since some limitation to the size of the operation panel is unavoidable, operated portions of the display device and of the operation switches are accordingly limited to some extent in the prior art construction in which the display panel and the operation switches are disposed in the operation panel to be adjacent to each other. Consequently, it is difficult to increase an area occupied by the display device in the operation panel and to thereby improve the visibility. Furthermore, the operability of the operation switches is reduced.

SUMMARY OF THE INVENTION

Therefore, an object of the present invention is to provide a washing machine wherein the display device displaying information about the washing operation can be thinned to thereby improve the degree of freedom in the design thereof, improvements in the visibility and the power consumption of the display device can be achieved, and the visibility of the display device and the operability of switch means can be improved even when the switch means is disposed so as to correspond to the display device.

The present invention provides a washing machine including a display device provided for displaying information about a washing operation and including an NCAP liquid crystal panel permitting light to pass therethrough when a voltage is applied thereto and having elasticity, and light-reflecting means disposed in the rear of the NCAP liquid crystal panel.

The display device has a plurality of unit display areas for displaying various types of information about the washing operation. The light-reflecting means has various portions each corresponding to one of the unit display areas and colored by a plurality of colors. A switch means is disposed in the rear of the display device so as to be operated in response to depressing the display device. The switch means includes a plurality of key switches corresponding to respective unit display areas of the display device. A control means is provided for controlling the display device so that one or more of the unit display areas display information when the corresponding key switches are operated.

The nematic curvilinear aligned phase (NCAP) liquid crystal causes either the scattering or the absorption of incident light to take place when no voltage is applied thereto, thereby restraining light from passing therethrough. On the other hand, the NCAP liquid crystal permits the light to pass therethrough when a voltage is applied thereto. The NCAP liquid crystal panel comprising the above-described NCAP liquid crystal has a wide angle of visibility and smaller power consumption than the light-emitting diode and the fluorescent character display tube. Furthermore, the NCAP liquid crystal panel requires no back lights. Consequently, the visibility of the display device comprising the NCAP liquid crystal panel can be improved, and a reduction in the power consumption can be achieved. Furthermore, the display device can be thinned to a large extent, whereupon the degree of freedom in the design of the washing machine can be improved.

Furthermore, since the light-reflecting means is disposed in the rear of the NCAP liquid crystal panel, the light-reflecting means can be viewed when voltage is applied to the NCAP liquid crystal panel. Consequently, the displaying function of the display device can be improved by use of the light-reflecting means.

The display device has elasticity, and switch means is disposed in the rear of the display device so as to be operated in response to a depressing operation to the display device. Since the switch means need not be adjacent to the display device as in the prior art, the limitation of the size of the operating part of each of the display device and the switch means can be reduced. Consequently, the visibility of the display device and the operability of the switch means can be improved. The optical characteristics of the NCAP liquid crystal are not adversely affected even when pressure is applied thereto. Accordingly, the displaying function of the display device cannot be deteriorated even when the display device is depressed.

The display device has a plurality of unit display areas displaying a plurality of pieces of information about the washing operation respectively. The switch means includes a plurality of key switches corresponding to the unit display areas of the display device respectively. One or more of the unit display areas display the information when the corresponding key switches are in an operable state. Consequently, the displayed contents can be diversified, and the operability of the display device can be improved.

Furthermore, occurrence of error in operation of the switch means can be prevented.

The light-reflecting means of the display device has portions corresponding to the unit display areas respectively and colored by different colors from one another. Consequently, the visibility of the display device can be further improved with diversification of the displayed contents.

The plurality of unit display areas may include another plurality of unit display areas for displaying progress of steps of the washing operation, and the control means may control the display device so that only one of said another plurality of unit display areas corresponding to the step being currently executed performs the displaying operation. Consequently, the displaying function as performed in the washing machine can be improved. Furthermore, the control means may control the display device so that said another plurality of unit display area are switched to a displaying state during the washing operation and so that an intermittent displaying operation is performed only by one of said another plurality of unit display areas corresponding to the step being currently executed.

An overlay may cover a surface of the NCAP liquid crystal panel and may be printed with the contents displayed by the NCAP liquid crystal panel. Consequently, the contents to be displayed by the display device can be readily confirmed. Furthermore, the light-reflecting means may be printed with the contents displayed by the NCAP liquid crystal panel. Consequently, the contents displayed by the display device can be diversified.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENTS

Figure 1:
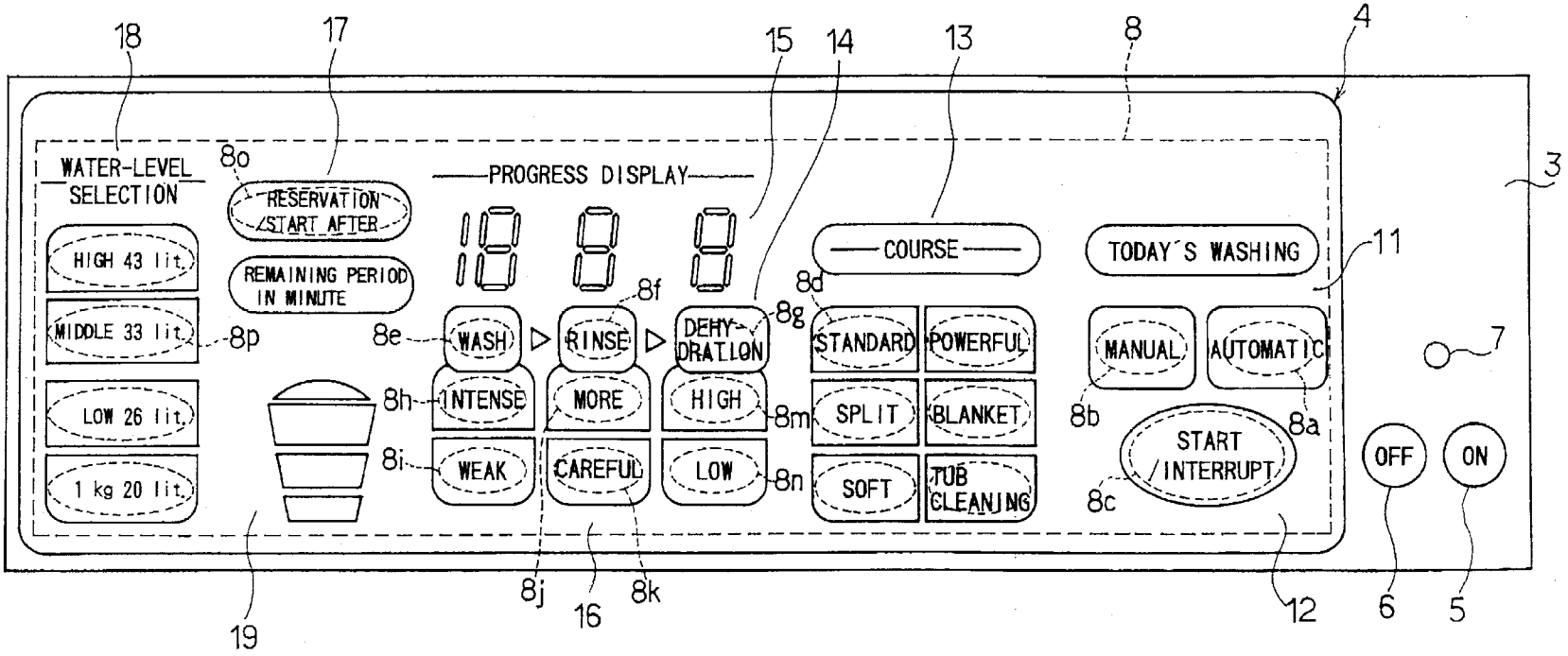
FIG. 1 is a front view of an operation panel employed in an automatic washing machine of a first embodiment in accordance with the present invention.
Figure 2:
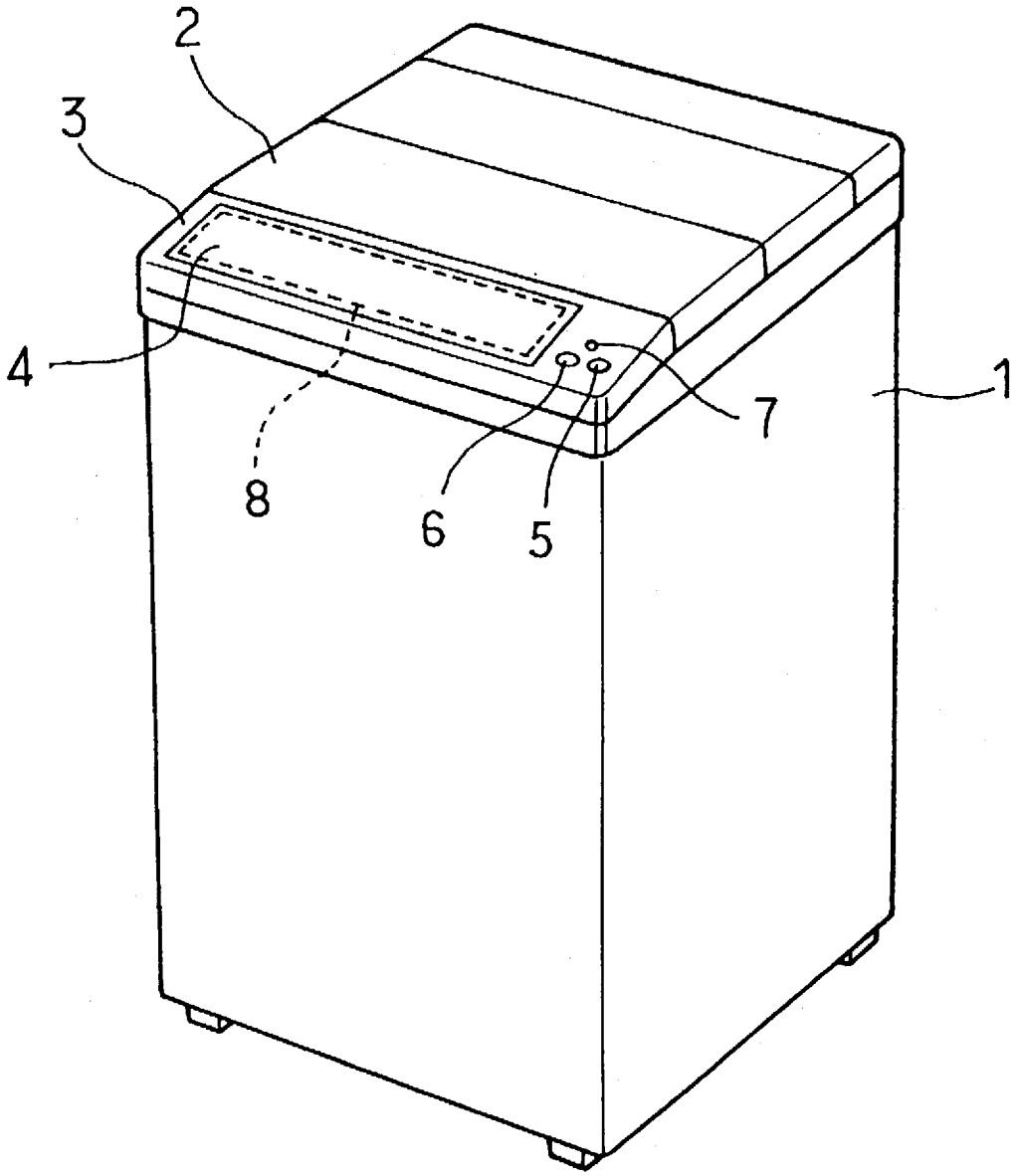
FIG. 2 is a perspective view of the washing machine.

A first embodiment of the present invention will be described with reference to FIGS. 1 to 7. Referring to FIG. 2, an automatic washing machine of the first embodiment in accordance with the present invention is shown. The washing machine comprises an outer cabinet 1 and a folding lid 2 mounted on the top of the outer cabinet 1 for opening and closing an access opening (not shown) through which laundry is put into and taken out of the washing machine. An operation panel 3 is mounted in front of the folding lid 2. The operation panel 3 includes a generally rectangular display device 4 which is approximately planar with the panel 3. Adjacent to the display device 4 are an ON switch 5 for power supply, an OFF switch 6 for power cut-off, and a light-emitting diode 7 serving as a pilot lamp. These parts are also approximately planar with the operation panel 3. The operation panel 3 further includes switch means or a membrane switch 8 constituting key switches and located at the underside of the display device 4.

Figure 3:
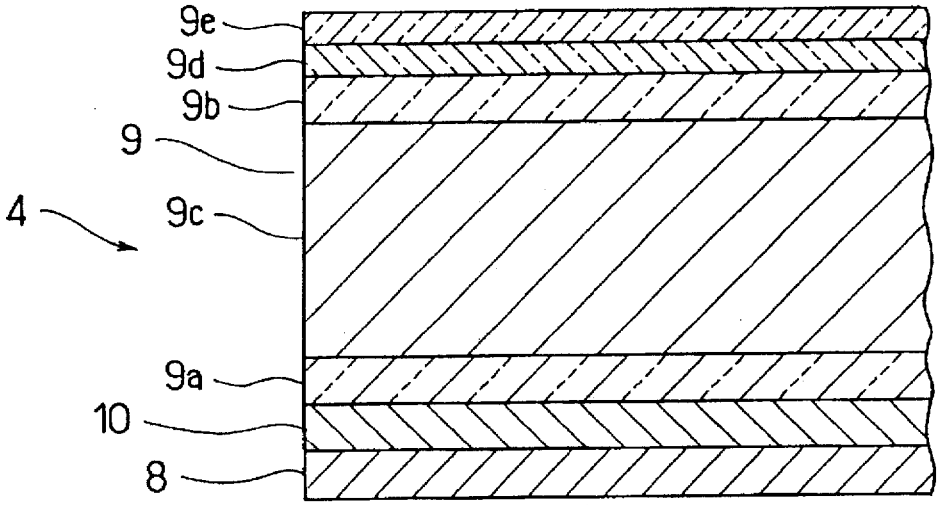
FIG. 3 is a schematic sectional view of a display device and a membrane switch employed in the display device.

Curvilinear aligned phase (NCAP) liquid crystal and is formed into the shape of a flat plate. The display device 4 has elasticity. FIG. 3 shows a diagrammatic sectional structure of the display device 4. More specifically, the display device 4 comprises an NCAP liquid crystal panel 9 having elasticity and light reflecting means or a reflector 10 which is made of an elastic material and disposed on the back of the panel 9. The membrane switch 8 is attached to the back of the reflector 10. The NCAP liquid crystal panel 9 includes a transparent electrode membrane 9*a* constituting individual electrodes, a transparent electrode membrane 9*b* constituting a common electrode, and an NCAP liquid crystal material 9*c* sandwiched between the membranes 9*a* and 9*b*. An ultraviolet barrier film 9*d* and a protecting sheet 9*e* are laminated on the transparent electrode membrane 9*b*. The barrier film 9*d* and the protecting sheet 9*e* are each made of a transparent material.

Figure 4A:
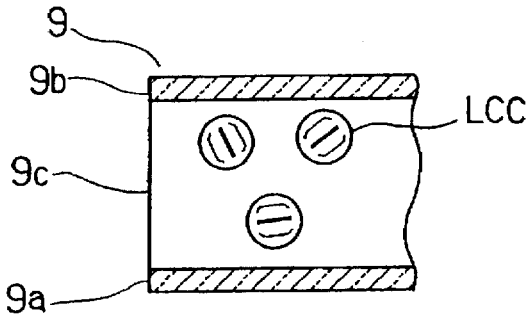
FIGS. 4A and 4B are schematic views showing operating principles of an NCAP liquid crystal employed in the display device.
Figure 4B:
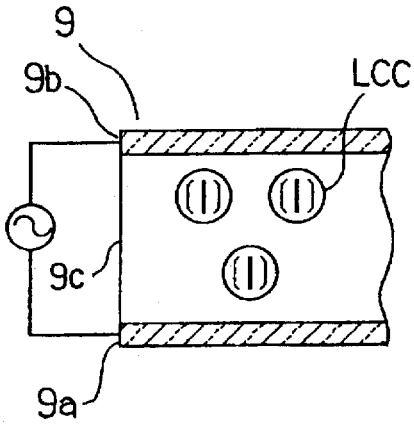

In the NCAP liquid crystal panel 9 constituted as described above, liquid crystal cells LCC in the NCAP liquid crystal material 9*c* are relatively free in a steady state in which no voltage is applied across the transparent electrode membranes 9*a* and 9*b*, as typically shown in FIG. 4A. Consequently, an incident light is scattered or absorbed such that the liquid crystal cells LCC function to restrain the incident light from passing through the NCAP liquid crystal panel 9. A quantity of light reflected on the reflector 10 is decreased according to the restraint of the incident light, whereupon the reflector 10 is dimmed. On the other hand, when an AC voltage is applied across the transparent electrode membranes 9*a* and 9*b*, the liquid crystal cells LCC are aligned as typically shown in FIG. 4B. Consequently, a quantity of light scattered or absorbed is decreased such that the liquid crystal cells LCC permit light to pass through the NCAP liquid crystal panel 9. A quantity of light reflected on the reflector 10 is accordingly increased, whereupon the reflector 10 is brightened.

A surface of the reflector 10 adjacent to the transparent electrode membrane 9*a* is colored. A transparent portion having a desired configuration is formed in the protecting sheet 9*e* so as to correspond to a colored portion of the reflector 10. A shielding layer is applied to the portion of the sheet 9*e* other than the transparent portion. Then, a desired figure or character hemmed by the shielding layer can serve as a display section with a desired color. Furthermore, a plurality of such display sections can be provided and each selectively operated when a plurality of the above-described transparent electrode membranes 9*a* are disposed so that voltage is applied separately to them. More specifically, the display device 4 in the embodiment is provided with a plurality of unit display areas or a plurality of display sections 11 to 19 for displaying a plurality of pieces of information about the washing operation respectively.

The arrangements and functions of the display sections 11 to 19 will be described. The colors set on the reflector 10 located at the backside of the panel 9 appear on the surfaces of the display sections 11 to 19 when the voltage is applied across the transparent electrode membranes 9*a* and 9*b*. The displaying operations of the display sections 11 to 19 are stopped with stop of the voltage application across the membranes 9*a* and 9*b*, so that the display sections 11 to 19 are dimmed.

(a) A mode display section 11 has a blue set on the reflector 10, for example. The mode display section 11 is provided for displaying either an AUTOMATIC mode in which the washing operation is automatically executed or a MANUAL mode in which operating conditions of the washing machine are manually set. An automatic operation key switch 8*a* and a manual operation key switch 8*b* are provided on portions of the membrane switch 8 corresponding to indications of AUTOMATIC and MANUAL respectively.

(b) An operation display section 12 has a green on the reflector 10, for example. The operation display section 12 is provided for displaying the location of a START key switch for starting and interrupting the washing operation. A START key switch 8*c* is provided on a portion of the membrane switch 8 corresponding to an indication of START/INTERRUPT.

(c) A course selecting display section 13 has a yellow on the reflector 10, for example. The course selecting display section 13 is provided for displaying one of a plurality of washing courses, STANDARD, POWERFUL, SPLIT WASH, BLANKET, SOFT, and TUB CLEANING. Six course selecting switches 8*d* are provided on portions of the membrane switch 8 corresponding to indications of STANDARD, POWERFUL, SPLIT, BLANKET, SOFT, and TUB CLEANING respectively.

(d) A step display section 14 has an orange on the reflector 10, for example. The step display section 14 is provided for displaying a step being currently executed among WASH, RINSE, and DEHYDRATION which are sequentially executed. The step display section 14 is also provided for displaying the location of a step selecting key switch for selecting the state in which these steps are individually executed. A WASH selecting key switch **8*e*, a RINSE selecting key switch 8*f*, and a DEHYDRATION selecting key switch 8*g* are provided on portions of the membrane switch 8 corresponding to indications of WASH, RINSE, and DEHYDRATION. The WASH selecting key switch 8*e* has a function of manually setting a wash period. The RINSE selecting key switch 8*f* has a function of manually setting the number of times of a rinsing operation. The DEHYDRATION key switch 8*g*** has a function of manually setting a dehydrating period.

(e) A time display section 15 has an orange on the reflector 10, for example. The time display section 15 is paired with the step display section 14 and is provided for displaying a remaining period or a set period of the wash step, a remaining number of times or set number of times of the rinsing operation, and a remaining period or set period of the dehydration step. The time display section 15 further has a function of displaying a set period by means of a reserve timer for setting a washing start time or a period between the current time and the washing start time.

(f) A setting change switch display section 16 has a yellow on the reflector 10, for example. The setting change switch display section 16 is provided for displaying the location of a setting change key switch for changing the standard mode of each of the wash, rinse, and dehydration steps under the condition that the above-described MANUAL mode has been selected. Wash water stream mode changing key switches **8*h* and 8*i* are provided on portions of the membrane switch 8 corresponding to indications of INTENSE and WEAK which are disposed in proximity to the wash selecting key switch 8*e*. Rinse mode changing key switches 8*j* and 8*k* are provided on portions of the membrane switch 8 corresponding to indications of MORE and CAREFUL which are disposed in proximity to the rinse selecting key switch 8*f*. Dehydrating speed changing key switches 8*m* and 8*n* are provided on portions of the membrane switch 8 corresponding to indications of HIGH and LOW which are disposed in proximity to the dehydration selecting key switch 8*g***.

(g) A timer setting display section 17 has a yellow on the reflector 10, for example. The timer setting display section 17 includes an indication of RESERVE/START AFTER which indicates that a remaining period of the reserve timer in the unit of hour is displayed on the portion corresponding to WASH in the time display section 15. The timer setting display section 17 further includes an indication of REMAINING PERIOD IN MINUTE which indicates that a remaining period of the wash step in the unit of minute is displayed on the above-described portion. A reserve timer key switch **8*o* for starting up the function of the reserve timer and setting a timer period is provided on a portion of the membrane switch 8** corresponding to the indication of REMAINING PERIOD IN MINUTE.

(h) A water-level selecting display section 18 has a blue on the reflector 10, for example. The water-level selecting display section 18 is provided for displaying the location of a water-level setting key switch for setting the level of water supplied into the tub under the condition that the MANUAL mode is selected. Four water-level setting key switches **8*p* are provided on portions of the membrane switch 8** corresponding to indications of water-levels respectively.

(i) A detergent quantity display section 19 has a white on the reflector 10, for example. The detergent quantity display section 19 is provided for displaying a quantity of detergent to be supplied to the tub under the condition that the AUTOMATIC mode is selected and a quantity of detergent in four stages in the case where a desired water-level has been selected by one of the water-level setting key switches **8*p***.

Figure 5:
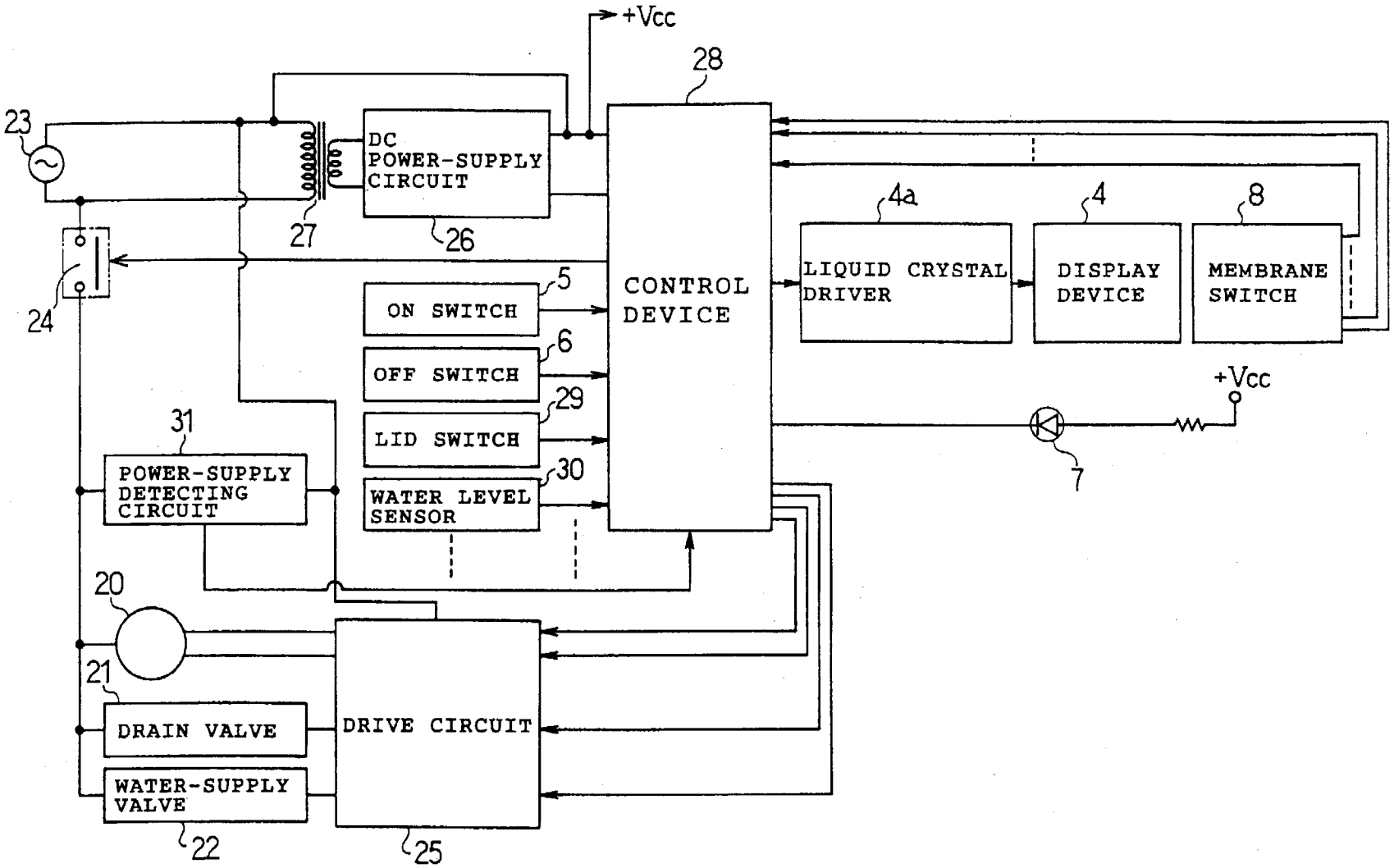
FIG. 5 is a circuit diagram showing an electrical arrangement of the washing machine.

Referring now to FIG. 5, an electrical arrangement for control of the washing machine is shown. An electric motor 20 for the washing operation, a drain valve 21, and a water-supply valve 22 are energized via a relay switch 24 and a drive circuit 25 by an AC power supply 23. A DC power supply circuit 26 is energized via a step-down transformer 27 by the AC power supply 23 such that the stabilized power-supply output is supplied to a control device 28 and the light-emitting diode 7. The display device 4 is driven by a liquid crystal driver **4*a*** comprising a power supply circuit generating a predetermined AC voltage, for example, rectangular waves of about 38 volts.

The control device 28 comprises a microcomputer and stores therein a program for controlling the washing operation. The control device 28 is supplied with signals from the ON switch 5, the OFF switch 6, and the membrane switch 8. The control device 28 is further supplied with signals from a lid switch 29 responsive to the opening of the lid 2, a water-level sensor 30 for detecting the water level in the tub, a power-supply detecting circuit 31, and various signal generators (not shown). The power-supply detecting circuit 31 generates a power input detection signal when the relay switch 24 is turned on or when the motor 20, the drain valve 21, and the water-supply valve 22 can be energized via the drive circuit 25, thereby supplying the signal to the control device 28. Based on the above-described input signals and the previously stored program, the control device 28 controls the relay switch 24 and the drive circuit 20 for controlling the motor 20, the drain valve 21, and the water-supply valve 22, the liquid crystal driver **4*a* for controlling the display device 4, and controls the light-emitting diode 7**.

A part of the control of the display device 4 by the control device 28 will be described with reference to FIGS. 6A to 6D. FIGS. 6A–6D each show the same state as in FIG. 1 regarding the portions in the display sections 11–19 where the continuous displaying operation is being performed. A portion where the intermittent displaying operation is being performed is checkered. A strip of slanting lines indicates a portion where the displaying operation is stopped.

Figure 6A:
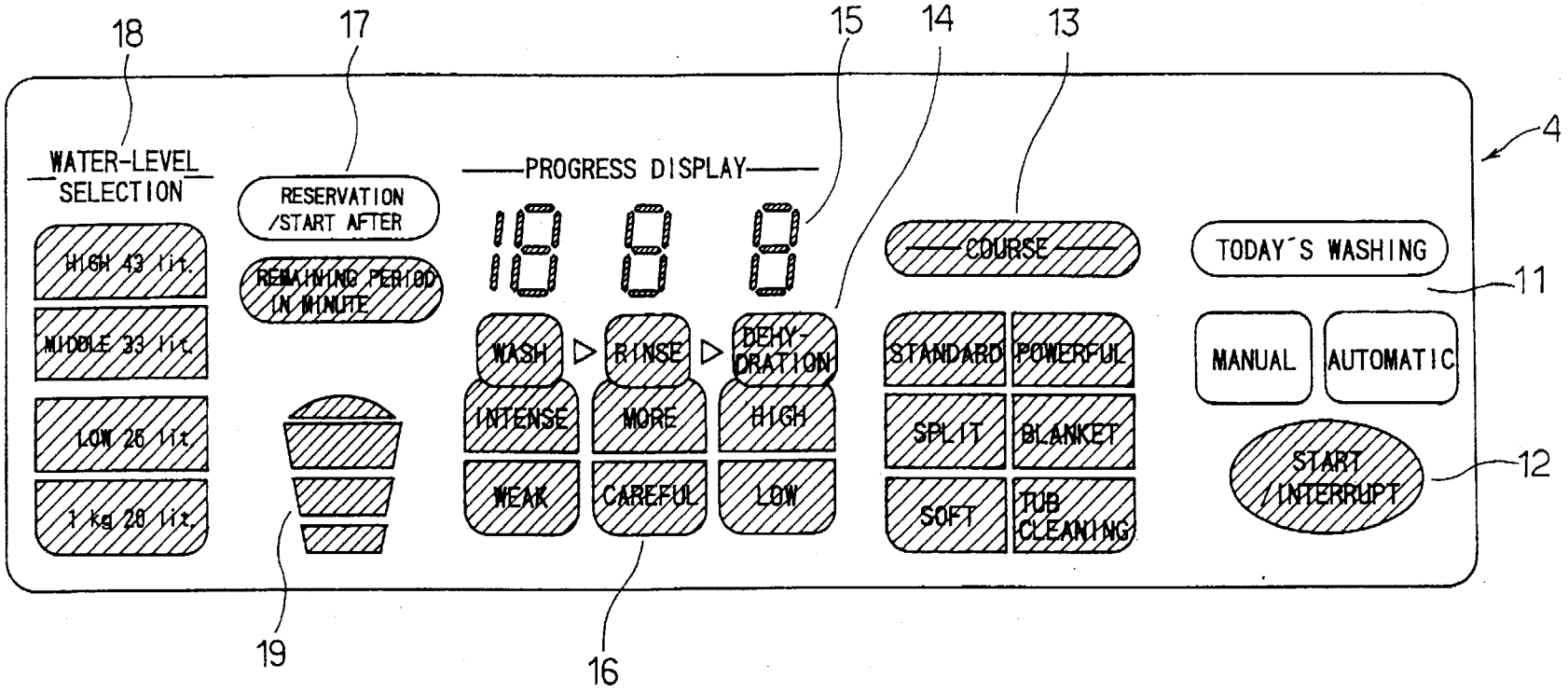
FIGS. 6A to 6D are front views of the display device showing displayed contents.

(1) The relay switch 24 is turned on upon turn-on of the ON switch 5, so that the display device 4 is changed to an active state. Several display sections of the display device 4 are switched to a continuous displaying state as shown in FIG. 6A when the power input detection signal is supplied from the power-supply detecting circuit 31 to the control device 28 with the change of the display device 4 to the active state. More specifically, the whole mode display section 11 corresponding to the key switches **8*a*, 8*b* and 8*o*, and the indication of RESERVE/START AFTER in the timer setting display section 17** are switched to the continuous displaying state. These switches are rendered operable upon power input to the washing machine.

Figure 6B:
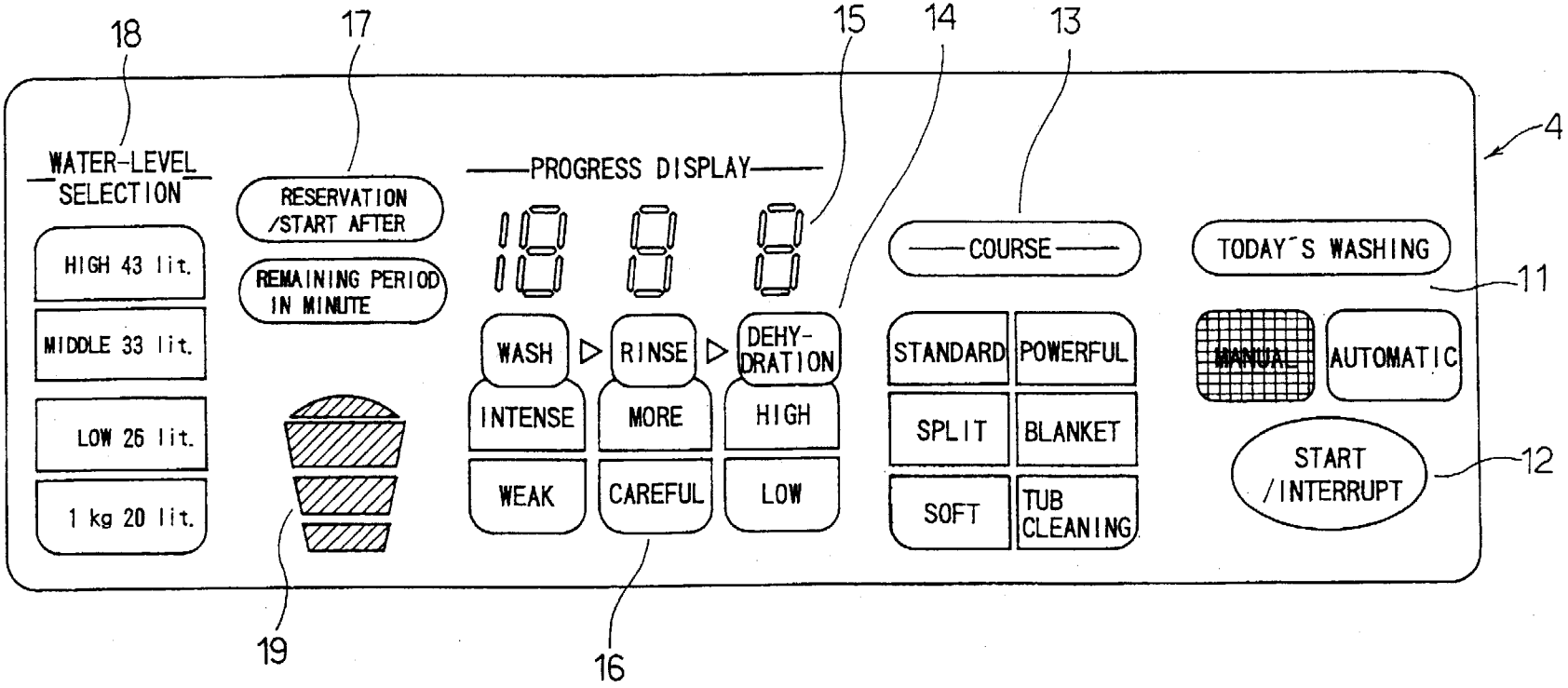

(2) Subsequently, when the manual operation key switch **8*b* corresponding to the indication of MANUAL is depressed, for example, several display sections are switched to a display mode as shown in FIG. 6B. More specifically, the display sections switched to the continuous displaying state upon depression of the key switch 8a include the indication of AUTOMATIC of the mode display section 11, the operation display section 12, the course selecting display section 13, the step display section 14, the time display section 15, the setting change switch display section 16, the timer setting display section 17, and the water-level selecting display section 18. These display sections correspond to the key switches 8a, 8c to 8k, and 8m to 8p respectively. Furthermore, the indication of MANUAL of the mode display section 11** is switched to an intermittent displaying mode.

Figure 6C:
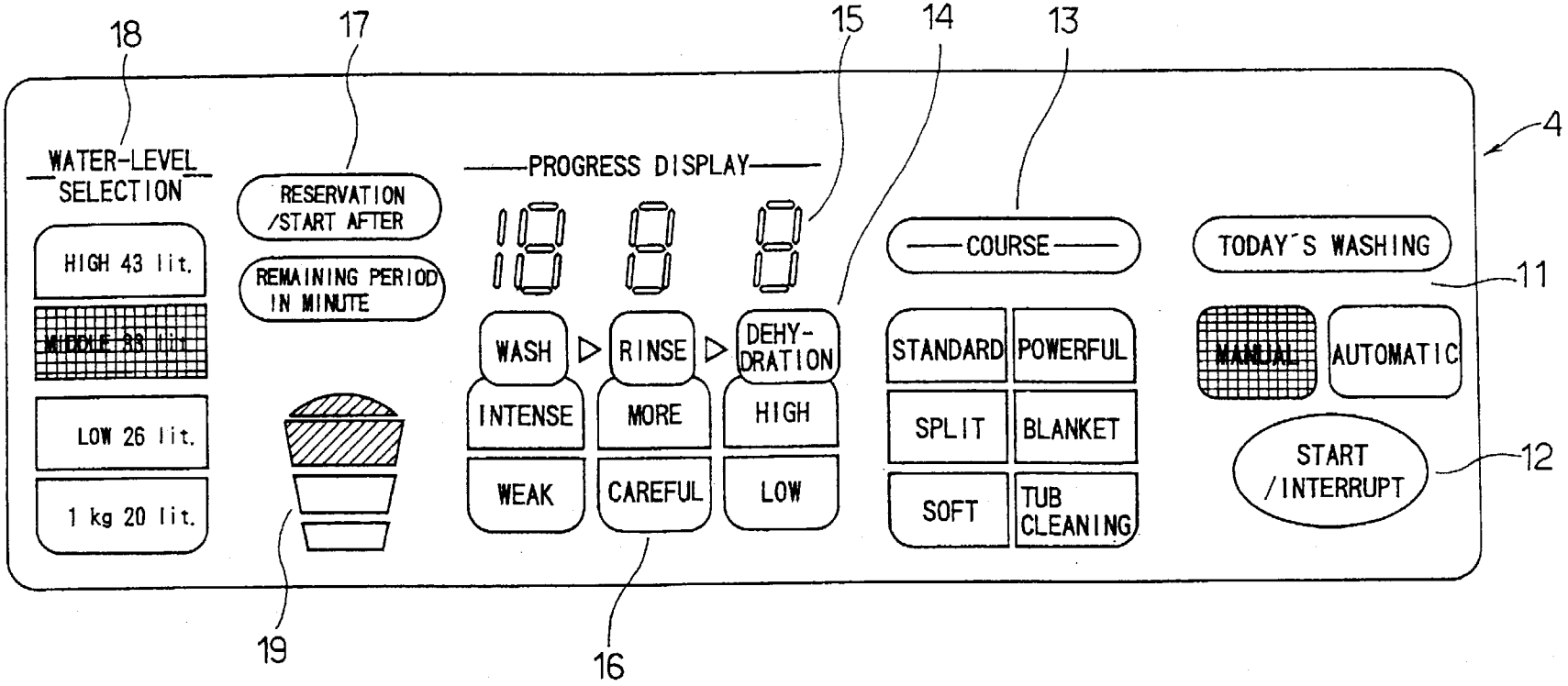

(3) One of the water-level setting key switches 8p of the water-level selecting display 18 is depressed under the condition that the MANUAL mode has been selected, for example. Then, one of the indications of the water-level selecting display section 18 corresponding to the depressed key switch 8p is switched to the intermittent displaying mode, as shown in FIG. 6C. Furthermore, the detergent quantity display section 19 is switched to the continuous displaying state to display a quantity of detergent suitable for the selected water-level.

(4) When one of the key switches 8d to 8k and 8m to 8o corresponding to the respective display sections 13, 14 16, and 17 is depressed under the condition that the MANUAL mode has been selected, the indication corresponding to the depressed key switch is switched to the intermittent displaying mode. Accordingly, the above-described intermittent displaying operation permits easy understanding of various settings under the condition that the MANUAL mode has been selected.

Figure 6D:
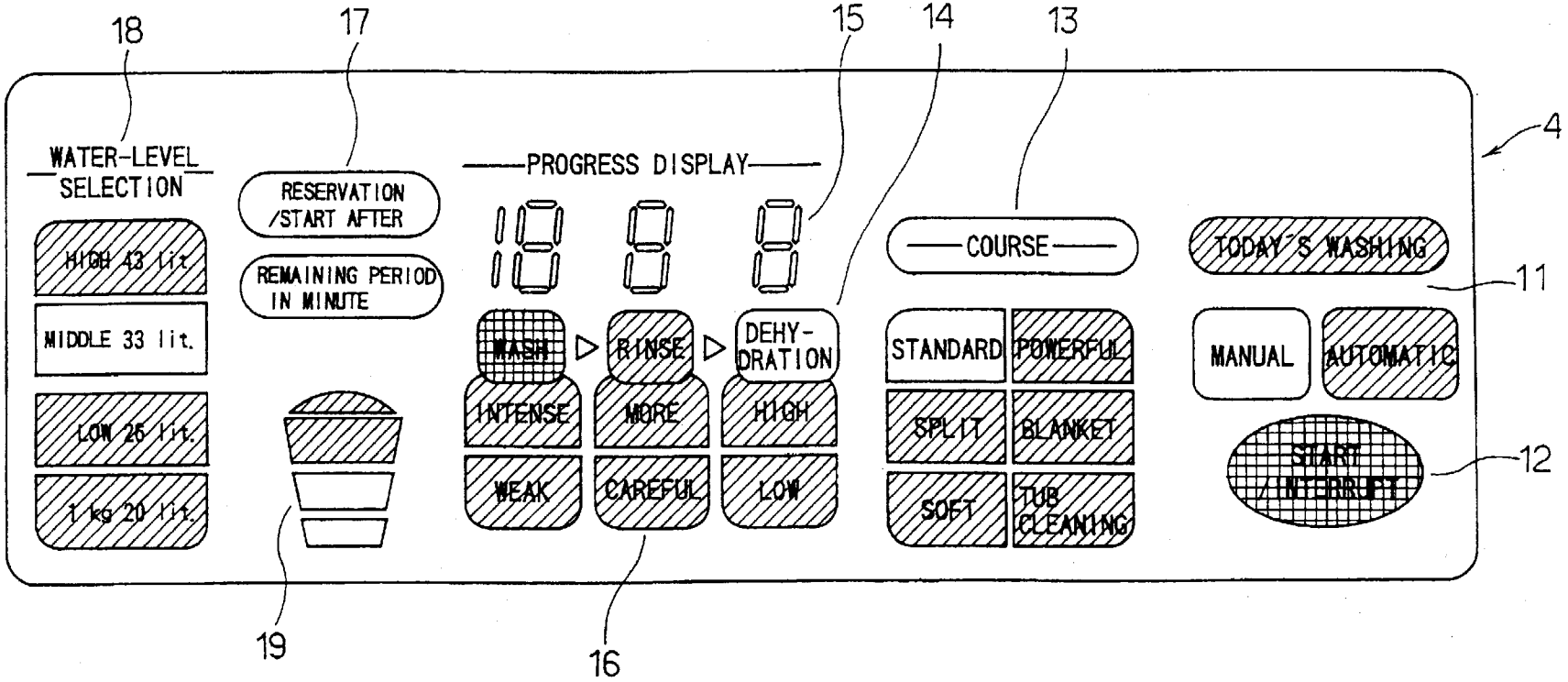

(5) The START/INTERRUPT key switch 8c of the operation display section 12 is depressed under the condition that the settings in the MANUAL mode have been performed. Then, the display sections which are in the intermittent displaying state are switched to the continuous displaying state, whereas the operation display section 12 is switched to the intermittent displaying state, as shown in FIG. 6D. Furthermore, the indication of the step display section 14 indicative of the currently executed operation step is switched to the intermittent displaying state.

The control device 28 turns off the relay switch 24 when the OFF switch 6 is turned on or when a sequence of control for the washing operation has been completed. The control device 28 terminates the displaying operation of the display device 4 when input of the power input detection signal from the power-supply detecting circuit 31 to the control device 28 is interrupted.

Figure 7:
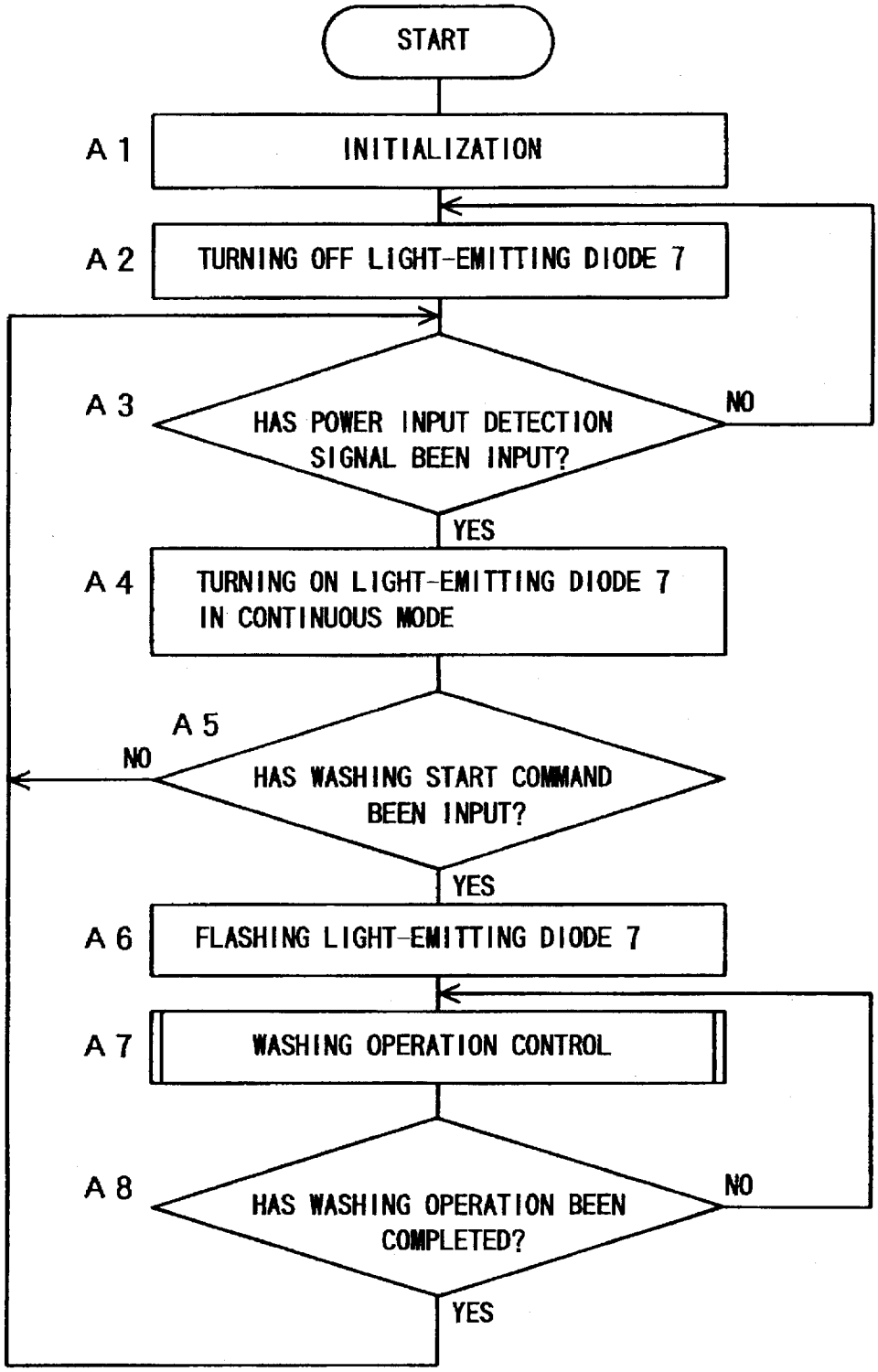
FIG. 7 is a flowchart showing a control manner of a control device.

FIG. 7 illustrates the control manner of the control device 28 and more specifically, the control of the light-emitting diode 7 functioning as a pilot lamp. The control device 28 executes a predetermined initialization step A1 when power is applied thereto and subsequently, turns off the light-emitting diode 7 (step A2). The light-emitting diode 7 is maintained in the off state until the power input detection signal is input from the power-supply detecting circuit 31 to the control device 28 (step A3). The light-emitting diode 7 is switched to the on state when the power input detection signal is input to the control device 28 (step A4).

The control device 28 then determines whether or not a command for the start of the washing operation is supplied thereto (step A5). The control device 28 returns to step A3 when determining that the start command is not supplied thereto. The light-emitting diode 7 is switched to a flashing state when the control device 28 determines that the start command has been supplied thereto (step A6). Subsequently, the control device 28 executes a washing operation control routine A7 for the control of the display device 4 as described above and for the control of the washing operation. Execution of the washing operation control routine A7 is continued at step A8 until the control device 28 determines that the washing operation has been completed or that the OFF switch 6 has been operated. The control device 28 returns to step A3 when determining at step A8 that the washing operation has been completed or terminated.

According to the above-described embodiment, the display device 4 for displaying the operation modes of the washing operation comprises the NCAP liquid crystal panel 9 having elasticity and the reflector 10 having elasticity and disposed on the back of the NCAP liquid crystal panel 9. Furthermore, the membrane switch 8 is attached to the back of the reflector 10 and includes a number of key switches 8a to 8k and 8m to 8o attached to the back of the reflector 10. The NCAP liquid crystal panel 9 has a wide angle of visibility and has a small power consumption as compared with the light-emitting diodes or the fluorescent character display tubes employed in the display device of the conventional washing machines. Additionally, no back light is required. Consequently, the visibility of the display device 4 can be improved, and the power consumption thereof can be reduced. Furthermore, since the NCAP liquid crystal panel 9 can be thinned to a large extent, the display device 4 can also be thinned accordingly. Additionally, since the thin membrane switch 8 is employed as the switch means, the thickness of the switch means can be reduced. Consequently, the freedom in the design of the washing machine can be improved. More specifically, when the display device 4 is disposed on the front top of the outer cabinet 1 as described above, the washing machine can be designed so that the height at the front side of the outer cabinet 1 is reduced for an operator easily taking the laundry out of the tub.

The size of an operating part of each of the display device and the switch means is limited when the display device and the switch means are adjacent to each other as in the prior art arrangement. However, since the display device 4 is laid over the membrane switch 8 in the above-described embodiment, such a limitation of the size of the operating part of each of the display device and the switch means can be eliminated. Consequently, the visibility of the display device 4 and the operability of the membrane switch 8 can be improved. Additionally, the optical characteristics of the NCAP liquid crystal panel 9 are not adversely affected even when pressure is applied thereto. Consequently, the displaying function of the NCAP liquid crystal panel 9 is not deteriorated even when pressure is applied thereto upon depression of the membrane switch 8.

The display device 4 includes a plurality of display sections 11 to 19 for displaying a plurality of pieces of information about the washing operation respectively. A plurality of key switches 8a to 8k and 8m to 8o are provided on the membrane switch 8 so as to correspond to the display sections 11 to 19. Consequently, the displayed contents can be diversified, and the operability of the display device can be improved. Furthermore, one or more of the display sections 11–19 corresponding to the key switches 8a–8k and 8m–8o the operation of which is effective perform the displaying operation. Consequently, occurrence of error in operation can be advantageously prevented.

Even in the provision of the plurality of display sections 11–19 as described above, the colors displayed by the respective display sections 11–19 can be optionally set by selection of the colors on the reflector 10. Consequently, the contents displayed by the display device 4 can be further diversified and the visibility thereof can be further improved.

The indications of WASH, RINSE, and DEHYDRATION of the step display section 14 provided for displaying the progress of the steps of the washing operation are switched to the displaying state during the washing operation. The indication corresponding to the currently executed step is switched to the intermittent displaying state. Thus, the displaying function as performed in the washing machine can be improved. The same effect can be achieved when only one of the indications that corresponds to the currently executed step may be switched to the displaying state.

In the foregoing embodiment, the control device 28 controls the light-emitting diode 7 so that the same is selectively lighted or flashed. Alternatively, the light-emitting diode 7 may be continuously lighted under the condition that power is applied to the washing machine or that the relay switch 24 is turned on. For this purpose, a switch circuit is provided which is turned on when the power input detection signal is delivered by the power-supply detecting circuit 31. Connection is provided so that an energizing path for the light-emitting diode 7 is formed through the switch circuit.

Figure 8:
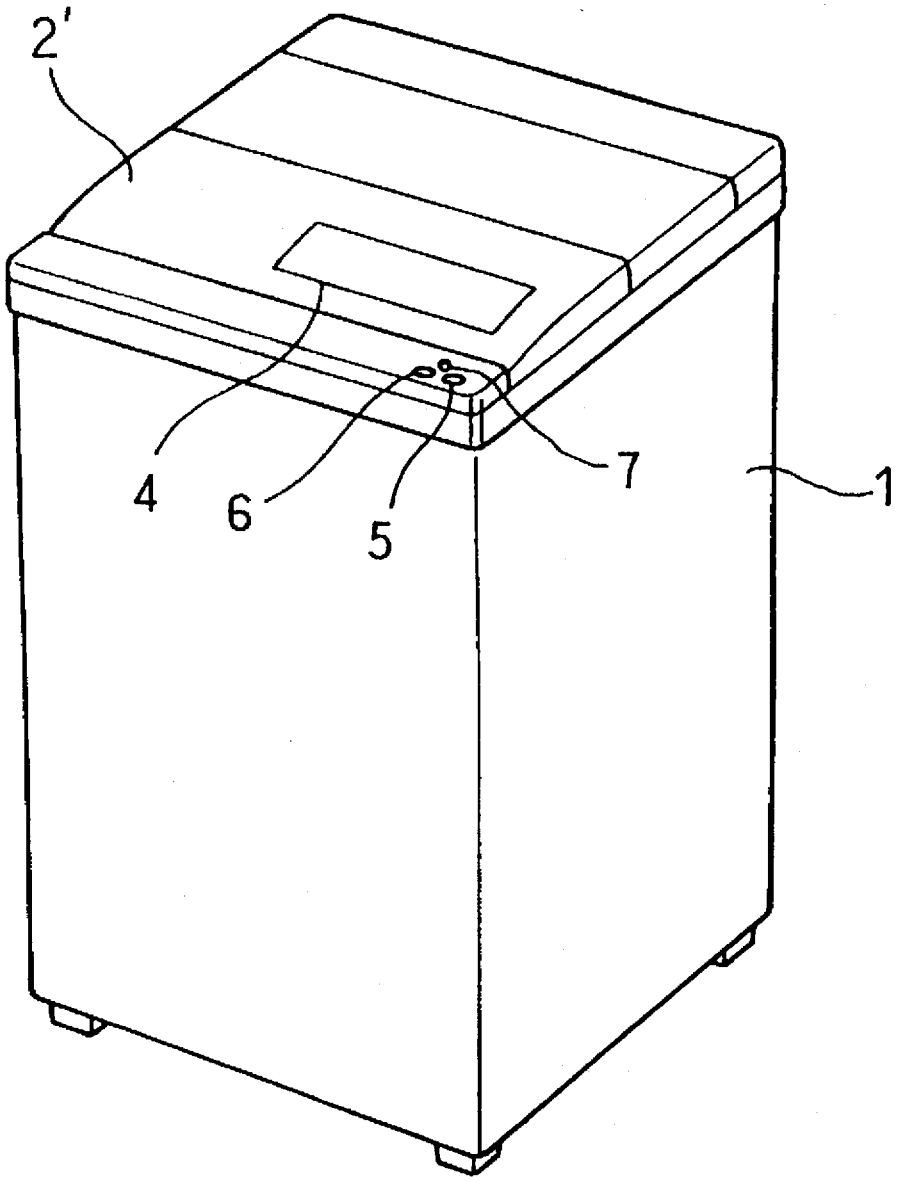
FIG. 8 is a perspective view of an automatic washing machine of a second embodiment in accordance with the present invention.

FIG. 8 illustrates a second embodiment of the present invention. Differences between the first and second embodiments will be described. A unit of the display device 4 and the membrane switch (not shown) associated therewith is disposed in the front divided portion of the folding lid 2'.

In the second embodiment, the visibility of the display device 4 can be improved, and the freedom in the configuration and structure of the outer cabinet 1 can be improved. Thus, the arrangement of the second embodiment contributes to the designing of the outer cabinet 1 so that the height at the front side of the outer cabinet 1 is reduced. Furthermore, since each of the display device 4 and the membrane switch can be thinned to a large extent, provision of the display device 4 and the membrane switch does not prevent the functions of the lid 2'.

Figure 9:
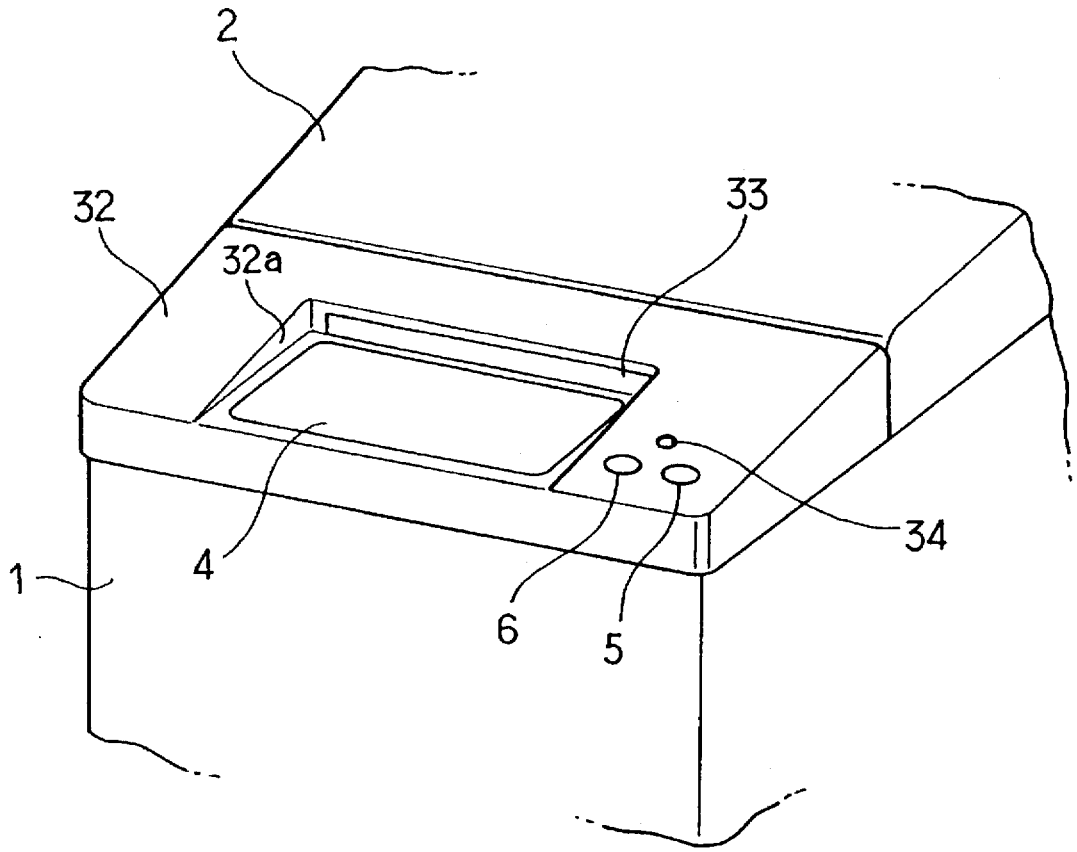
FIG. 9 is a partial perspective view of an automatic washing machine of a third embodiment in accordance with the present invention.
Figure 10:
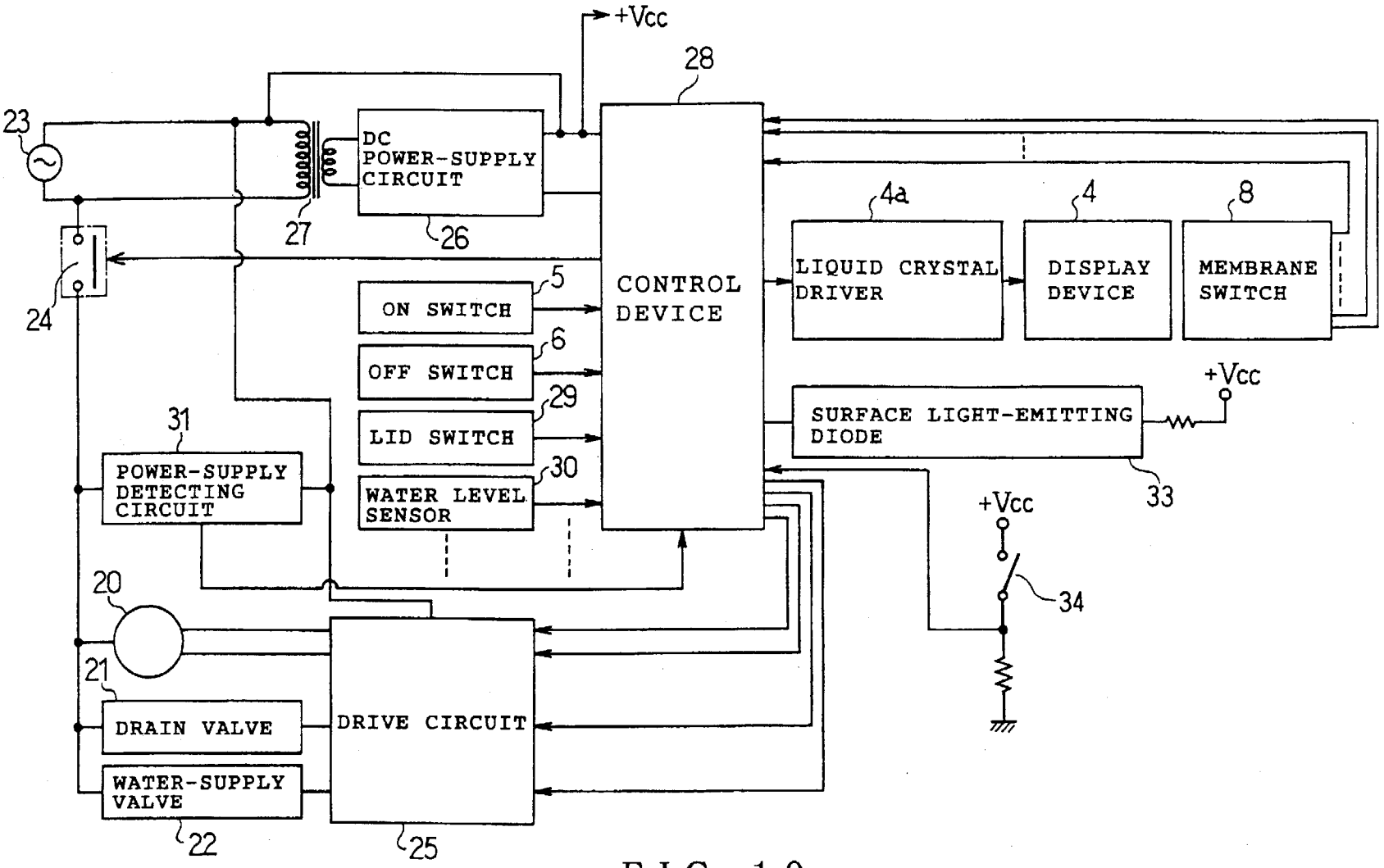
FIG. 10 is a circuit diagram showing an electrical arrangement of the washing machine of the third embodiment.

FIGS. 9 and 10 illustrate a third embodiment of the present invention. Differences between the first and third embodiments will be described. Referring to FIG. 9, the operation panel 32 provided on the front top of the outer cabinet 1 is formed so as to be inclined forward. The operation panel 32 has in the inclined portion thereof a rectangular concavity **32*a* in which the display device 4 is to be horizontally disposed. A surface light-emitting diode 33 serving as light-emitting means is disposed on a portion of an inner wall of the concavity 32*a*, the portion being exposed when the display device 4 has been disposed in the concavity 32*a* as described above. The surface light-emitting diode 33 illuminates the display device 4 obliquely downward. An operation switch 34 is provided in the operation panel 32 for manually turning the surface light-emitting diode 33** on and off.

Referring to FIG. 10, power applied to the surface light-emitting diode 33 is obtained from the DC power supply circuit 26. The surface light-emitting diode 33 is controlled by the control device 28. An operation signal is supplied from the operation switch 34 to the control device 28. The control device 28 switches the surface light-emitting diode 33 between the on and off states alternately repeatedly every time the same receives the operation signal.

According to the third embodiment, the display device 4 can be illuminated by the surface light-emitting diode 33 upon manual operation of the operation switch 34. Consequently, the contents displayed on the display device 4 can be easily confirmed even when it is dark around the washing machine. The illuminating function is selectively effected only when it is required, which provides convenience in the practical use of the washing machine.

The operation for illuminating the display device 4 can be eliminated when the surface light-emitting diode 33 is automatically turned on upon application of power to the washing machine. For this purpose, the control device 28 may be provided with a function of turning on the surface light-emitting diode 33 upon receipt of the power input detection signal from the power-supply detecting circuit 31. Alternatively, a switch circuit may be provided which is turned on when the power input detection signal is delivered by the power-supply detection circuit 31. Connection is provided so that an energizing path for the surface light-emitting diode 33 is formed through the switch circuit.

Figure 11:
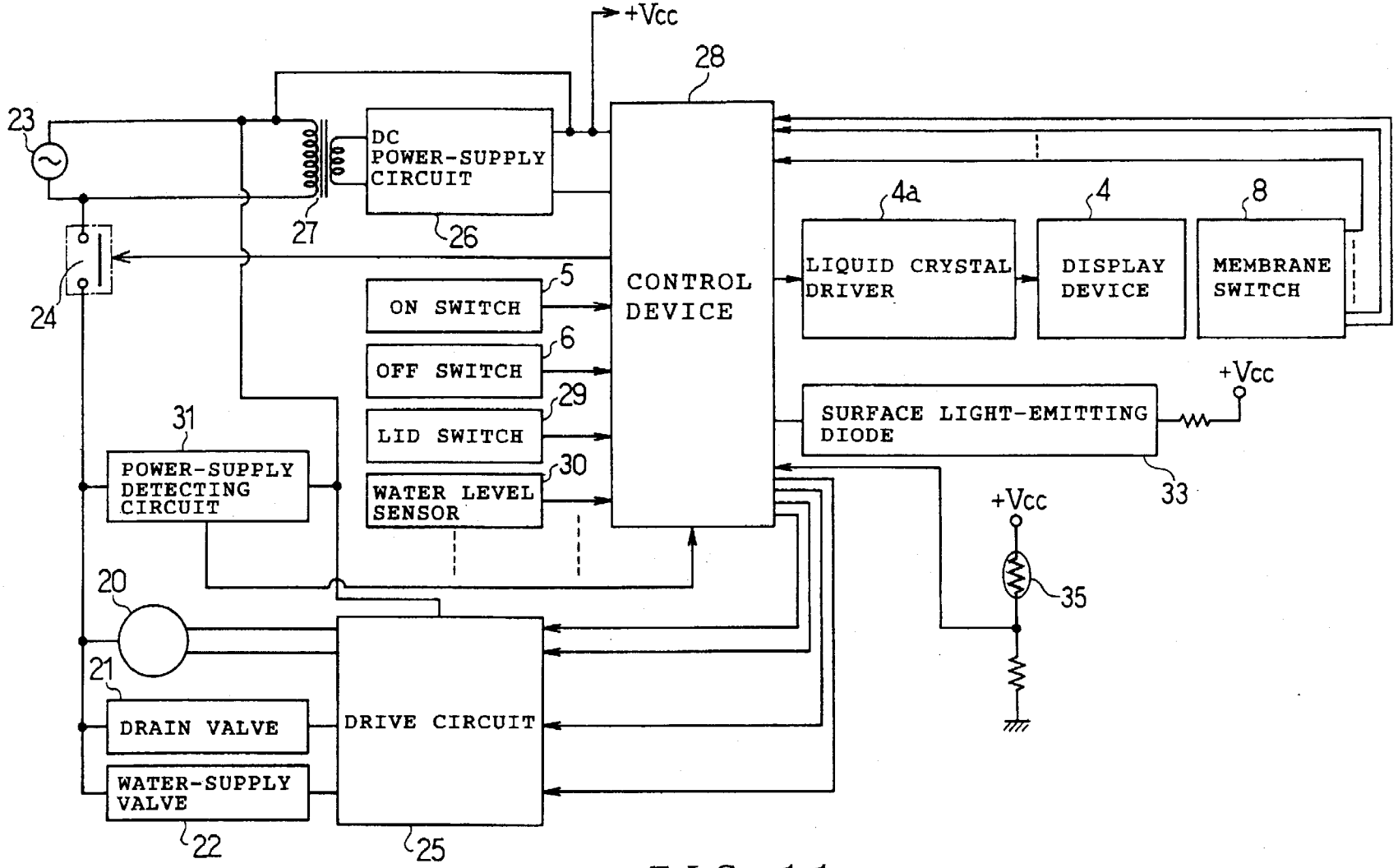
FIG. 11 is a circuit diagram showing an electrical arrangement of an automatic washing machine of a fourth embodiment in accordance with the present invention.
Figure 12:
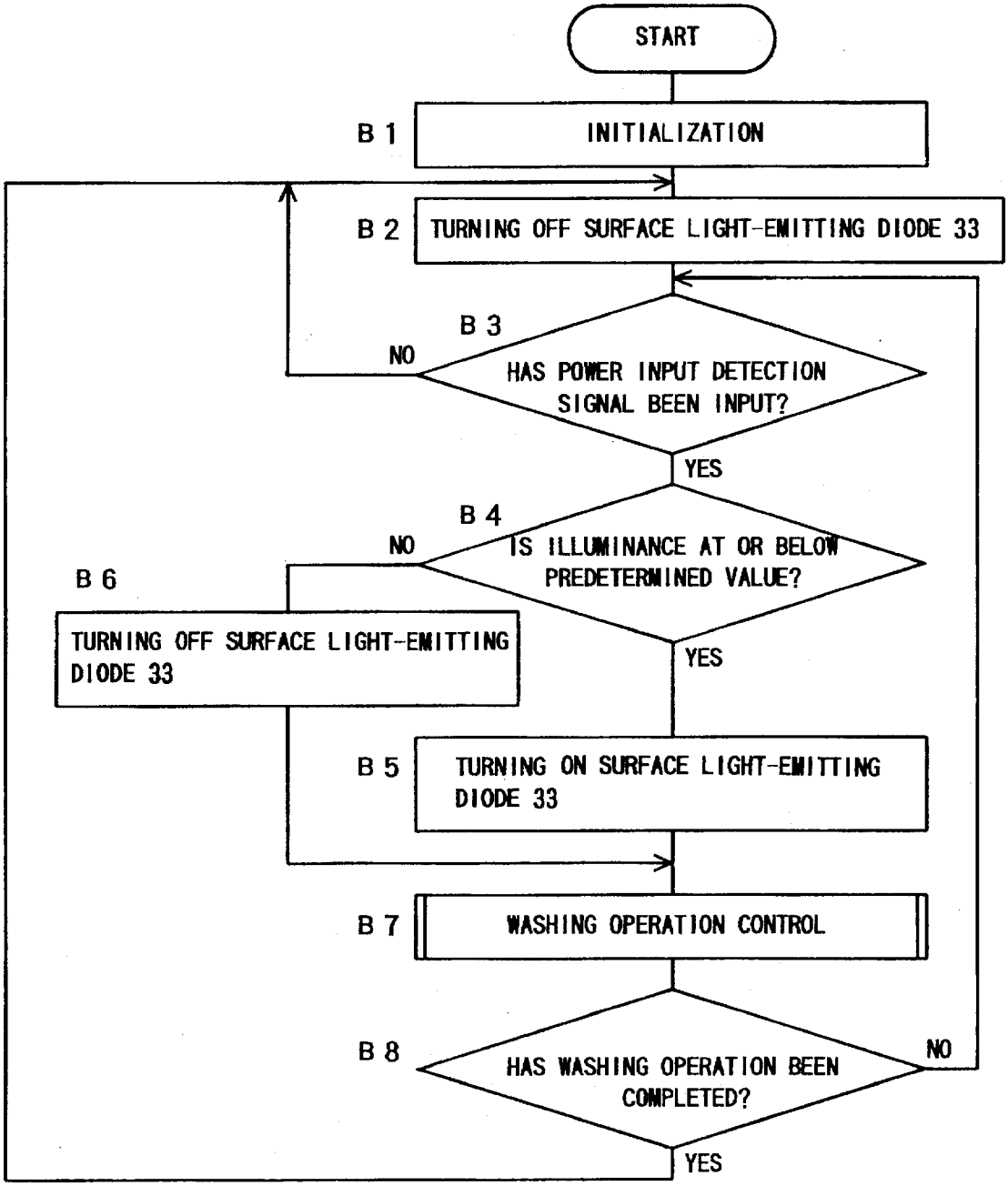
FIG. 12 is a flowchart showing a control manner of a control device employed in the washing machine of the fourth embodiment.

FIGS. 11 and 12 illustrate a fourth embodiment of the present invention. Differences between the third and fourth embodiments will be described. Referring to FIG. 11, a cadmium sulfide (CdS) cell 35 serving as illuminance measuring means is disposed on the top of the outer cabinet 1 for measuring the illuminance around the washing machine. The CdS cell 35 is connected to the control device 28 to supply to the same a voltage signal the level of which is in accordance with the measured illuminance.

FIG. 12 illustrates a control manner of the control device 28 mainly in relation to the control of the surface light-emitting diode 33. The control device 28 executes a predetermined initialization step B1 when power is applied thereto and subsequently, turns off the surface light-emitting diode 33 (step B2). The surface light-emitting diode 33 is maintained in the off state until the power input detection signal is input from the power-supply detecting circuit 31 to the control device 28 (step B3). Upon input of the power input detection signal, the control device 28 determines whether or not the illuminance measured by the CdS cell 35 is at or below a predetermined value (step B4).

The surface light-emitting diode 33 is turned on when the measured illuminance is at or below the predetermined value (step B5). Subsequently, the control device 28 advances to the washing operation control routine B7 including a step at which the control device 28 determines as to input of the start command for the washing operation. When the measured illuminance is above the predetermined value, the control device 28 turns off the surface light-emitting diode 33 (step B6), then advancing to the washing operation control routine B7. The control at and after step B3 is continuously executed until the control device 28 determines at step B8 that the washing operation has been completed or that the OFF switch 6 has been operated. The control device 28 returns to step B2 when determining at step B8 that the washing operation has been completed or terminated.

According to the fourth embodiment, the surface light-emitting diode 33 is turned on only when the illuminance in the atmosphere around the outer cabinet 1 is at or below the predetermined level. Consequently, the surface light-emitting diode 33 can be turned on economically.

Figure 13:
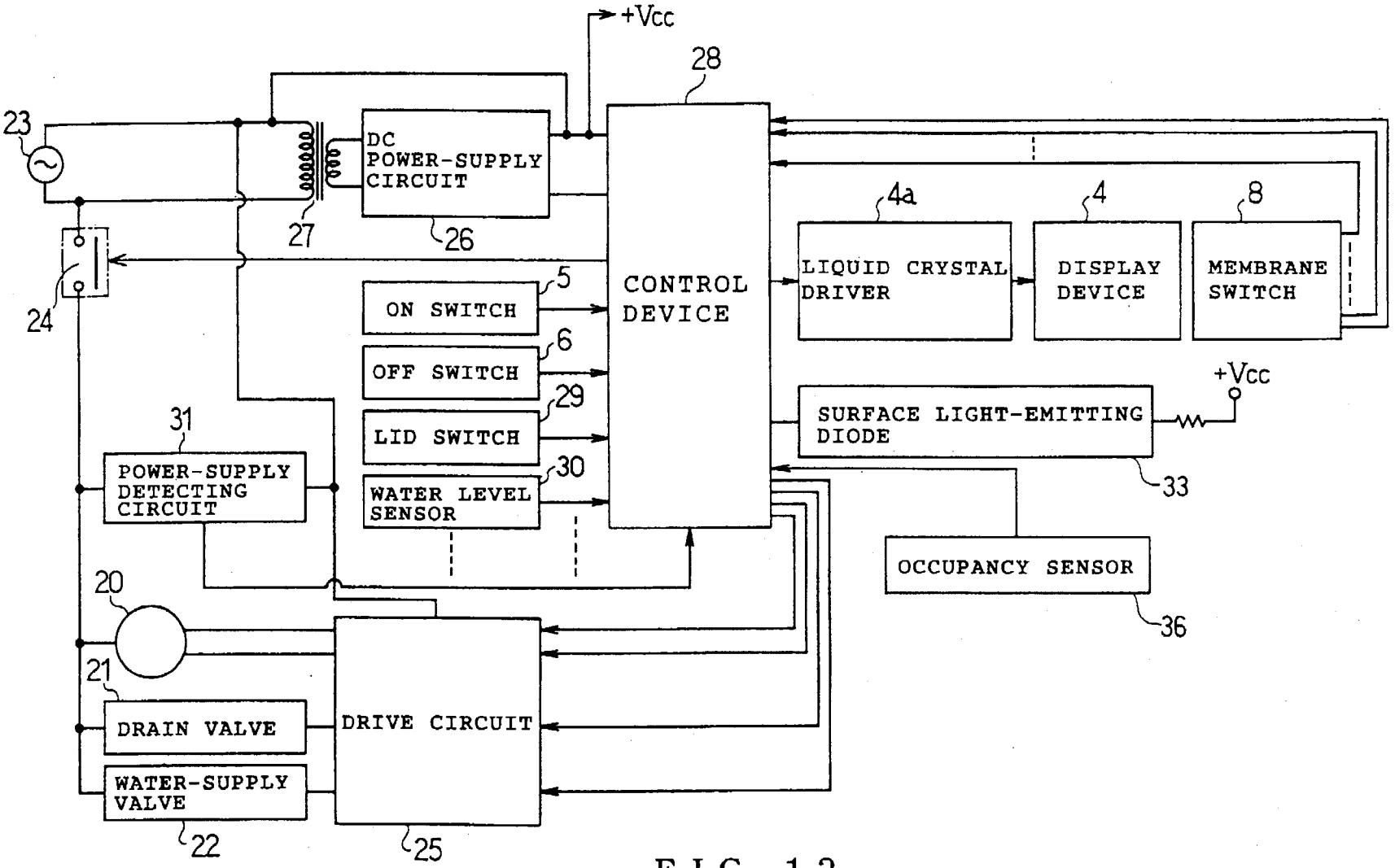
FIG. 13 is a circuit diagram showing an automatic washing machine of a fifth embodiment in accordance with the present invention.
Figure 14:
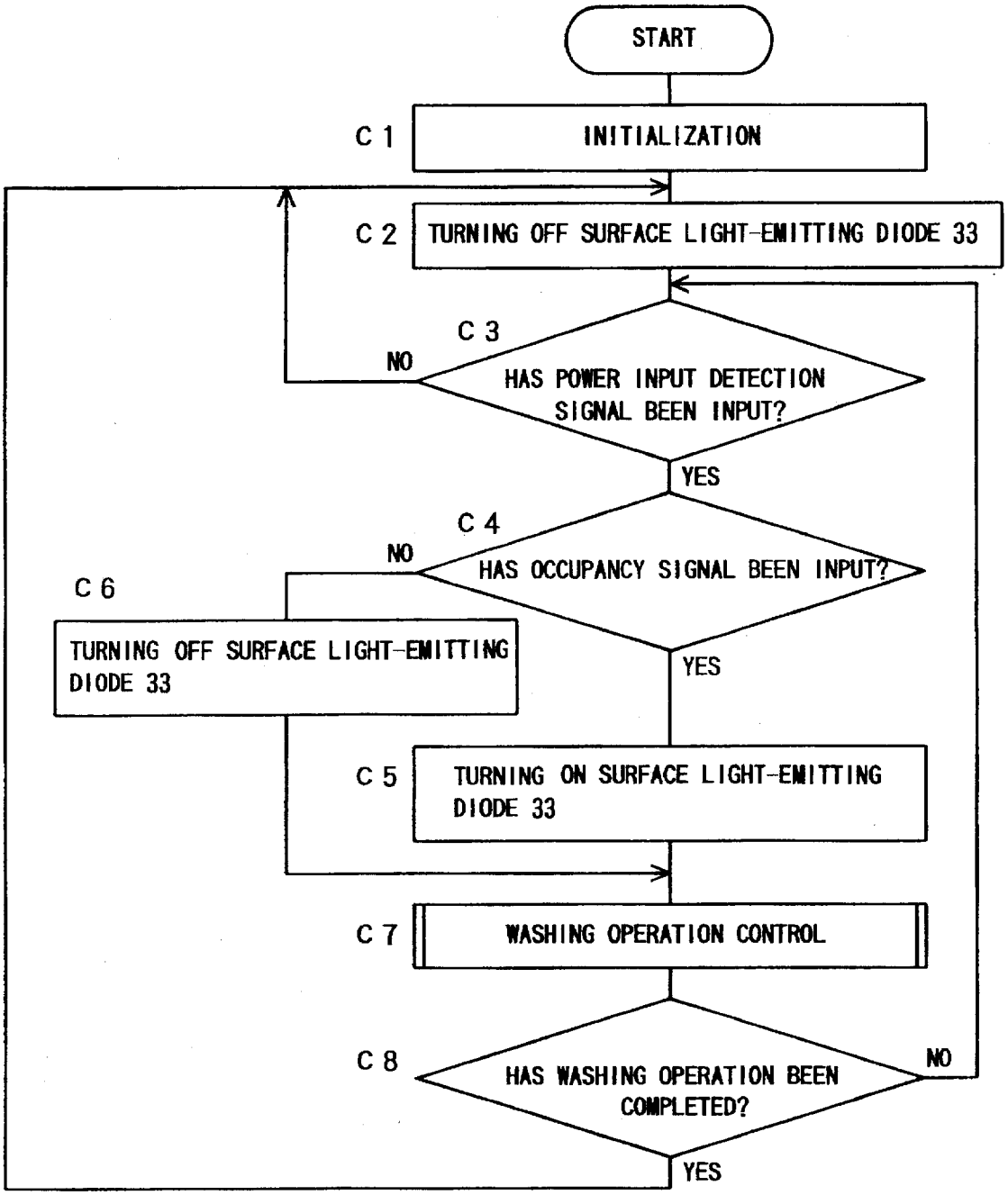
FIG. 14 is a flowchart showing a control manner of a control device employed in the washing machine of the fifth embodiment.

FIGS. 13 and 14 illustrate a fifth embodiment of the invention. Differences between the third and fifth embodiments will be described. Referring to FIG. 13, an occupancy sensor 36 is mounted on the front of the outer cabinet 1 for detecting presence of a human being in the vicinity of the outer cabinet 1. The occupancy sensor 36 comprises a pyroelectric infrared ray sensor, for example. The occupancy sensor 36 is connected to the control device 28 so as to deliver an occupancy signal to the control device 28 when a human being occupies an area within a predetermined distance from the outer cabinet 1.

FIG. 14 illustrates a control manner of the control device 28 mainly in relation to the control of the surface light-emitting diode 33. The control device 28 executes a predetermined initialization step C1 when power is applied thereto and subsequently, turns off the surface light-emitting diode 33 (step C2). The surface light-emitting diode 33 is maintained in the off state until the power input detection signal is input from the power-supply detecting circuit 31 to the control device 28 (step C3). Upon input of the power input detection signal, the control device 28 determines whether or not the occupancy signal has been input thereto (step C4).

The surface light-emitting diode 33 is turned on when the occupancy signal has been input to the control device 28, that is, when a human being is present in the area within the predetermined distance from the outer cabinet 1 (step C5). Subsequently, the control device 28 advances to the washing operation control routine C7 including a step at which the control device 28 determines as to input of the start command for the washing operation. When no occupancy signal has been input, the control device 28 turns off the surface light-emitting diode 33 (step C6), then advancing to the washing operation control routine C7. The control at and after step C3 is continuously executed until the control device 28 determines at step C8 that the washing operation has been completed or that the OFF switch 6 has been operated. The control device 28 returns to step C2 when determining at step C8 that the washing operation has been completed or terminated.

According to the fifth embodiment, the surface light-emitting diode 33 is automatically turned on only when a human being is in the area within the predetermined distance from the outer cabinet 1, that is, only when illumination of the display device 4 is necessitated. Consequently, the surface light-emitting diode 33 can be prevented from being uselessly turned on.

Figure 15:
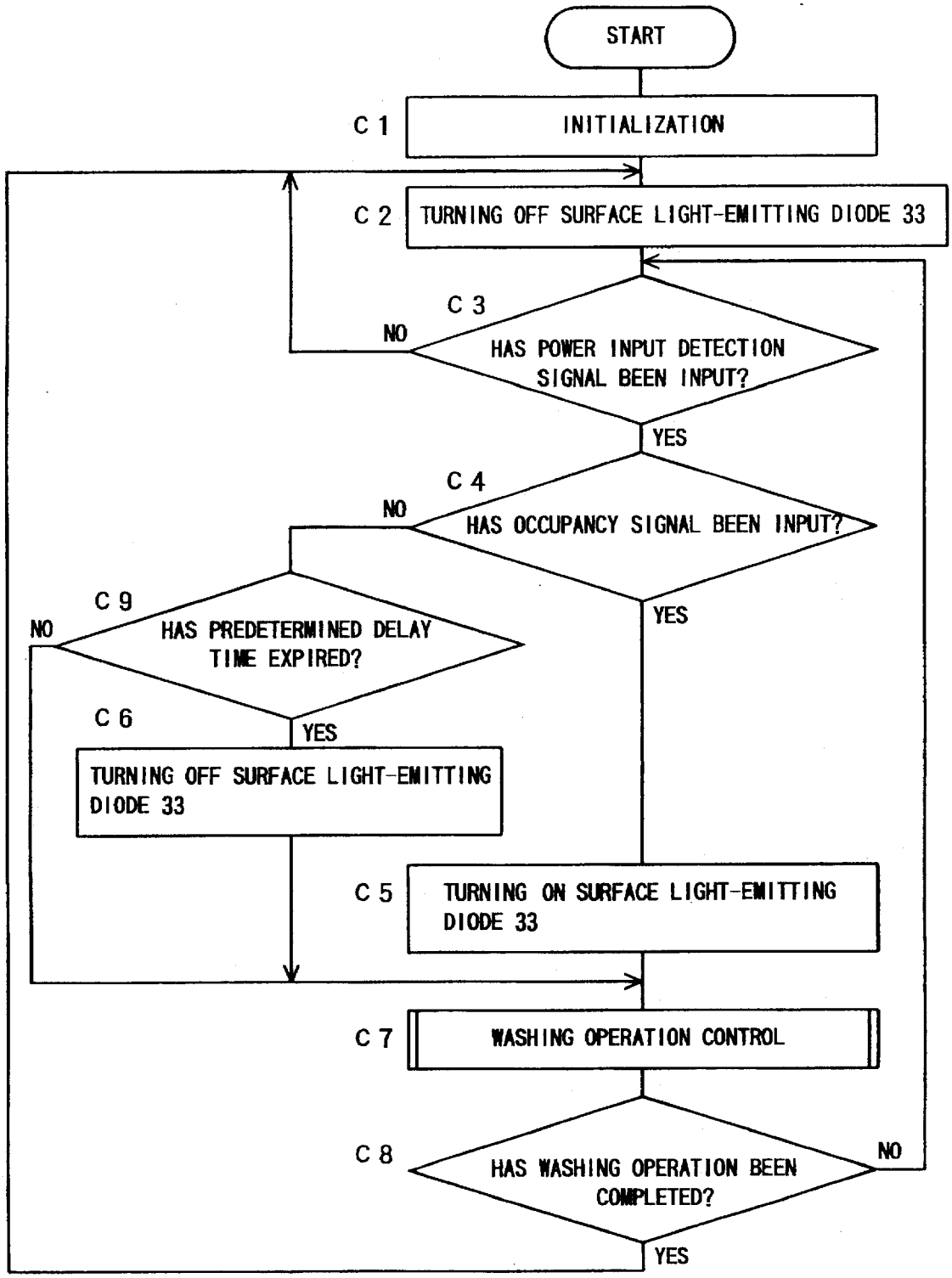
FIG. 15 is a flowchart showing a control manner of a control device employed in an automatic washing machine of a sixth embodiment in accordance with the present invention.

FIG. 15 illustrates a sixth embodiment of the invention. The control device 28 determines whether a predetermined delay time has expired or not (step C9) when determining in the negative at step C4. The control device 28 advances to the washing operation control routine C7 when the predetermined delay time has not expired. When the delay time has expired, the control device 28 turns off the surface light-emitting diode 28 at step C6, thereafter advancing to the washing operation control routine C7.

According to the sixth embodiment, the surface light-emitting diode 33 is turned off only when the delay time has expired after the switching of the occupancy sensor 36 from the detecting state to the non-detecting state. Consequently, the surface light-emitting diode 36 can be prevented from being turned off unnecessarily early.

The surface light-emitting diode 33 serving as the light-emitting means is provided for illuminating the display device 4 obliquely downwardly, in the above-described third to sixth embodiments. Alternatively, a light-emitting diode may be provided for emitting light toward a transparent portion of the NCAP liquid crystal panel 9 constituting the display device 4 and more specifically, toward the barrier film **9*d* and the protecting sheet 9*e*** directly from the sides thereof.

Figure 23:
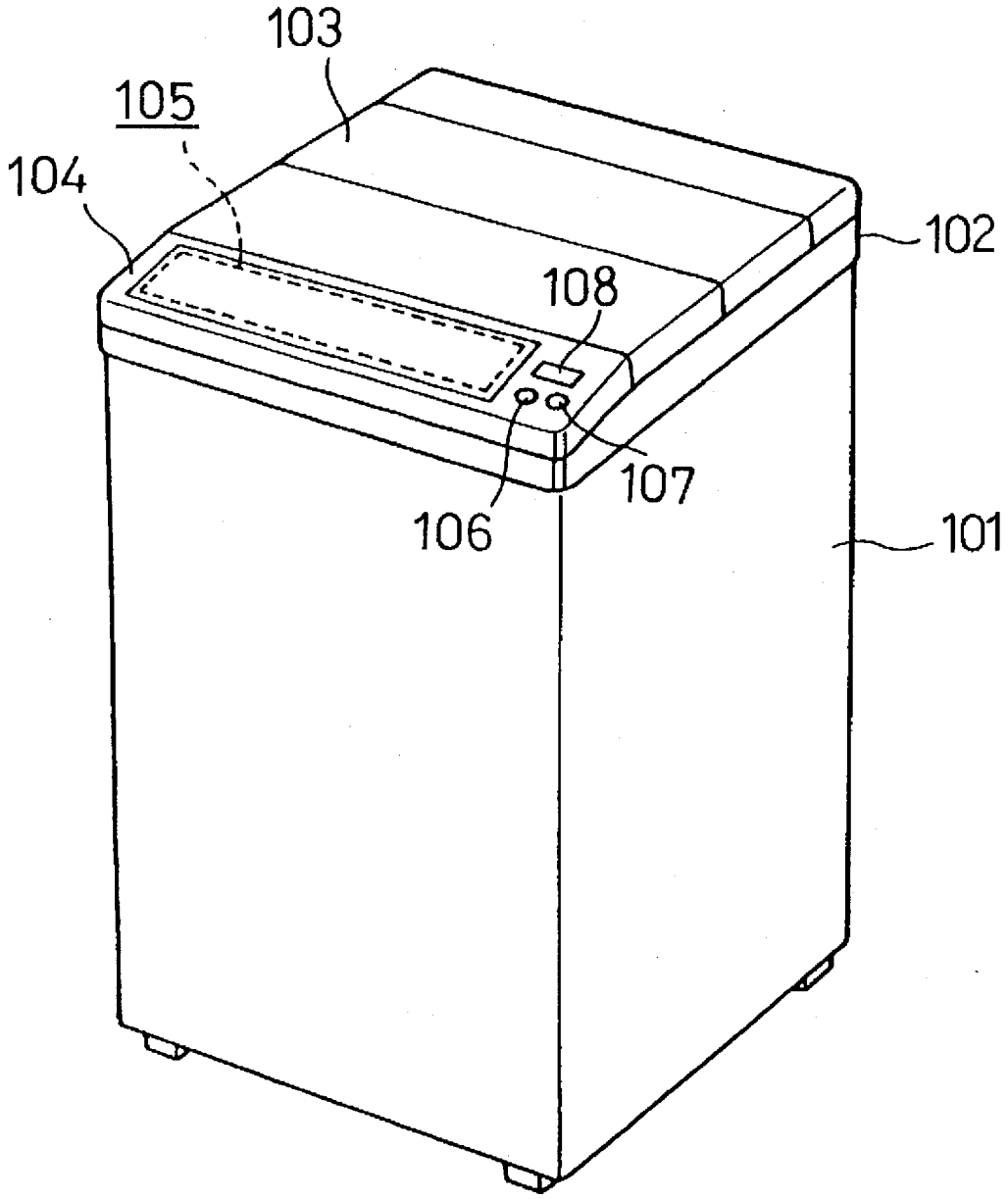
FIG. 23 is a perspective view of the automatic washing machine.

FIGS. 16 to 33 illustrate a seventh embodiment of the present invention. Referring to FIG. 23, an outer cabinet 101 of a washing machine in accordance with the present invention is shown. A top cover 102 made of plastic is attached to the top of the outer cabinet 101. A folding lid 103 is mounted on the top cover 102 for opening and closing an access opening (not shown) through which laundry is put into and taken out of a tub. An operation panel 104 made of plastic is mounted on the top cover 102 so as to be disposed in front of the lid 103. The operation panel 104 includes a generally rectangular display device 105 which is approximately planar with the panel 104. Adjacent to the display device 105 are an ON switch 106 for power supply, an OFF switch 107 for power cut-off, and a light-emitting diode 108 serving as a pilot lamp. These parts are also approximately planar with the operation panel 104. The operation panel 104 further includes switch means or a membrane switch 109 (see FIG. 21) constituting a number of key switches and located at the underside of the display device 105.

Figure 21:
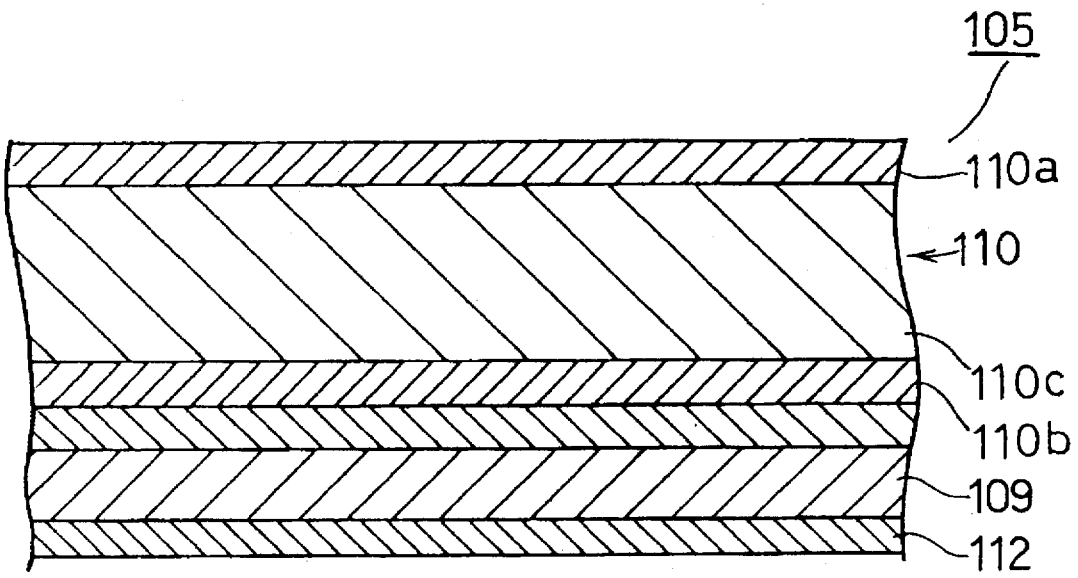
FIG. 21 is a schematic sectional view of a display device and a membrane switch employed in the display device.
Figure 22:
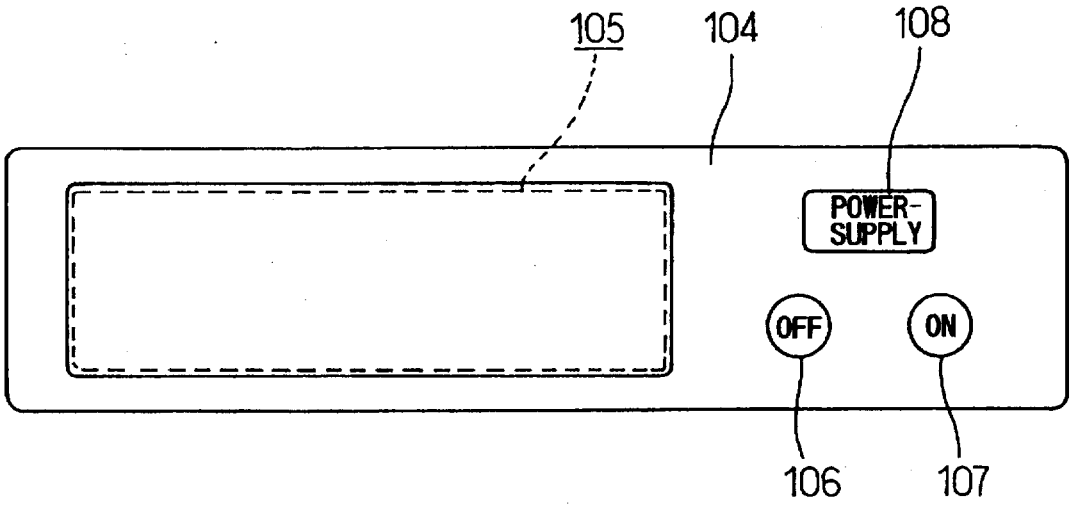
FIG. 22 is a plan view of the operation panel.

Components of the display device 105 and the mounting thereof on the operation panel 104 will be described. The display device 105 comprises a nematic curvilinear aligned phase (NCAP) liquid crystal and is formed into the shape of a flat plate. The display device 105 has elasticity. FIG. 21 shows a diagrammatic sectional structure of the display device 105. More specifically, the display device 105 comprises an NCAP liquid crystal panel 110 having elasticity and light reflecting means or a reflector 111 which is made of an elastic material and disposed on the back of the panel 110, as shown in FIG. 21. The membrane switches 109 are attached to the back of the reflector 111. The membrane switch 109 is operable by depression of the NCAP liquid crystal panel 110. The NCAP liquid crystal panel 110 includes a transparent electrode membrane **110*a* constituting individual electrodes, a transparent electrode membrane 110*b* constituting a common electrode, and an NCAP liquid crystal material 110*c* sandwiched between the membranes 110*a* and 110*b*. The reflector 111 is made of a translucent material and accordingly permits light to pass therethrough. A thin metal plate 112 is attached to the underside of the membrane switch 109** for reinforcement thereof.

Figure 20:
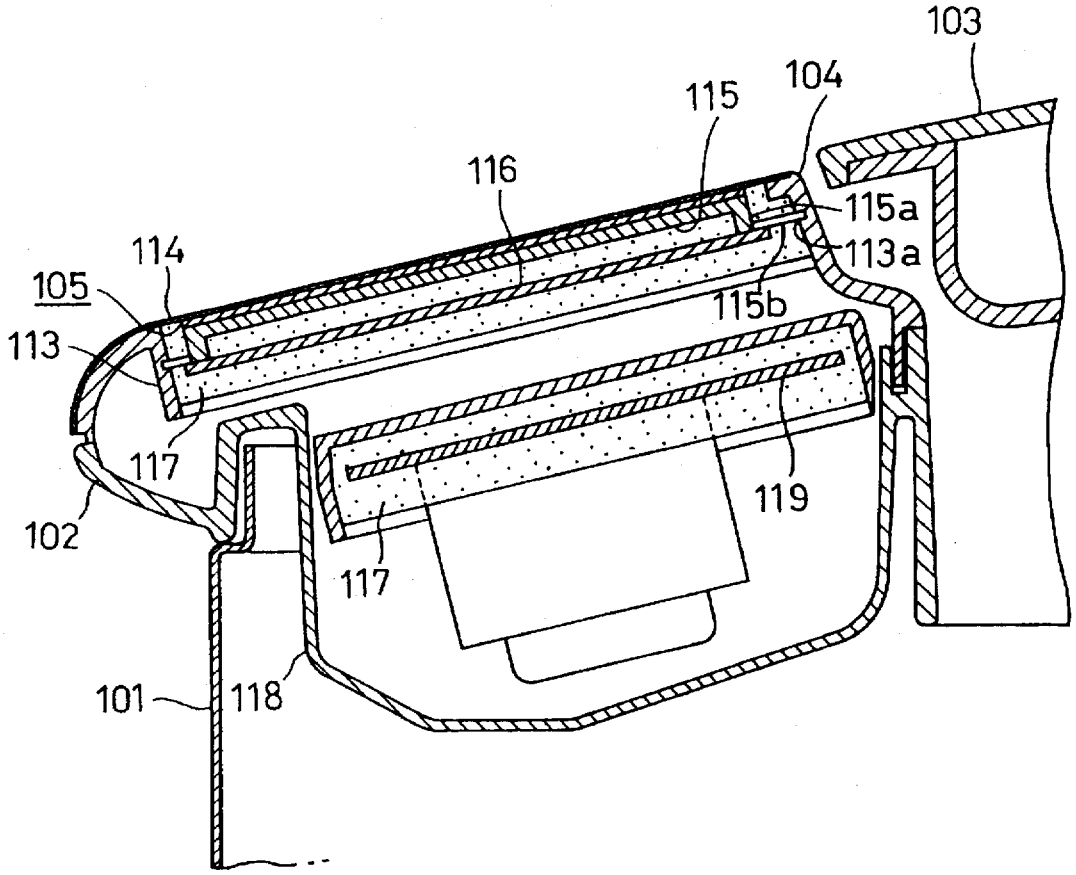
FIG. 20 is a longitudinally sectional side view of the display device as viewed from a different angle.

The operation panel 104 includes a rectangular casing 113 formed integrally therewith as shown in FIG. 20. The casing 113 has an upper opening closed by an overlay 114 which comprises a transparent sheet and is integrated with the top of the operation panel 104 by an insert molding. The upper transparent electrode membrane **110*a* constituting the upper surface of the display device 105 is bonded to the overlay 114 by a transparent adhesive agent, whereby the display device 105 to which the membrane switch 109 is attached is disposed in the casing 113. A supporting plate 115 serving as a supporting member and made of plastic is disposed in the casing 113 so as to be located at the underside of the display device 105. The supporting plate 115 has a downwardly protruding peripheral wall 115*a* and projections 115*b* formed on the peripheral wall 115*a* at predetermined intervals. The casing 113 has holes 113*a* formed in the inner peripheral wall thereof at predetermined intervals. The projections 115*b* of the supporting plate 115 are inserted in the holes 113*a* respectively so that the supporting plate 115 is fixed in the casing 113, whereby the display device 105 is held between the supporting plate 115 and the overlay 114 with the supporting plate 115 supporting the display device 105 at the underside thereof. A circuit board 116 on which electronic components such as those for control of the display device 105 are mounted is attached to the lower end of the supporting plate 115. The casing 113 is filled with a dampproofing material 117 such as urethane resin in the condition that the display device 105**, the supporting plate 115, and the circuit board 116 are disposed in the casing 113 as described above. The display device 105 and the circuit board 116 are enclosed in the dampproofing material 117 so as to be shielded from damp. The top cover 102 has a casing 118 formed to be located below the operation panel 104. The casing 118 accommodates another circuit board 119 on which electronic components for control of the washing operation and the like are mounted. The circuit board 119 is also enclosed in the dampproofing material 117 filling the casing 118.

The NCAP liquid crystal panel 110 constituted as described above scatters or absorbs incident light in the steady state in which no voltage is applied across the transparent electrode membranes 110*a* and 110*b*, thereby restraining the light from passing therethrough. In this state, a quantity of light reflected on the reflector 111 is decreased such that the NCAP liquid crystal panel 110 is dimmed. This state will be referred to as "dimmed state." On the other hand, when a voltage is applied across the transparent electrode membranes 110*a* and 110*b*, the quantity of light scattered or absorbed is decreased such that the NCAP liquid crystal panel 110 permits the incident light to pass therethrough. Consequently, the quantity of light reflected on the reflector 111 is increased such that a portion of the panel 110 to which the voltage is applied is brightened. This state will be referred to as "brightened state."

Figure 18:
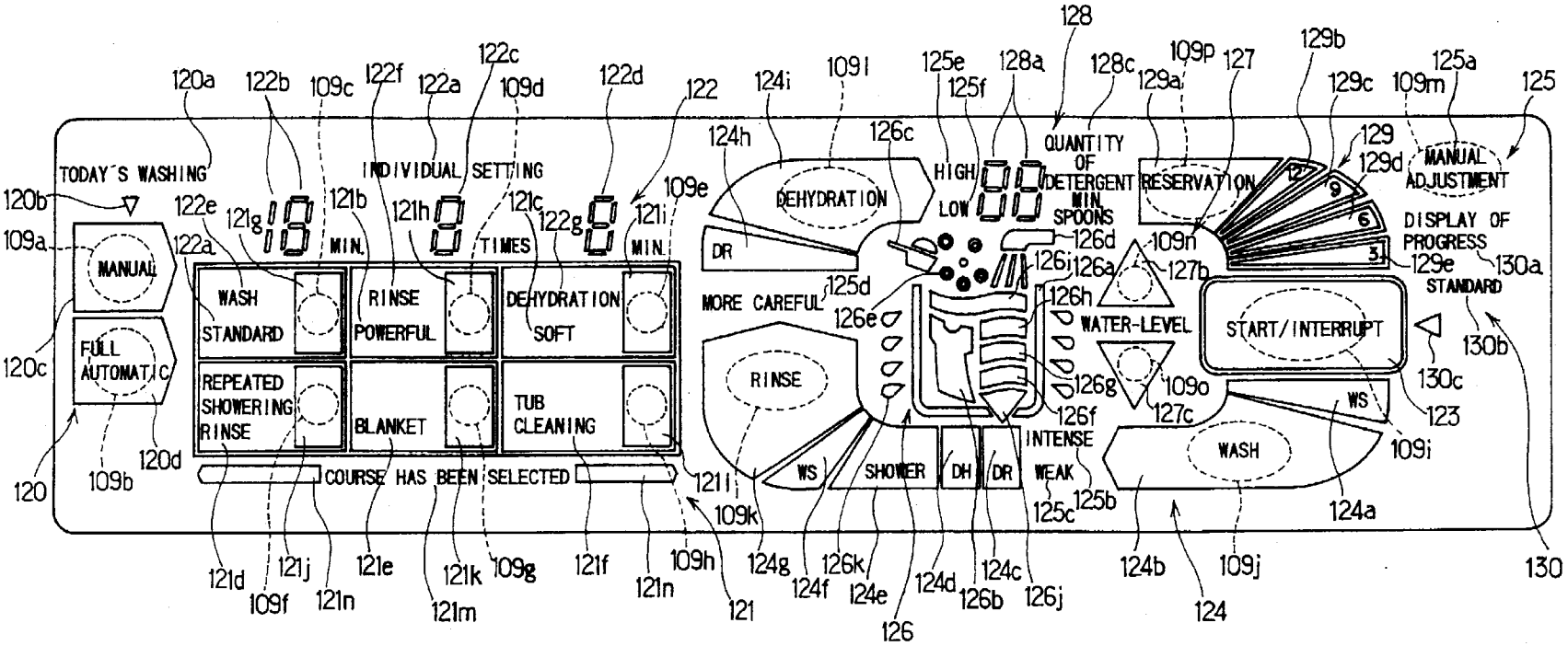
FIG. 18 is a plan view of the display device with an overlay.

A plurality of display sections can be formed in the display device 105 when a plurality of the individual electrode membranes 110*a* are provided so that the voltage is applied to a plurality of portions of the NCAP liquid crystal panel 110. Furthermore, one or more of the display sections can be selectively brightened so as to display the information about the washing operation. More specifically, the display device 105 includes a plurality of display sections 120 to 130 as shown in FIG. 18 so that a plurality of pieces of information about the washing operation are displayed.

The display sections 120 to 130 will be described.

(a) A mode display section 120 is provided for displaying either an automatic mode in which the washing operation is automatically executed or a manual mode in which operation modes of the wash, rinse, and dehydration steps are manually set. The mode display section 120 further indicates the locations of key switches for selection of the FULL AUTOMATIC or MANUAL mode. The mode display section 120 includes an indication 120*a* of TODAY'S WASHING, an inverted triangular portion 120*b*, and upper and lower pentagonal portions 120*c* and 120*d*. A portion of the membrane switch 109 corresponding to the upper pentagonal portion 120*c* serves as a MANUAL key switch 109*a*. A portion of the membrane switch 109 corresponding to the lower pentagonal portion 120*d* serves as a FULL AUTOMATIC key switch 109*b*. The overlay 114 has on the surface thereof printed characters and figures. More specifically, these printed characters and figures include characters 114-1 of TODAY'S WASHING positioned over the indication 120*a*, a triangular frame 114-2 encircling the inverted triangular portion 120*b*, two pentagonal frames 114-3 and 114-4 encircling the respective pentagonal portions 120*c* and 120*d*, characters 114-5 of MANUAL encircled by the frame 114-3, and characters 114-6 of FULL AUTOMATIC encircled by the frame 114-4. The mode display section 120 is brightened when the ON switch 106 is operated so that power is applied to the washing machine. When either the MANUAL key switch 109*a* or the FULL AUTOMATIC key switch 109*b* is selected, one of the pentagonal portions 120*c* and 120*d* corresponding to the selected key switch is maintained in the brightened state, whereas the other pentagonal portion is dimmed.

(b) A full automatic course display section 121 is provided for selection of one of a plurality of wash courses including STANDARD, POWERFUL, SOFT, REPEATED SHOWERING RINSE, BLANKET, and TUB CLEANING. The full automatic course display section 121 further indicates the locations of the key switches for selection of the courses. The full automatic course display section 121 is disposed on the right of the mode display section 120 in the vicinity thereof. The full automatic course display section 121 includes upper indications 121*a*, 121*b*, 121*c* of STANDARD, POWERFUL, SOFT, lower indications 121*d*, 121*e*, 121*f* of REPEATED SHOWERING RINSE, BLANKET, TUB CLEANING, six square portions 121*g* to 121*l* on the right of the respective indications 121*a* to 121*f*, characters 121*m* of COURSE HAS BEEN SELECTED, and two strip portions 121*n* at both sides of the characters 121*m*. Six course selecting key switches 109*c* to 109*h* are provided on portions of the membrane switch 109 corresponding to the respective square portions 121*g* to 121*l* for selection of the individual courses.

Figure 19:
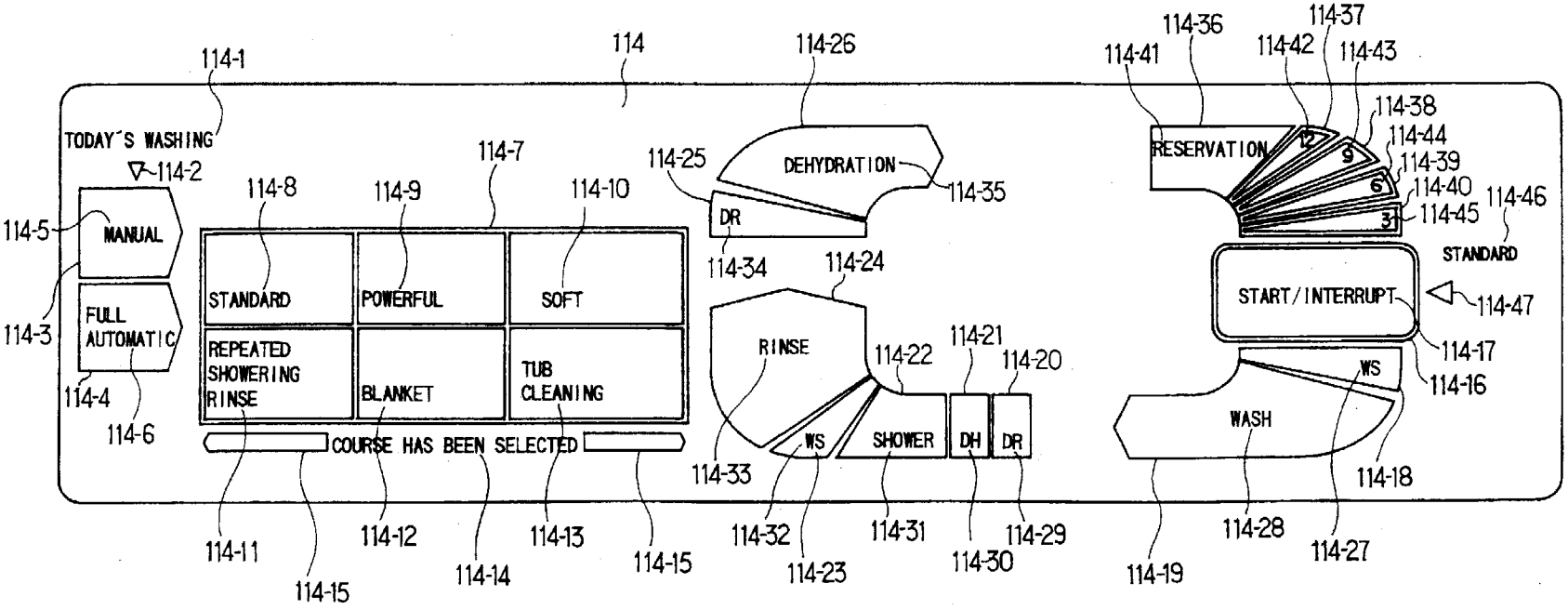
FIG. 19 is a plan view of the overlay, showing the contents printed thereon.

The overlay 114 has on the surface thereof printed characters and figures corresponding to the above-described indications and figures as shown in FIG. 19. These printed characters and figures include a square lattice frame 114-7 dividing the display section 121 to the character portions 121*a* to 121*f* and the corresponding square portions 121*g* to 121*l*, indications 114-8 to 114-14 of STANDARD, POWERFUL, SOFT, REPEATED SHOWERING RINSE, BLANKET, TUB CLEANING, and COURSE HAS BEEN SELECTED which are positioned over the characters 121*a* to 121*f* and 121*m* respectively, and two frames 114-15 for the strip portions 121*n*. The course display section 121 is brightened when the FULL AUTOMATIC key switch 109*b* is depressed so that the FULL AUTOMATIC course is selected. One of the square portions 121*g* to 121*l* is then depressed so that one of the key switches 109*c* to 109*h* is operated. Then, the characters and the square portion corresponding to the operated switch are maintained in the brightened state, whereas the other part is dimmed.

(c) A manual course display section 122 is provided for the setting of the wash, rinse, and dehydration steps, setting of a wash period, the number of times of rinsing, and a dehydrating period, and the locations of the key switches for the above-described setting. In the embodiment, the key switches 109*c* to 109*e* for selection of the respective courses of STANDARD, POWERFUL, and SOFT also serve as those for selection of the courses, WASH, RINSE, and DEHYDRATION and for setting of the wash period, the number of times of rinsing, and the dehydrating period respectively.

The manual course display section 122 includes the characters 122*a* of INDIVIDUAL SETTING located above the lattice frame printed on the overlay 114, and numeric portions 122*b*, 122*c*, and 122*d* located on the left, center, and right for displaying the wash period, the number of times of rinsing, and the dehydrating period with units respectively. The manual course display section 122 further includes characters 122*e*, 122*f*, and 122*g* of WASH, RINSE, and DEHYDRATION located over the characters 121*a*, 121*b*, and 121*c* of STANDARD, POWERFUL, and SOFT respectively, and the square portions 121*g* to 121*i* indicating the locations of the course selecting key switches 109*c* to 109*e* respectively. The characters 122*a* of INDIVIDUAL SETTING, the characters 122*e* to 122*g* of WASH, RINSE, and DEHYDRATION, and the square portions 121*g* to 121*i* are turned to the brightened state when the MANUAL key switch 109*a* is operated. As the result of operation of the MANUAL key switch 109*a*, the course selecting key switches 109*c* to 109*e* serve to set the wash period, the number of times of rinsing, and the dehydrating period respectively. The STANDARD course selecting key switch 109*c* is operated for setting the wash course and the wash period. A period according to the number of times of operation of the key switch 109*c* is then displayed on the numeric portion 122*b* in the brightened state. The POWERFUL course selecting key switch 109*d* is operated for setting the rinse and the number of times of rinsing. The number of times of rinsing according to the number of times of operation of the key switch 109*d* is then displayed on the numeric portion 122*c* in the brightened state. The SOFT course selecting key switch 109*e* is operated for setting the dehydration and the dehydrating period. The dehydrating period according to the number of times of operation of the key switch 109*e* is then displayed on the numeric portion 122*d* in the brightened state.

(d) An operation switch display section 123 is provided for displaying the location of a key switch for commanding the start and interrupt of the washing operation. The operation switch display section 123 is formed into a rectangular shape and located in a right-hand portion of the display device 105, as viewed in FIG. 18. A portion of the membrane switch 109 corresponding to the operation switch display section 123 serves as a start key switch 109*i*. A square frame 114-16 encompassing the operation switch display section 123 is printed on the surface of the overlay 114, and characters 114-17 of START/INTERRUPT is printed within the frame 114-16, as shown in FIG. 19. The operation switch display section 123 is brightened when the ON switch 106 is operated so that the power is supplied to the washing machine, whereas it is dimmed upon completion of the washing operation.

(e) A step display section 124 is provided for displaying operations from the wash step to the dehydration step and for displaying the operation of the step being currently executed. Thus, the step display section 124 functions as a progress display section displaying the progress of the washing operation. In the embodiment, the step display section 124 further functions to display the locations of key switches for manually setting the intensity of the wash mode, the degree of rinsing, and the intensity of the dehydration mode. The step display section 124 includes first to nine portions 124*a* to 124*i* starting from below the operation switch display section 123 to be arranged clockwise. Portions of the membrane switch 109 corresponding to the second, seventh, and ninth portions 124*b*, 124*g*, and 124*i* serve as a wash mode selecting key switch 109*j* with a function of setting a wash mode, a rinse mode selecting key switch 109*k* with a function of selecting a normal mode or a careful mode, and a dehydration mode selecting key switch 109*l* with a function of selecting an high mode or a low mode respectively. Frames 114-18 to 114-26 encompassing the first to nine portions 124*a* to 124*i* are printed on the surface of the overlay 114 as shown in FIG. 19. Furthermore, characters 114-27 to 114-35 showing the contents displayed on the first to ninth portions 124*a* to 124*i* are printed within the frames 114-18 to 114-26 respectively. These characters 114-27 to 114-35 include WS standing for water-supply, WASH, DR standing for draining, DH standing for dehydration, SHOWER, WS, RINSE, DR, and DEHYDRATION respectively. The entire progress display section 123 is brightened when the ON switch 106 is operated so that the power is supplied to the washing machine. Upon start of the washing operation with the depressing of the start key switch 109*i*, one of the portions 124*a* to 124*i* corresponding to the operation being currently executed is maintained in the brightened state with the other portions being dimmed. Thereafter, the portion displaying the currently executed operation is caused to flash by repeating the brightened and dimmed states alternately and is dimmed upon completion of the operation.

(f) A manual adjustment display section 125 is provided for displaying that the wash, rinse, and dehydration modes are manually settable. The manual adjustment display section 125 further displays the locations of key switches with which the modes are set and the contents set with the key switches. The manual adjustment display section 125 includes an indication 125*a* of MANUAL ADJUSTMENT provided on the upper right-hand portion of the display device 105, indications 125*b* and 125*c* of INTENSE and WEAK provided on the left of the second portion 124*b* of the progress display section 124 respectively, an indication 125*d* of MORE CAREFUL provided over the seventh portion 124*g* of the progress display section 124, and indications 125*e* and 125*f* of HIGH and LOW provided on the right of the ninth portion 124*i* of the progress display section 124. A portion of the membrane switch 109 corresponding to the characters 125*a* of MANUAL ADJUSTMENT serves as a manual adjustment key switch 109*m*. The indication 125*a* of MANUAL ADJUSTMENT is brightened when the ON switch 106 is operated so that the power is supplied to the washing machine. When the indication 125*a* is depressed in this state so that the manual adjustment key switch 109*m* is operated, the wash mode selecting key switch 109*j*, the rinse mode selecting key switch 109*k*, and the dehydration mode selecting key switch 109*l* are rendered effective. Either one of the indications 125*b* and 125*c* of INTENSE and WEAK is brightened by operation of the wash mode selecting key switch 109*j*. A normal rinse mode and the careful rinse mode are alternately selected when the rinse mode selecting key switch 109*k* is operated. The indication 125*d* of MORE CAREFUL is brightened when the careful rinse mode has been selected. Either one of the indications 125*e* and 125*f* of HIGH and LOW is turned to the brightened state when the dehydration mode selecting key switch 109*g* is operated. Thereafter, the indication 125*a* of MANUAL ADJUSTMENT is dimmed upon operation of the start key switch 109*i*.

(g) An operation display section 126 is provided for diagrammatically displaying the currently executed operation in the steps of the wash to dehydration. The operation display section 126 is surrounded by the step display section 124 on the display device 105. The operation display section 126 serves as an operation progress display section and more particularly as a step display section. The operation display section 126 includes a rotatable tub portion 126*a* standing for a wash and dehydration tub, a laundry portion 126*b* inside the rotatable tub portion 126*a*, a detergent spoon portion 126*c* indicating dispense of detergent into the rotatable tub, a faucet portion 126*d* indicating water supply to the rotatable tub, a bubble portion 126*e* indicating bubbles resulting from detergent during the wash step, four water-level lines 126*f* to 126*i* indicating the water levels in the rotatable tub, an inverted triangular valve portion 126*j* indicating the drain valve, and a water drop portion 126*k* indicating water drops splashing out of the rotatable tub during the dehydrating operation.

(h) A water-level setting switch display section 127 is provided for displaying that the level of water supplied into the rotatable tub are settable. The water-level setting display switch 127 further displays the location of a key switch for the water-level setting. The water-level setting switch display section 127 includes an indication 127*a* of WATER-LEVEL on the right of the operation display section 126, a triangular portion 127*b*, and an inverted triangular portion 127*c*. Portions of the membrane switch 109 corresponding to the triangular and inverted triangular portions 127*b* and 127*c* serve as a water-level increasing key switch 109*n* with a water-level setting function and a water-level decreasing key switch 109*o* with a water-level setting function respectively. The water-level setting switch display section 127 is brightened when the ON switch 106 is operated so that the power is supplied to the washing machine. The water-level increasing and decreasing key switches 127*n* and 127*o* are rendered effective when the manual adjustment key switch 109*m* is operated in the above-described state. The water level is increased one step every time the water-level increasing key switch 109*n* is operated, whereas the water level is decreased one step every time the water-level decreasing key switch 109*o* is operated. The water level thus set is indicated by any one of the four water-level lines 126*f* to 126*i* that is brightened.

(i) A remaining period display section 128 is provided for displaying a remaining period of the washing operation, thereby displaying the progress of the washing operation. Accordingly, the remaining period display section 128 serves as the operation progress display section displaying the progress of the washing operation. The remaining period display section 128 includes a two-digit numeric portion 128*a* and an indication 128*b* of MIN. indicating the unit of a numeral indicated by the numeric portion 128*a*. The remaining period display section 128 further serves to indicate in the form of the number of detergent spoons a quantity of detergent to be supplied into the tub, which quantity is determined on the basis of detection of the weight of laundry performed upon start of a wash step. Indication 128*c* constituted by QUANTITY OF DETERGENT and SPOONS are provided on the right of the numeric portion 128*a*. The indication 128*c* of QUANTITY OF DETERGENT and SPOONS and the numeric portion 128*a* are brightened when the quantity of detergent is displayed on the remaining period display section 128, whereas the indication 128*b* of MIN. and the numeric portion 128*a* are brightened when the remaining period of the washing operation is displayed on the remaining period display section 128.

(j) A reserved operation display section 129 is provided for displaying that the washing operation can be reserved. The section 129 further displays the location of a key switch for the reserving of the washing operation. The reserved operation display section 129 includes a generally trapezoidal portion 129*a* provided on the right of the remaining period display section 128 and four generally sectorial portions 129*b* to 129*e* arranged clockwise. A portion of the membrane switch 109 corresponding to the triangular portion 129*a* serves as a reserving key switch 109*p*. The reserved washing operation is completed after expiration of a set period of time. The overlay 114 includes on the surface thereof printed frames 114-36 to 114-40 encompassing the trapezoidal portion 129*a* and the sectorial portions 129*b* to 129*e* respectively, an indication 114-41 of RESERVATION disposed within the frame 114-36 of the trapezoidal portion 129*a*, numerals 114-42 to 114-45 of "12," "9," "6," and "3" disposed within the frames 114-37 to 114-40 of the sectorial portions 129*b* to 129*e* respectively, as shown in FIG. 19. The trapezoidal portion 129*a* is brightened when the ON switch 106 is operated so that the power is supplied to the washing machine. When the reserving key switch 109*p* is operated for setting a reserved period of time, any one of the sectorial portions 129*b* to 129*e* corresponding to the set time period is brightened. Thereafter, the sectorial portion turned to the brightened state is changed sequentially clockwise every time three hours elapses.

(k) An instruction display section 130 includes an indication 130*a* of DISPLAY OF PROGRESS indicating that the progress display section 124 is displaying the progress of the washing operation, an indication 130*b* of STANDARD indicating that the STANDARD course is unconditionally selected without course selection upon operation of the start key switch 109*i*, and a triangular portion 130*c* below the indication 130*b* of STANDARD. The overlay 114 includes on the surface thereof printed characters 114-46 of STANDARD positioned on the indication 130*b* of STANDARD and a frame 114-47 encompassing the triangular portion 130*c*. The indication 130*b* of STANDARD and the triangular portion 130*c* are brightened with the indication 130*a* of DISPLAY OF PROGRESS being turned to the dimmed state when the ON switch 106 is operated so that the power is supplied to the washing machine. Then, when the start key switch 109*c* is operated, the indication 130*a* of DISPLAY OF PROGRESS is brightened, whereas the indication 130*b* of STANDARD and the triangular portion 130*c* are dimmed. An ink containing a luminous material is used for printing the indications and frames 114-1 to 114-38 on the overlay 114. The luminous material is constituted by a luminous fluorescent material produced and sold under the trademark of "N-YAKO" by Nemoto Special Chemical Co., Ltd., Japan, for example. Each of the indications and frames 114-1 to 114-38 has a thickness of 150 microns. When light of 500 lux (corresponding to brightness obtained one or one and half meters away from a fluorescent lamp of 40 W) is irradiated onto the luminous material for twenty minutes, it can be viewed for eight hours.

Six light-emitting diodes 131 each serving as light-emitting means are provided for illuminating the numeric portions 122*b* to 122*d* of the manual course display section 122, the operation display section 126, and the remaining period display section 128 from the back of the display device 105. The four light-emitting diodes 131 are provided for the numeric portions 122*b* to 122*d* and the remaining period display section 128 respectively, and the other two light-emitting diodes 131 are provided for the operation display section 126 which has a larger section.

Figure 16:
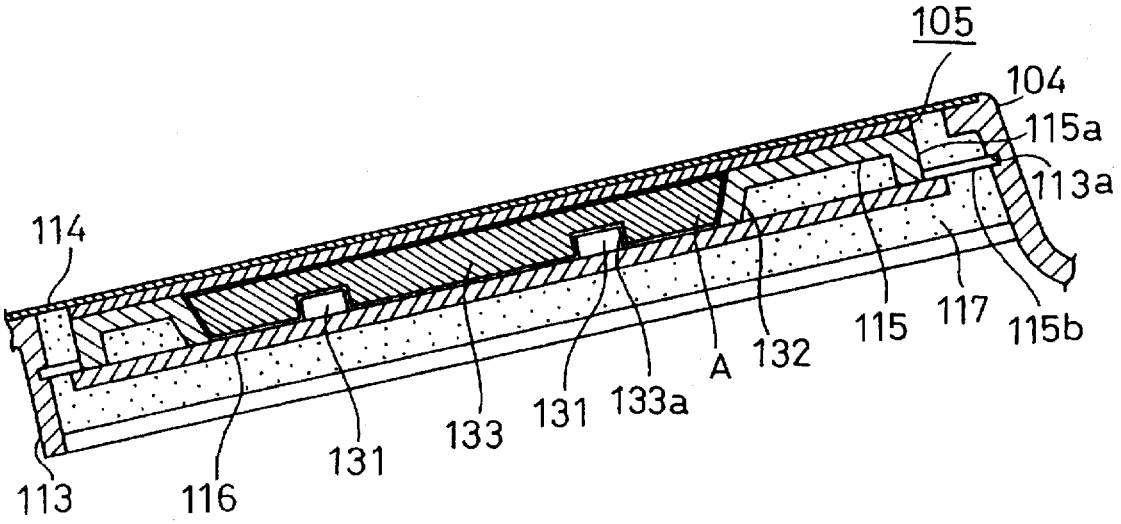
FIG. 16 is a longitudinally sectional side view of a display device employed in an automatic washing machine of a seventh embodiment in accordance with the present invention.

FIG. 16 illustrates the arrangement of the light-emitting diodes 131 for the operation display section 126. The arrangement of the light-emitting diodes 131 for the numeric portions 122*b* to 122*d* and for the remaining period display section 128 is substantially the same as that for the operation display section 126 with the difference in the number of the light-emitting diodes 131. Accordingly, the arrangement will be eliminated. Referring to FIG. 16, a rectangular light-shielding wall 132 integrally protrudes downward from a portion of the supporting plate 115 corresponding to the operation display section 126 so as to surround the portion. An illumination chamber A having upper and lower openings is formed inside the light-shielding wall 132. The upper opening of the illumination chamber A is closed by the NCAP liquid crystal panel 110. The circuit board 116 serves as a closing member closing the lower opening of the illumination chamber A located opposite to the NCAP liquid crystal panel 110. The two light-emitting diodes 131 are mounted on the upper surface of the circuit board 116 so as to face the interior of the illumination chamber A.

A light guide member 133 made of a transparent acrylic resin, for example, is provided in the illumination chamber A. The light guide member 133 guides light emitted by each light-emitting diode 131 so that the light is irradiated uniformly onto the entire operation display section 126. The light guide member 133 has two recesses 133*a* formed in the underside thereof. The light-emitting diodes 131 are accommodated in the recesses 133*a* respectively. The inner peripheral surface of the light-shielding wall 132 is electroplated, for example, so as to be formed into a mirror finished surface. Consequently, the light leaking through the peripheral side surfaces is reflected on the inner peripheral surface of the light-shielding wall 132 toward the operation display section 126. The light-shielding wall 132 is inclined toward the interior of the illumination chamber A so that the inner peripheral surface thereof is directed obliquely upward. Consequently, the light is efficiently reflected on the inner peripheral surface of the light-shielding wall 132 toward the operation display section 126. Preferably, the inclination of the light-shielding wall 132 is set so that the wall 132 enters the illumination chamber A by one millimeter per lowering by six millimeters.

Figure 17:
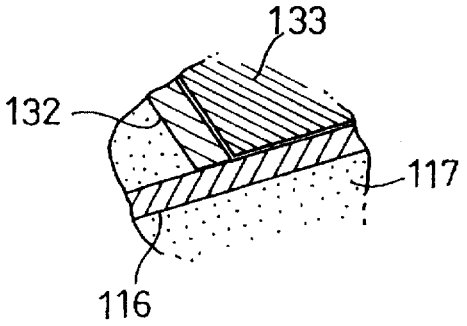
FIG. 17 is a partial sectional view showing the structure for preventing dampproofing material from entering an illumination chamber.

The lower end of the light-shielding wall 132 is formed into a flat surface as shown in FIG. 17 so that the lower end is abutted against the upper surface of the circuit board 116 or a gap, if formed therebetween, has a width of 0.1 to 0.2 millimeters or below, whereupon fluid-tightness is provided between the lower end of the light-shielding wall 132 and the upper surface of the circuit board 116. Consequently, liquid concentrate of the dampproofing material 117 can be prevented from entering the illumination chamber A through the gap between the lower end of the light-shielding wall 132 and the upper surface of the circuit board 116.

Figure 24A:
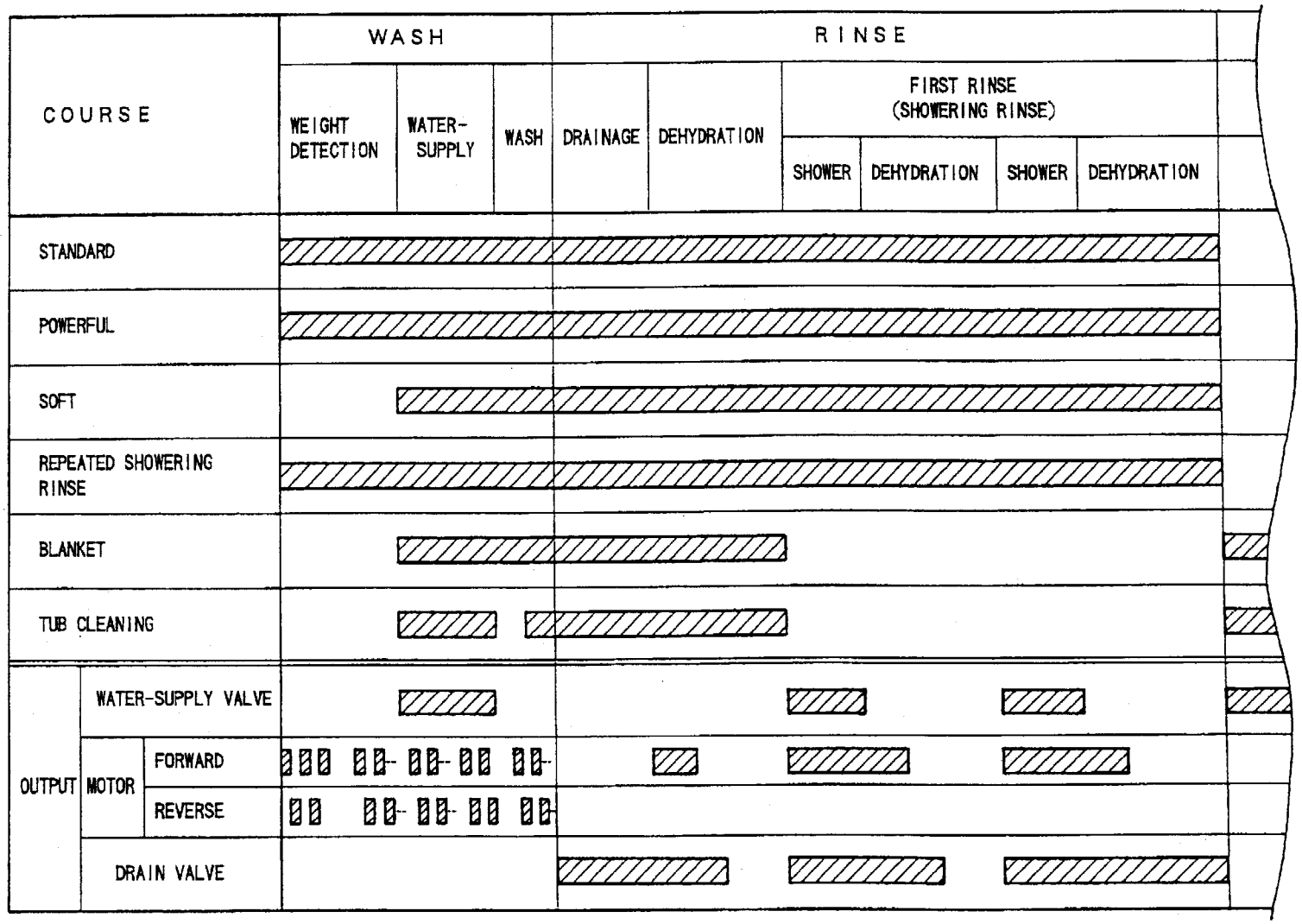
FIGS. 24A and 24B are time charts showing control manner for various operation courses and the states of a water-supply valve, a drive motor, and a drain valve.
Figure 24B:
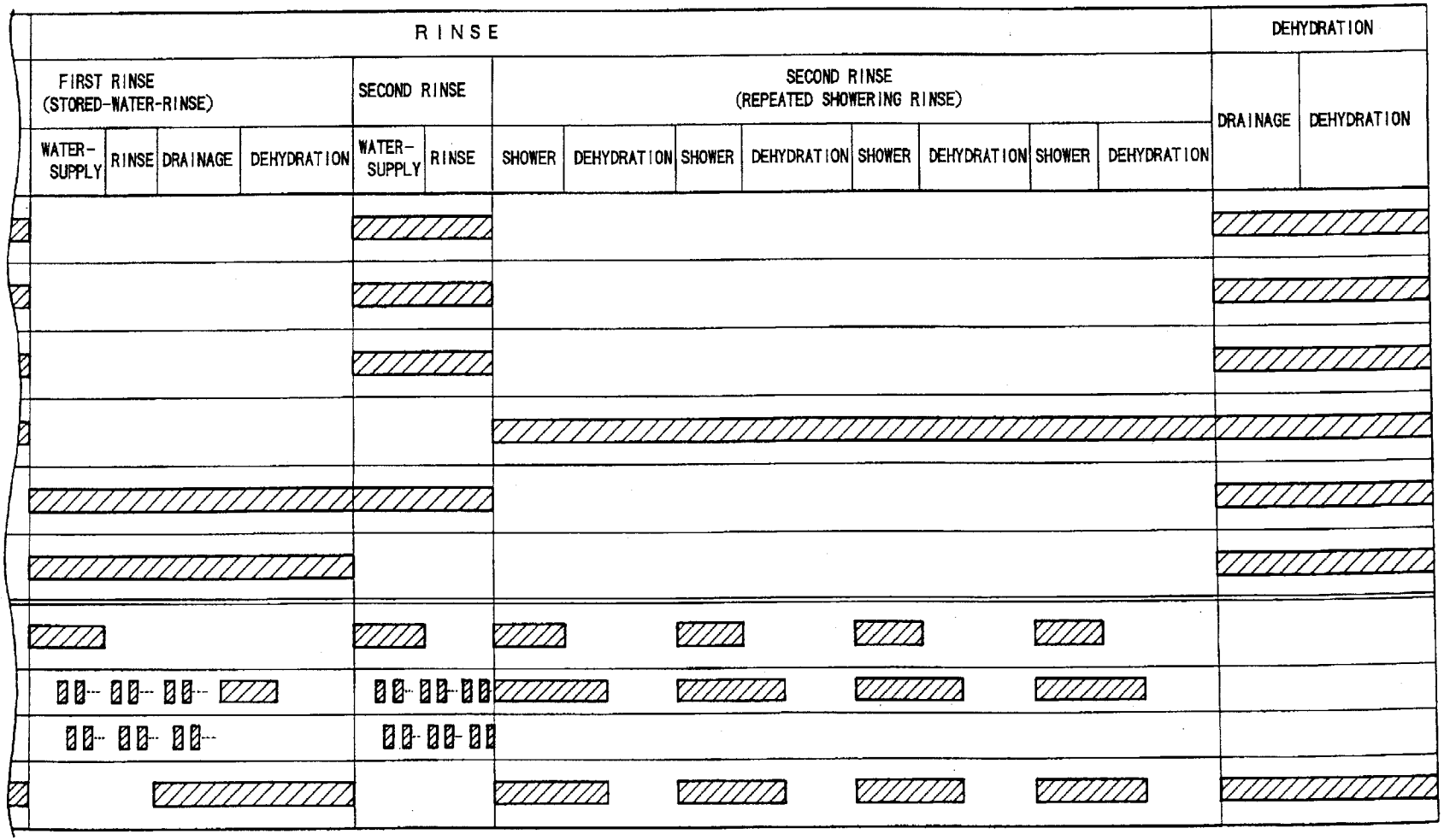

The operation of the washing machine will be described with reference to FIGS. 24A to 33. In the following description, a STANDARD course will be selected for the washing operation. FIGS. 24A and 24B show the contents of operation in the steps executed in each course under the FULL AUTOMATIC mode, and timings for energization of the water-supply valve, for energization of the motor for driving the agitator and the rotatable tub for the forward and reverse rotations thereof, and for energization of the drain valve. In FIGS. 24A and 24B, each bar with oblique lines denotes an energizing period. The STANDARD course includes a wash step in which detection of weight of laundry, supply of water, and washing are sequentially executed, a rinse step in which a first rinse including drainage, dehydration, and showering rinse and a second rinse including stored-water-rinse are sequentially executed, and a dehydration step in which drainage and dehydration are executed in turn. In the showering rinse, dehydration is executed after water is showered into the rotatable tub so that laundry is soaked in clear water, and showering and dehydration are repeated alternately twice. In the stored-water-rinse, water supply and rinse are executed, and the rinse is executed with water being stored in the rotatable tub.

Operation of various switches and the operation of the washing machine will be described in the execution of the STANDARD course.

(a) Selection of the STANDARD Course:

The ON switch 106 is operated so that electric power is applied to the washing machine. The pentagonal portion 120*d* having the printed indication of FULL AUTOMATIC in the mode display section 120 of the display device 105 is depressed to operate the FULL AUTOMATIC key switch 109*b*. Then, the pentagonal portion 120*c* having the printed indication of MANUAL is turned from the brightened state to the dimmed state, whereas all the indications and characters 121*a* to 121*n* of the full automatic course display section 121 are brightened. The square portion 121*g* on the right of the indication 121*a* of STANDARD is then depressed to operate the STANDARD course selecting key switch 109*c*, whereby the STANDARD course is selected. With selection of the STANDARD course, the indication 120*a* of TODAY'S WASHING, the triangular portion 120*b*, and the pentagonal portion 120*d* are brightened. Furthermore, the operation switch display section 123, all the portions 124*a* to 124*i* of the step display section 124, and the indication 130*b* of STANDARD and the triangular portion 130*c* of the instruction display section 130 are also brightened. Furthermore, the indication 125*a* of MANUAL ADJUSTMENT of the manual adjustment display section 125 and all the indication and portions 127*a* to 127*c* of the water-level setting switch display section 127 are also brightened. Consequently, the wash, rinse, and dehydration modes, and the water level in the rotatable tub can be manually set. Alternatively, the start key switch 109*i* may be operated to unconditionally select the STANDARD course.

(b) Start of Operation:

The washing operation starts when the operation switch display section 123 is depressed to operate the start key switch 109*i* in the above-described state. Then, the indication 120*a* of TODAY'S WASHING, the triangular portion 120*b*, the indication 125*a* of MANUAL ADJUSTMENT, and all the indication and portions 127*a* to 127*c* of the water-level setting switch display section 127 are dimmed. Furthermore, the indication 130*b* of STANDARD and the triangular portion 130*c* are also dimmed, whereas the the indication 130*a* of PROGRESS DISPLAY is turned from the dimmed state to the brightened state. Additionally, the rotatable tub portion 126*a* and the laundry portion 126*b* of the operation display section 126 are turned from the dimmed state to the brightened state, and the light-emitting diodes 131 disposed on the underside of the operation display section 126 are turned on. Light emitted from the light-emitting diodes 131 is guided by the light guide member 133 to illuminate the entire operation display section 126 via the translucent reflector 111 from the back thereof. The light leaking through the peripheral side surfaces of the light guide member 133 is reflected on the inner peripheral surface of the light-shielding wall 132 to be guided by the light guide member 133 to the operation display section 126. The light-emitting diodes 131 of the operation display section 126 are maintained in the ON state until the washing operation is completed.

(c) Detection of Laundry Weight:

Upon start of the washing operation under the STANDARD course, the weight (weight of laundry) detection is performed. An agitator (not shown) is rotated by a drive motor (not shown), and a sensor (not shown) for detecting load applied to the motor generates a detection signal, which signal is supplied to control means (not shown) such as a microcomputer. Based on the input signal, the control means determines the weight of laundry put into a rotatable tub (not shown). The water level, the period of the washing operation, and a quantity of detergent are determined on the basis of the determined weight. Then, the light-emitting diode 131 of the remaining period display section 128 is turned on, and the numeric portion 128*a* and the indication 128*c* of QUANTITY OF DETERGENT and SPOONS are brightened so that the number of spoons corresponding to the quantity of detergent determined as described above is displayed. The light-emitting diode 131 of the remaining period display section 128 is maintained in the ON state until the OFF switch 107 is operated after completion of the washing operation so that power is turned off. With display of the number of spoons, the detergent spoon portion 126*c* of the operation display section 126 is brightened, thereby prompting a user to dispense detergent into the rotatable tub. The user then dispenses the detergent the quantity of which is displayed on the remaining period display section 129 as the number of spoons.

Figure 25:
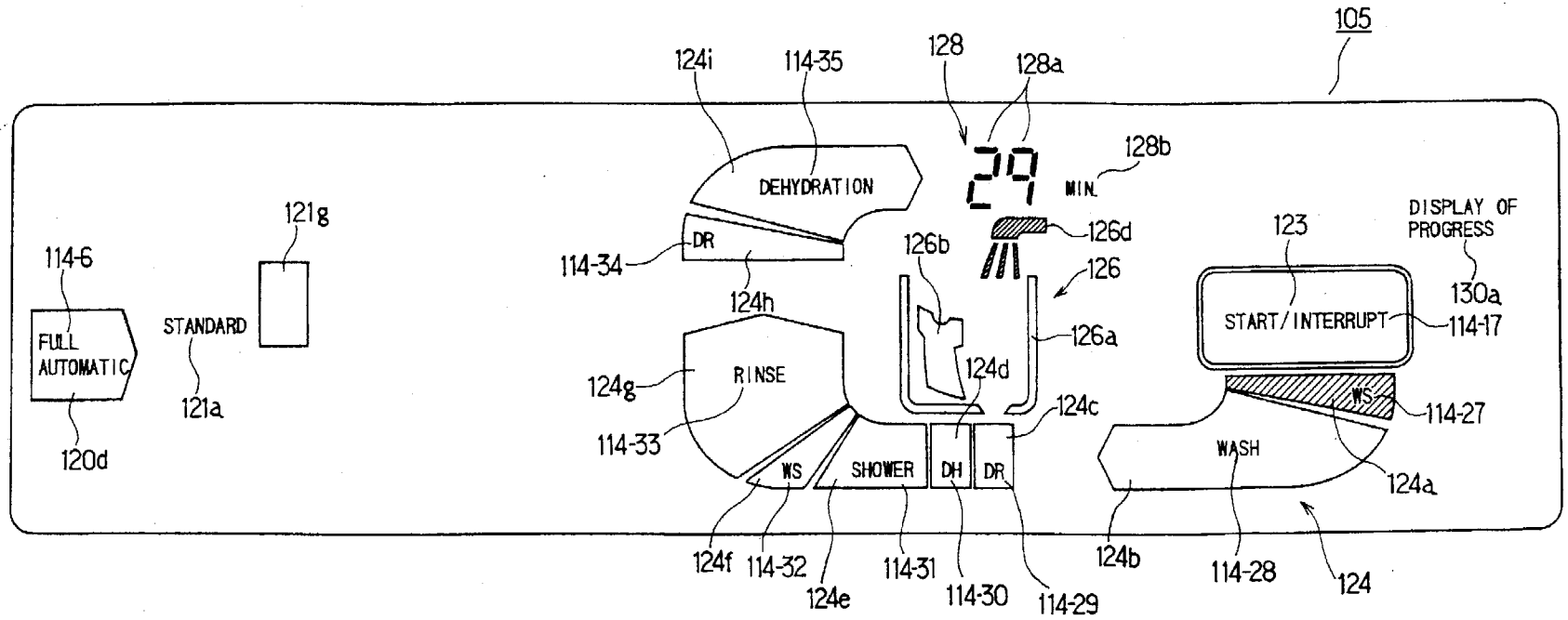
FIG. 25 is a plan view of the display device during a water supplying operation at a wash step in a STANDARD course.

(d) Water Supply in the Wash Step:

Water supply starts upon completion of the above-described weight detection. With start of the water-supply operation, the detergent spoon portion 126c of the operation display section 126 is dimmed. The faucet portion 126d and the first portion 124a having the indication 114-27 of WS repeat alternately the brightened and dimmed states so that they are flashed, thereby displaying the water-supply operation being currently executed. In FIGS. 25 to 33, the portions with oblique lines denotes those being flashed. With start of the water-supply operation, the numeric portion 128a of the remaining period display section 128 is switched so as to display the period of washing operation set on the basis of the previous detection of weight. Furthermore, the indication 128c of QUANTITY OF DETERGENT and SPOONS is dimmed, whereas the indication 128b of MIN. is brightened, whereupon the remaining period of the washing operation is displayed. FIG. 25 shows the case where the period of washing operation (the remaining period) is set at 29 minutes. The numeral displayed on the numeric portion 128a is decremented by one per minute.

Figure 26:
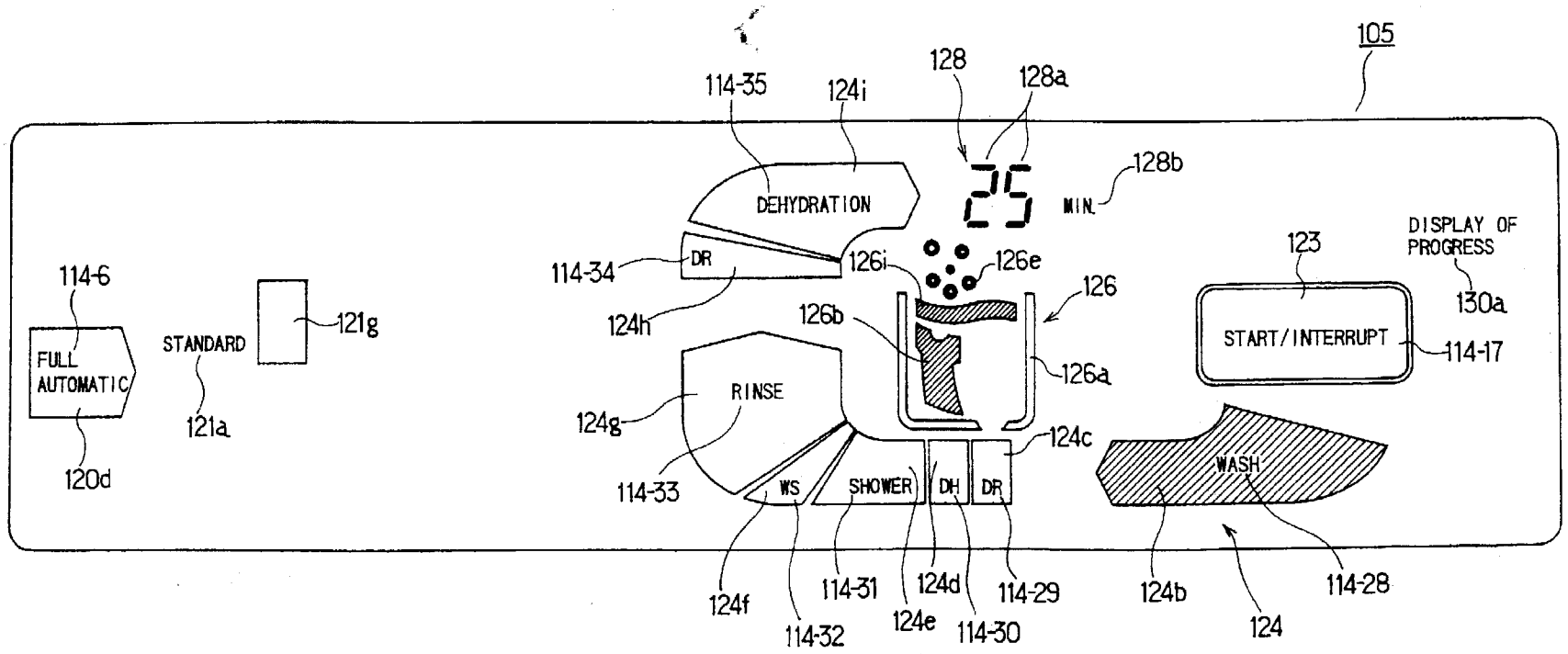
FIG. 26 is a plan view of the display device during the washing operation.

(e) Washing:

The water supply is stopped when the water level in the rotatable tub reaches the level set on the basis of the result of weight detection, for example, a maximum level. The washing is then initiated. Referring to FIG. 26, the first portion 124a having the printed indication 114-27 of WS in the progress display section 124 is dimmed, whereas the second portion 124b having the printed indication 114-28 of WASH is brightened. Furthermore, the laundry portion 126b, the maximum water-level line 126i, and the bubble portion 126e of the operation display section 126 are flashed to thereby indicate that the washing is being executed. When the washing has started, the remaining period display section 128 indicates that it is 25 minutes left.

Figure 27:
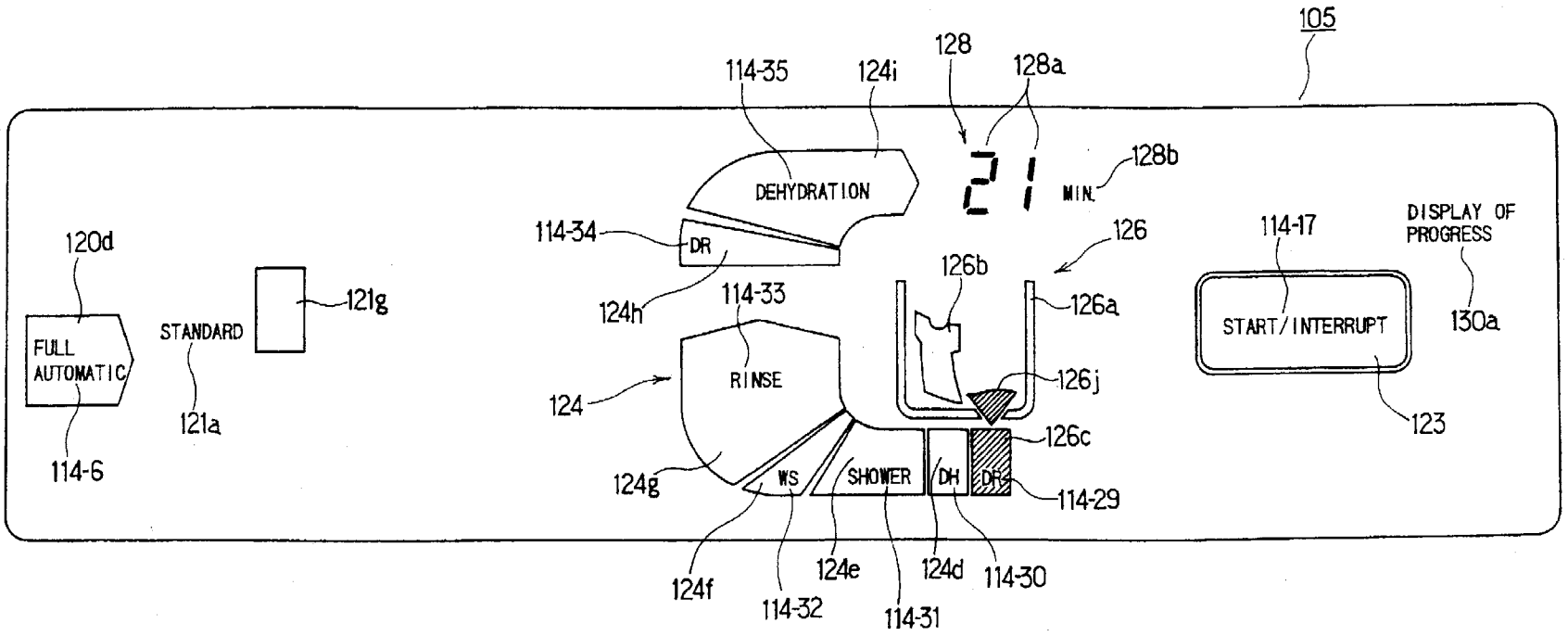
FIG. 27 is a plan view of the display device during the draining operation.

(f) Drainage in the Rinse Step:

Subsequently, drainage is performed upon completion of the washing. Referring to FIG. 27, the second portion 124b having the printed indication 114-28 of WASH is dimmed, and the third portion 124c having the printed indication 114-29 of DR is flashed. The maximum water-level line 126i is dimmed, whereas the valve portion 126j is flashed to thereby indicate that the drainage is being executed. When the drainage has started, the remaining period display section 128 indicates that it is 21 minutes left.

Figure 28:
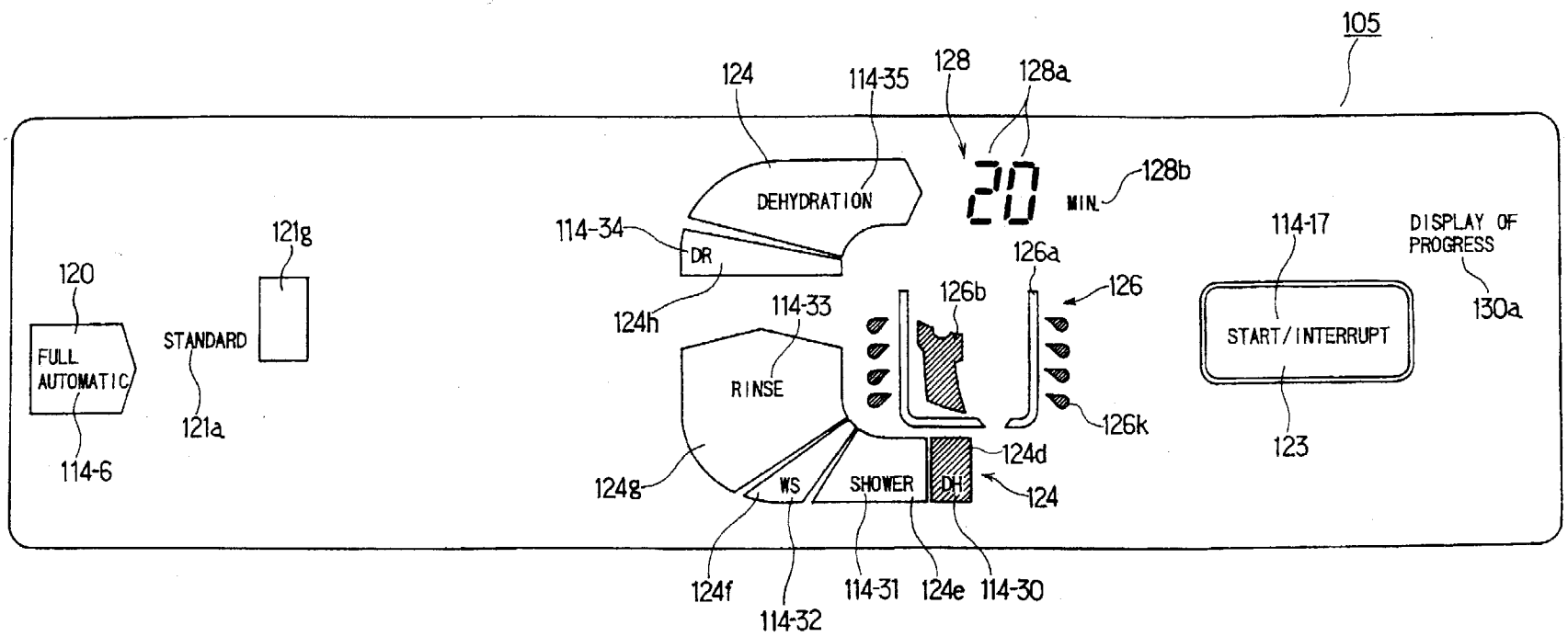
FIG. 28 is a plan view of the display device during the dehydrating operation.

(g) Dehydration:

Upon completion of the drainage, the dehydration is executed. Referring to FIG. 28, the third portion 124c having the printed indication 114-29 of DR in the step display section 124 and the valve portion 126j of the operation display section 126 are dimmed to thereby indicate completion of the drainage. The fourth portion 124d having the printed indication 114-30 of DH in the step display section 124, the laundry portion 126b, and the water drop portion 126k of the operation display section 126 are flashed to indicate that the dehydration is being executed. When the dehydration has started, the remaining period display section 128 indicates that it is 20 minutes left.

Figure 29:
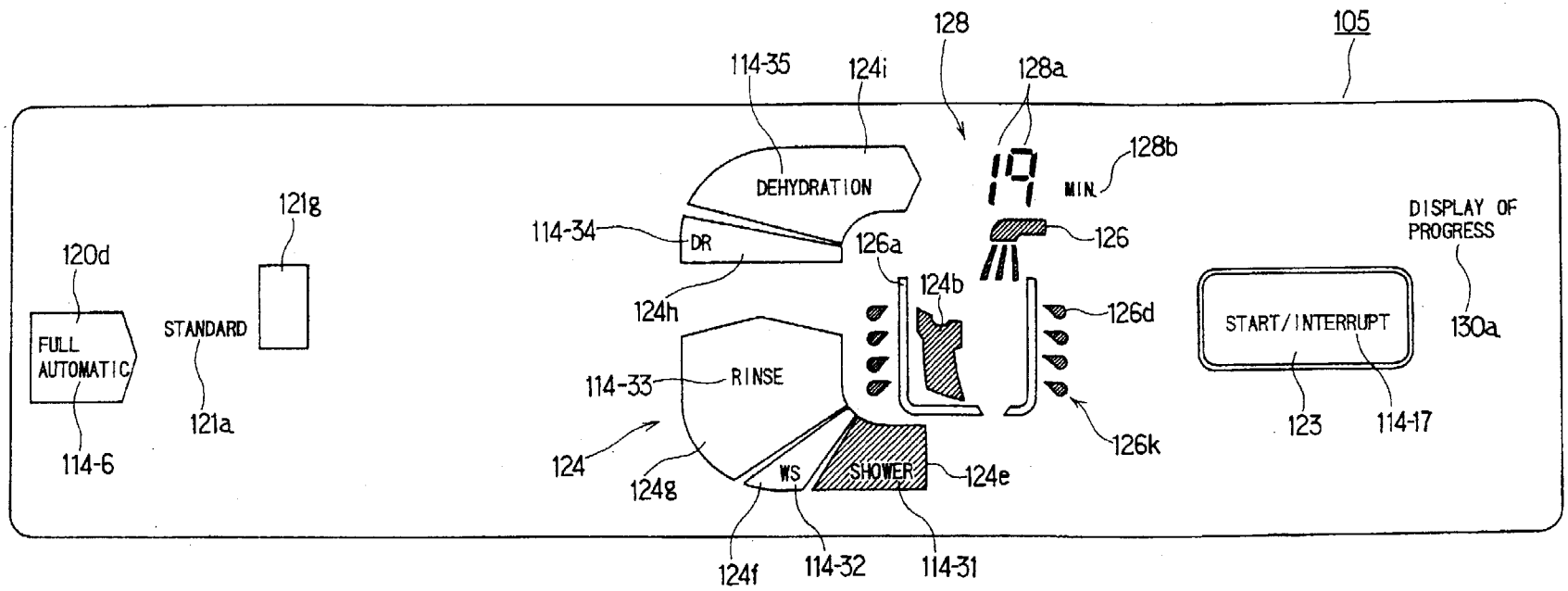
FIG. 29 is a plan view of the display device during the showering rinsing operation.

(h) Showering Rinse:

Upon completion of the drainage, the showering rinse is initiated. Referring to FIG. 29, the fourth portion 124d of the step display section 124 is dimmed to indicate completion of the dehydration. The fifth portion 124e having the printed indication of SHOWER in the step display section 124 and the laundry portion 126b, the faucet portion 126d, and the water drop portion 126k of the operation display section 126 are brightened to thereby indicate that the showering rinse is being executed. The remaining period display section 128 indicates that it is 19 minutes left.

Figure 30:
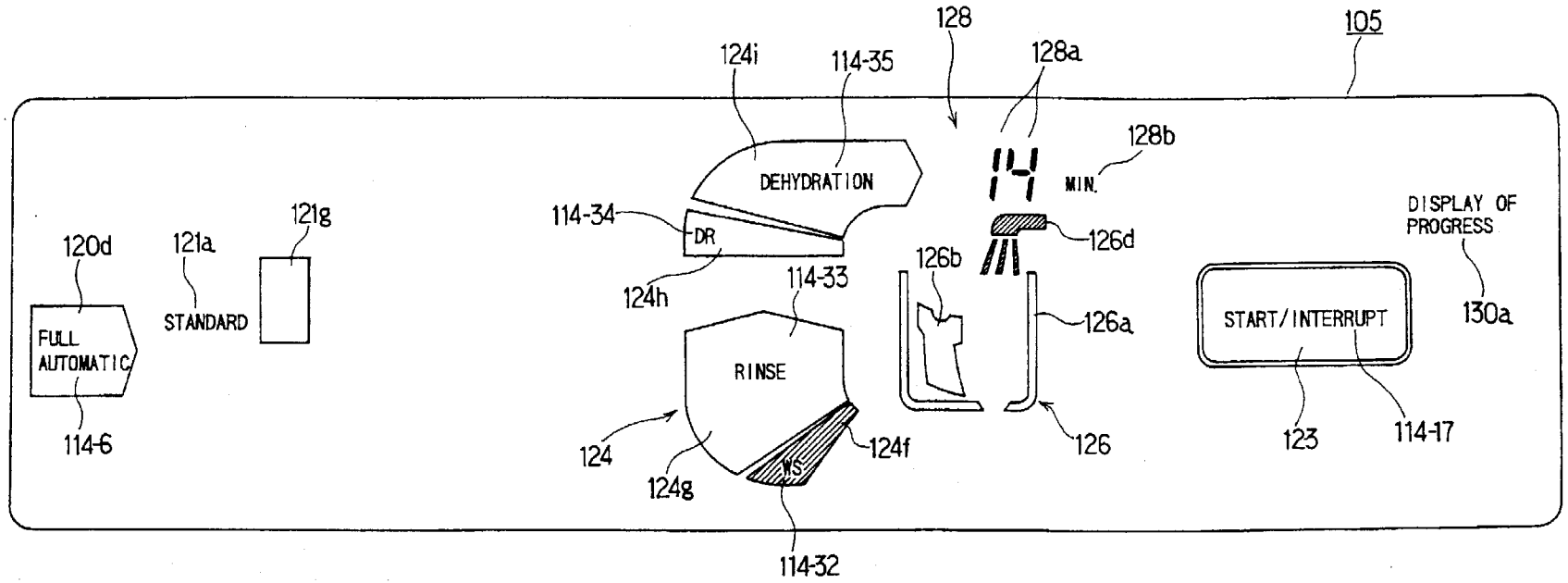
FIG. 30 is a plan view of the display device during the water supplying operation prior to the stored-water-rinse.

(i) Water Supply:

Upon completion of the showering rinse, the water supply is executed so that water is stored in the rotatable tub. Referring to FIG. 30, the fifth portion 124e of the step display section 124 and the water drop portion 126k of the operation display section 126 are dimmed to thereby indicate completion of the showering rinse. The sixth portion 124f having the printed indication 114-32 of WS in the step display section 124 and the faucet portion 126d of the operation display section 126 are brightened to indicate that the water supply is being executed. The remaining period display section 128 indicates that it is 14 minutes left.

Figure 31:
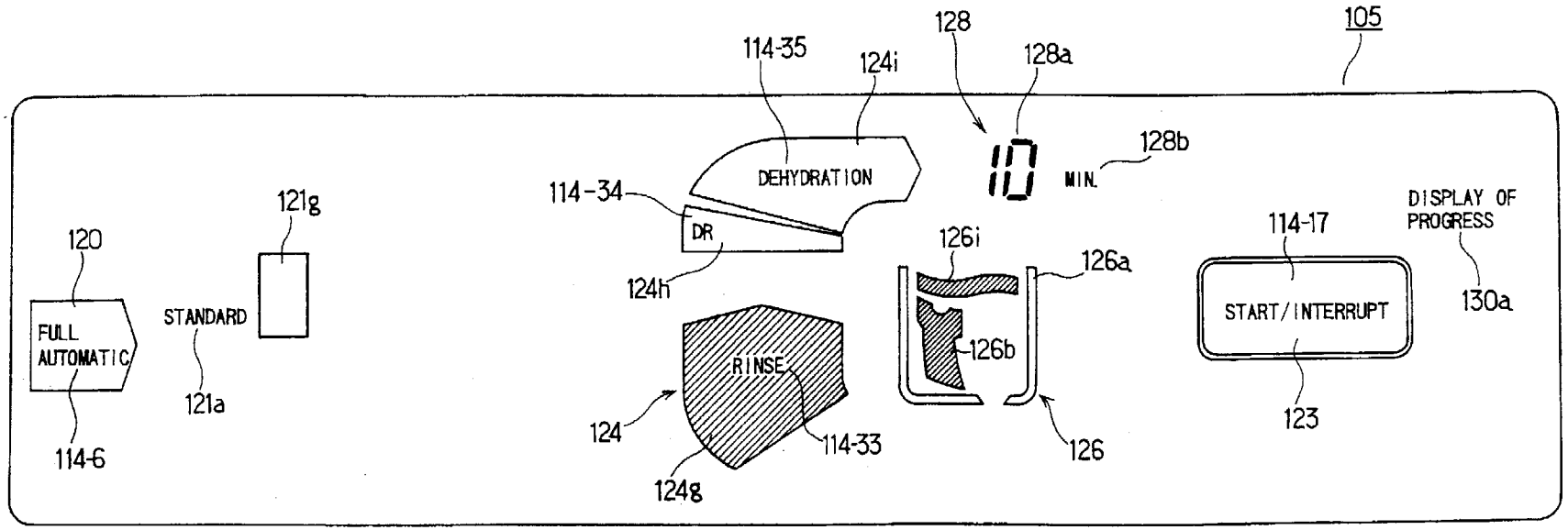
FIG. 31 is a plan view of the display device during the stored-water-rinse.

(j) Stored-Water-Rinse:

The water supply is completed when water has reached the set water level in the rotatable tub. The stored-water-rinse is then executed. Referring to FIG. 31, the sixth portion 124f of the step display section 124 and the faucet portion 126d of the operation display section 126 are dimmed, whereas the seventh portion 124g having the printed indication 114-33 of RINSE in the step display section 124, and the laundry portion 126b and the maximum water-level line 126i of the operation display section 126 are flashed to thereby indicate that the stored-water-rinse is being executed. The remaining period display section 128 indicates that it is 10 minutes left.

Figure 32:
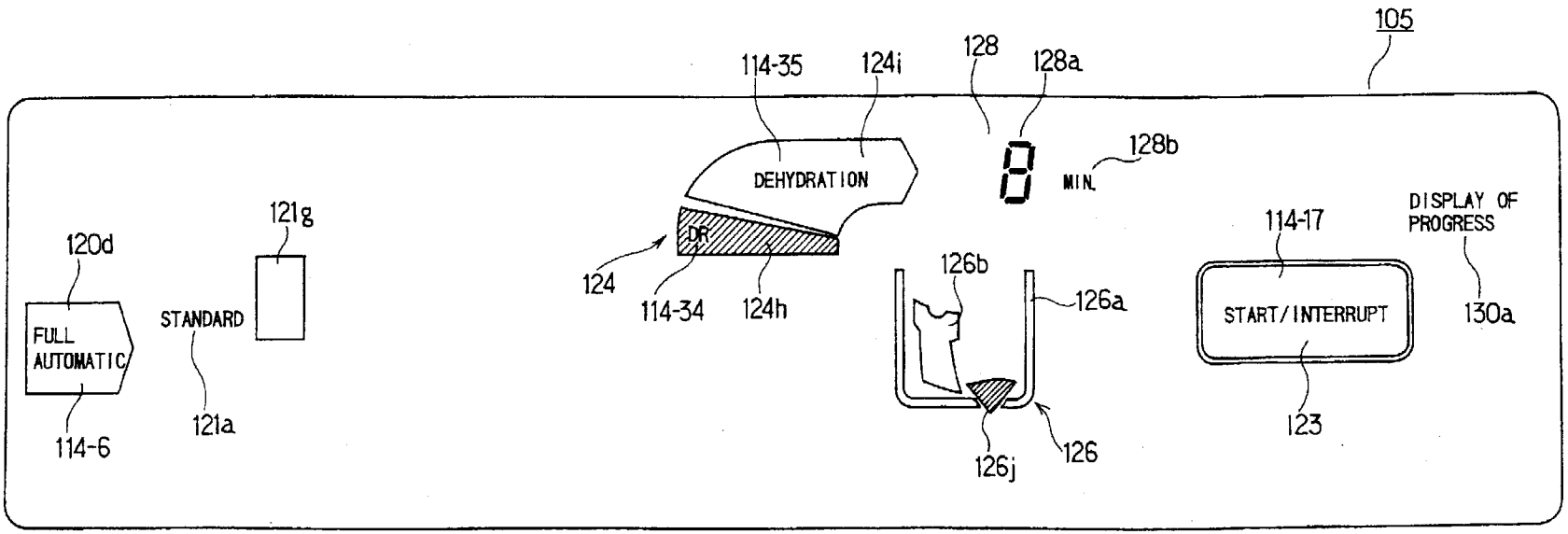
FIG. 32 is a plan view of the display device during the draining operation subsequent to the stored-water-rinse.

(k) Drainage in the Dehydration Step:

The drainage in the dehydration step is executed upon completion of the stored-water-rinse. Referring to FIG. 32, the seventh portion 124g of the step display section 124 and the maximum water-level line 126i of the operation display section 126 are dimmed, whereas the eighth portion 124h having the printed indication 114-34 of DR in the step display section 124 and the valve portion 126j of the operation display section 126 are flashed to thereby indicate that the drainage is being executed. The remaining period display section 128 indicates that it is 8 minutes left.

Figure 33:
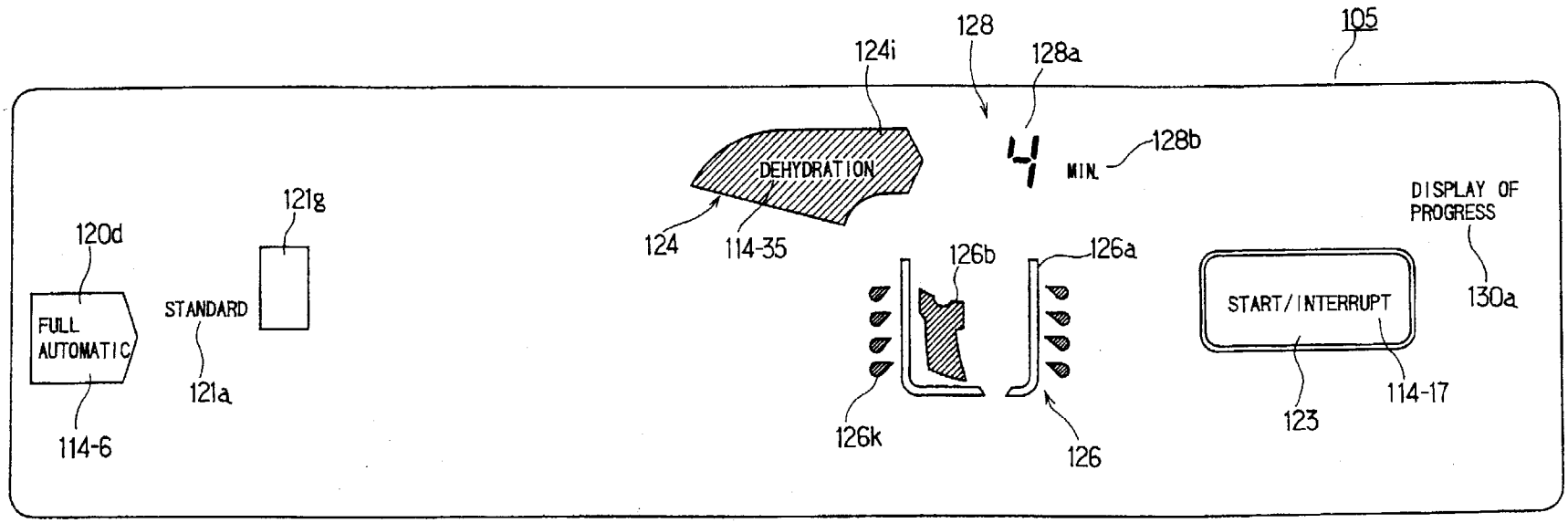
FIG. 33 is a plan view of the display device during the final dehydrating operation.

(l) Dehydration:

The dehydration is executed upon completion of the drainage. Referring to FIG. 33, the eighth portion 124h of the step display section 124 and the valve portion 126j of the operation display section 126 are dimmed, whereas the ninth portion 124i having the printed indication 114-35 of DH in the step display section 124, and the laundry portion 126b and the water drop portion 126k of the operation display section 126 are flashed to thereby indicate that the dehydration is being executed. The remaining period display section 128 indicates that it is 4 minutes left.

(m) Completion:

The washing operation under the STANDARD course is completed upon termination of the dehydration. The ninth portion 124i of the step display section 124, and the rotatable tub portion 126a, the laundry portion 126b, and the water drop portion 126k of the operation display section 126 are dimmed, and a buzzer (not shown) is activated to inform of completion of the washing operation. The pentagonal portion 120d having the printed indication of FULL AUTOMATIC in the mode display section 120 remains in the brightened state. Furthermore, the indication 121a of STANDARD of the full automatic course display section 121 and the square portion 121g displaying the location of the standard course selecting key switch 109c also remain in the brightened state. Additionally, the remaining period display section 128 keeps displaying "0 MIN." When the OFF switch 107 is operated so that power is turned off, all the portions of the display device 105 remaining in the brightened state are dimmed.

The numeric portions 122*b* to 122*d* of the manual operation display section 122 are brightened when the manual key switch 109*a* is operated for individual selection of the wash, rinse, and dehydration modes in execution of the washing operation. Simultaneously, the light-emitting diodes 131 disposed on the back of these numeric portions are turned on to illuminate them.

According to the above-described embodiment, the light-emitting diodes 131 are disposed on the back of the numeric portions 122*b* to 122*d* of the manual operation display section 122, the operation display section 126, and the remaining period display section 128. The light emitted by the light-emitting diodes 131 are irradiated outward through the numeric portions 122*b* to 122*d* of the manual operation display section 122, the operation display section 126, and the remaining period display section 128 when these portions and sections of the display device perform the displaying operations. Accordingly, the light emitted by the light-emitting diodes 131 illuminates the numeric portions 122*b* to 122*d* displaying the wash period, the number of times of rinsing, and the dehydration period respectively, the operation display section 126 displaying the figure showing the currently executed operation, and the remaining period display section 128 displaying the remaining period even when it is dark around the washing machine such that light reflected on the reflector 111 can provide insufficient brightness. Consequently, the user can clearly and easily confirm the contents displayed on these portions and sections of the display device. Since the light-emitting diodes 131 are disposed in the illumination chamber A surrounded by the light-shielding wall 132, the light emitted by the light-emitting diodes 131 can be prevented from leaking out to illuminate other portions than those which should be normally illuminated.

The inner peripheral surface of the light-shielding wall 132 is formed so as to reflect the light emitted by the light-emitting diodes 131 toward the numeric portions 122*b* to 122*d*, the operation display section 126, and the remaining period display section 128. Consequently, since a quantity of light illuminating these portions and sections is increased, further clear display can be provided. Additionally, the light guide member 133 is disposed in the illumination chamber A for guiding the light emitted by the light-emitting diodes 131. Accordingly, the numeric portions 122*b* to 122*d*, the operation display section 126, and the remaining period display section 128 can be uniformly illuminated. Consequently, these portions and sections can be prevented from being partially rendered bright or dark.

The light guide member 133 occupies almost the entire interior of the illumination chamber A. Accordingly, a vacant space is exceedingly small in the illumination chamber A. When the vacant space is large in the illumination chamber, air in the chamber is alternately compressed and expanded with the changes in the atmospheric temperature. This phenomenon is referred to as "respiration." Upon occurrence of such respiration, external damp enters the illumination chamber through minute openings. In the embodiment, however, this drawback can be prevented by the disposition of the light guide member 133 in the illumination chamber A. Consequently, the dampproofing for the display device 105 and the circuit board 116 can be secured. Furthermore, the light-shielding wall 132 is abutted against the circuit board 116 or the minute gap is fluid-tightly provided therebetween. Accordingly, the dampproofing material 117 can be prevented from entering the illumination chamber A when accommodated in the casing 103. Consequently, the dampproofing material 117 can be prevented from entering the space between the light-emitting diodes 131 and the display device 105 such that the display device cannot be illuminated.

The information the user wishes to obtain from the display device 105 during execution of the washing operation includes the information about the values at which the wash period and the dehydration period have been manually set, the information about the set number of times of the rinsing, the information about the currently executed operation and step, and the information about the remaining period necessary for completion of the washing operation. In the above-described embodiment, the light-emitting diodes 131 are disposed on the back of the numeric portions 122*b* to 122*d* of the manual operation display section 122, the operation display section 126, and the remaining period display section 128. Consequently, these pieces of information can be obtained reliably and easily from the display device 105 even when it is dark around the washing machine.

The frames, characters, and numerals 114-1 to 114-47 are printed on the overlay 114 as shown in FIG. 19. Accordingly, the types of contents displayed on the display sections 120 to 130 can be clearly understood. Since the printed frames, characters, and numerals 114-1 to 114-47 contain the luminous material, these portions self-emit light even when it is dark around the washing machine. Consequently, the contents displayed on the respective display sections 120 to 130 can be clearly and easily viewed even under dark circumstances.

The membrane switch 109 is provided on the back of the display device 105 so as to serve as the various key switches 109*a* to 109*p*. These key switches can be operated by depressing the NCAP liquid crystal panel 110. This arrangement of the key switches differs from that of the prior art wherein the key switches are disposed in the vicinity of the display device on the operation panel. Consequently, the area of the display device 105 occupying the operation panel 104 can be increased, whereupon the visibility of the display device can be improved.

Figure 34:
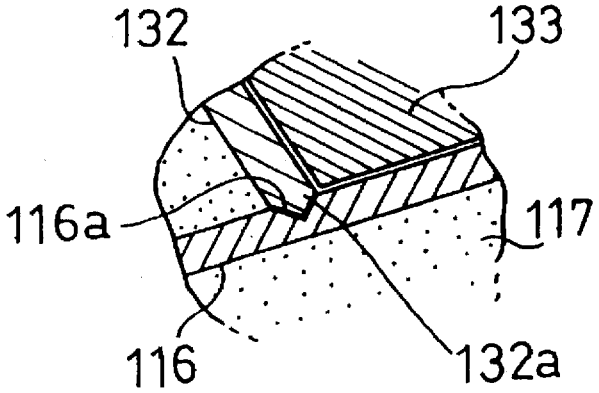
FIG. 34 is a partial sectional view showing the structure for preventing dampproofing material from entering an illumination chamber in a washing machine of an eighth embodiment in accordance with the present invention.
Figure 35:
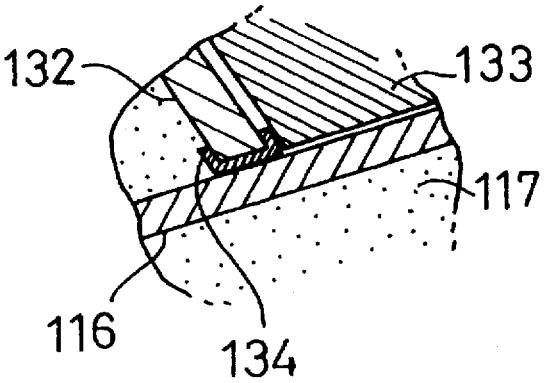
FIG. 35 is a partial sectional view showing the structure for preventing dampproofing material from entering the illumination chamber in a washing machine of a ninth embodiment in accordance with the present invention.

FIGS. 34 and 35 illustrate eighth and ninth embodiments of the invention. The eighth and ninth embodiments each relate to the structure for preventing the dampproofing material from entering the illumination chamber A through the gap between the circuit board 116 and the light-shielding wall 132 which is a peripheral wall of the illumination chamber A. Referring first to FIG. 34 showing the eighth embodiment, the lower end of the light-shielding wall 132 has a V-shaped section. The circuit board 116 has a V-shaped groove 116*a* formed in the upper surface thereof. The V-shaped end 132*a* of the light-shielding wall 132 is fitted with the V-shaped groove 116*a*, whereby the structure for preventing entrance of the dampproofing material is provided. On the other hand, in the ninth embodiment as shown in FIG. 35, a rubber packing 134 is attached to the distal end of the light-shielding wall 132, for example. The packing 134 is pressed against the circuit board 116 so that the structure for preventing entrance of the dampproofing material is provided.

Figure 36:
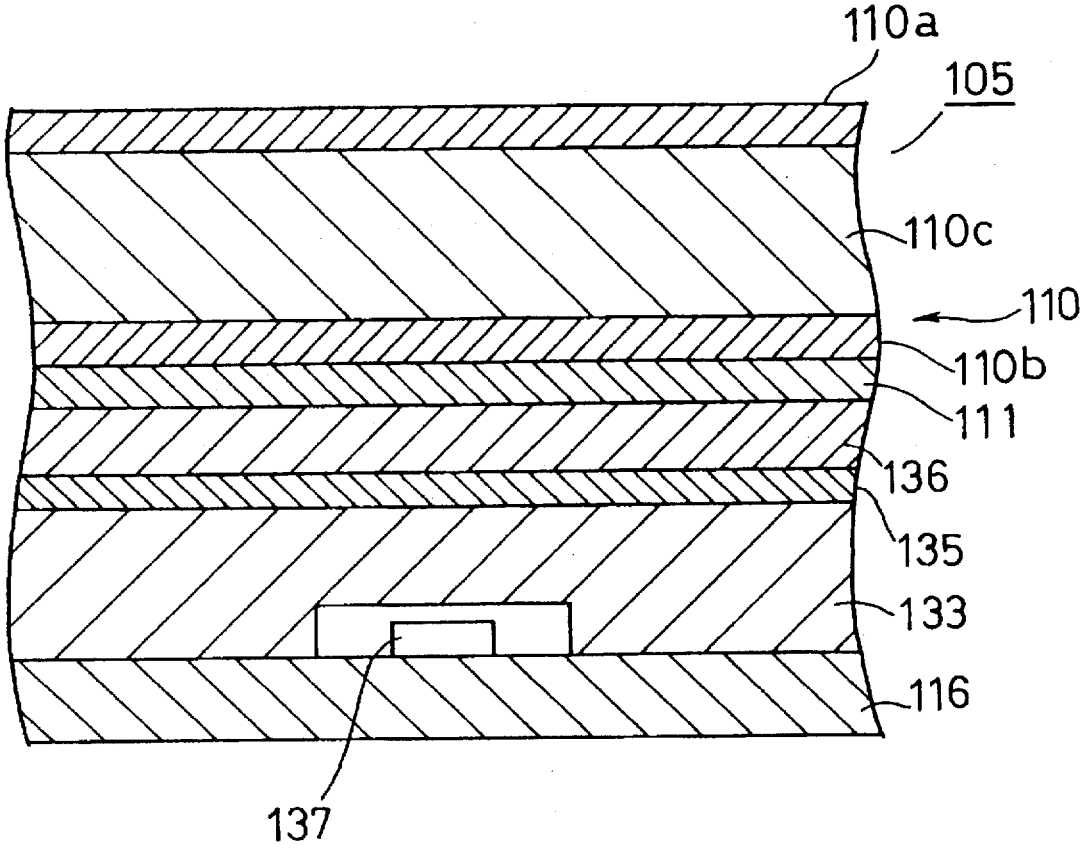
FIG. 36 is a longitudinally sectional view of a display device and a membrane switch employed in a display device of a washing machine of a tenth embodiment in accordance with the present invention.

FIG. 36 illustrates a tenth embodiment of the invention. A transparent membrane switch 136 is provided as the switch means on the back of the NCAP liquid crystal panel 110. The membrane switch 136 is reinforced by a reinforcing plate 135 which is made of a transparent material such as transparent plastic. A plurality of light-emitting diodes 137 one of which is shown are provided on the back of the membrane switch 136 to serve as the light-emitting means. The light-emitting diodes 137 illuminate the portions and sections corresponding to the various key switches 109*a* to 109*p* constituted by the membrane switch 136, that is, the pentagonal portions 120*c* and 120*d* of the mode display section 120, the square portions 121*g* to 121*l* of the full automatic course display section 121, the operation switch display section 123, the second, seventh, and ninth portions 124*b*, 124*g*, and 124*i* of the step display section 124, the indication 125*a* of MANUAL ADJUSTMENT of the manual adjustment display section 125, both triangular portions 127*b* and 127*c* of the water-level selecting switch display section 127, and the trapezoidal portion 129*a* of the reserved operation display section 129 all as shown in FIG. 18. Consequently, since the locations of the various key switches 109*a* to 109*p* can be clearly and easily confirmed even in the dark circumstances, error in operation of these key switches can be prevented.

Although the frames, characters, and numerals 114-1 to 114-47 are printed on the overlay 114 in the foregoing embodiments, they may be printed on the reflecting plate 111, instead. In this case, since the indications corresponding to the brightened display sections are viewed, these indications can be prevented from being mistaken for the other indications corresponding to the dimmed display sections. Furthermore, the reflecting plate 111 may not be provided when the display sections 120 to 130 are illuminated by the light-emitting diodes from the back thereof. Additionally, the microcomputer is provided for detecting the Weight of the laundry on the basis of the motor load at the initial stage of the wash step, thereby constituting the weight (laundry quantity) detecting means. At the same time, the microcomputer is also provided for setting the quantity of detergent and the wash period on the basis of the detected weight, thereby serving as the detergent quantity setting means and the wash period setting means. Instead, the user may visually confirm the weight or the quantity of laundry to thereby input the information obtained by the visual confirmation to the microcomputer by means of key switches.

Figure 37:
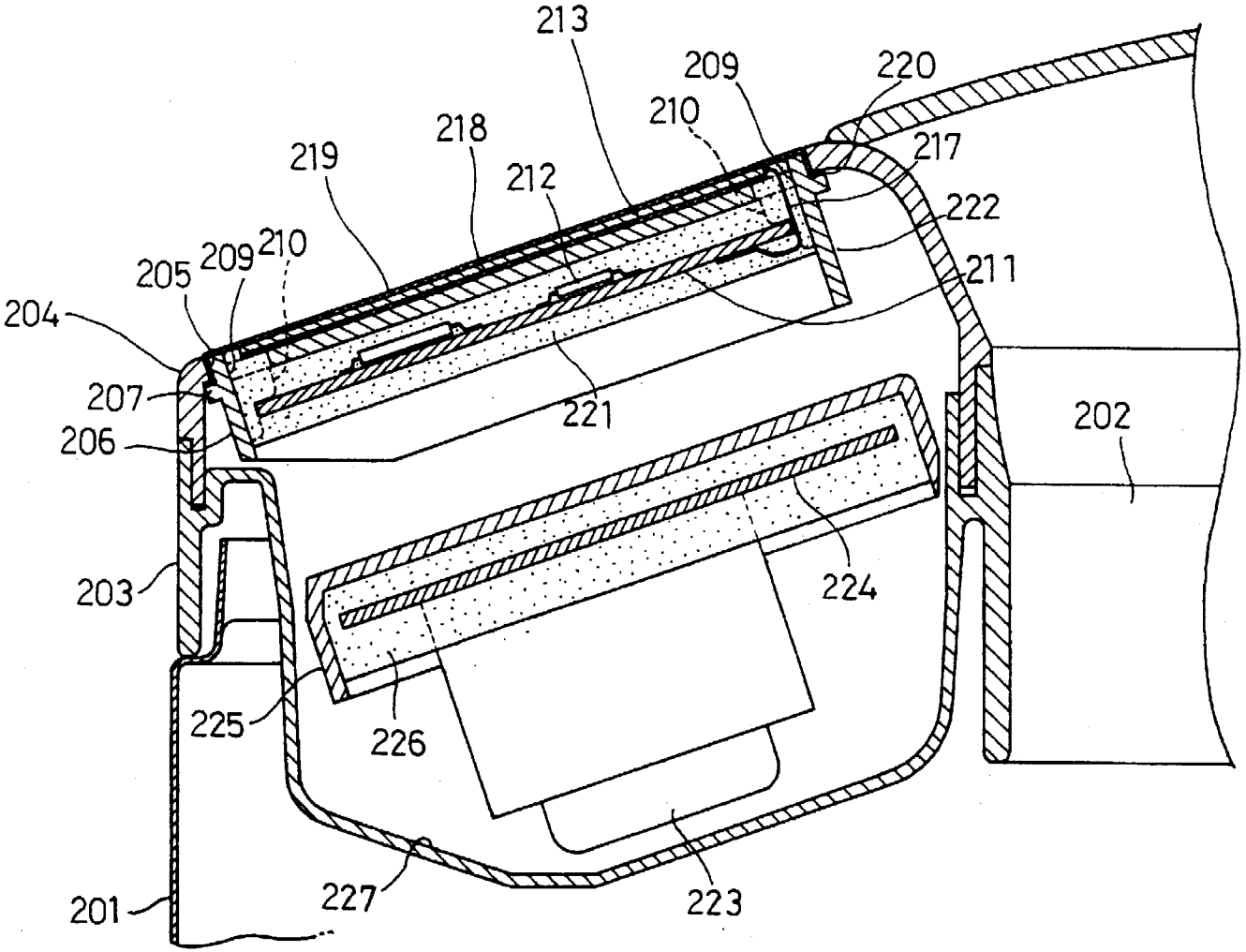
FIG. 37 is a longitudinally sectional side view of the display device employed in a washing machine of an eleventh embodiment in accordance with the present invention.
Figure 38:
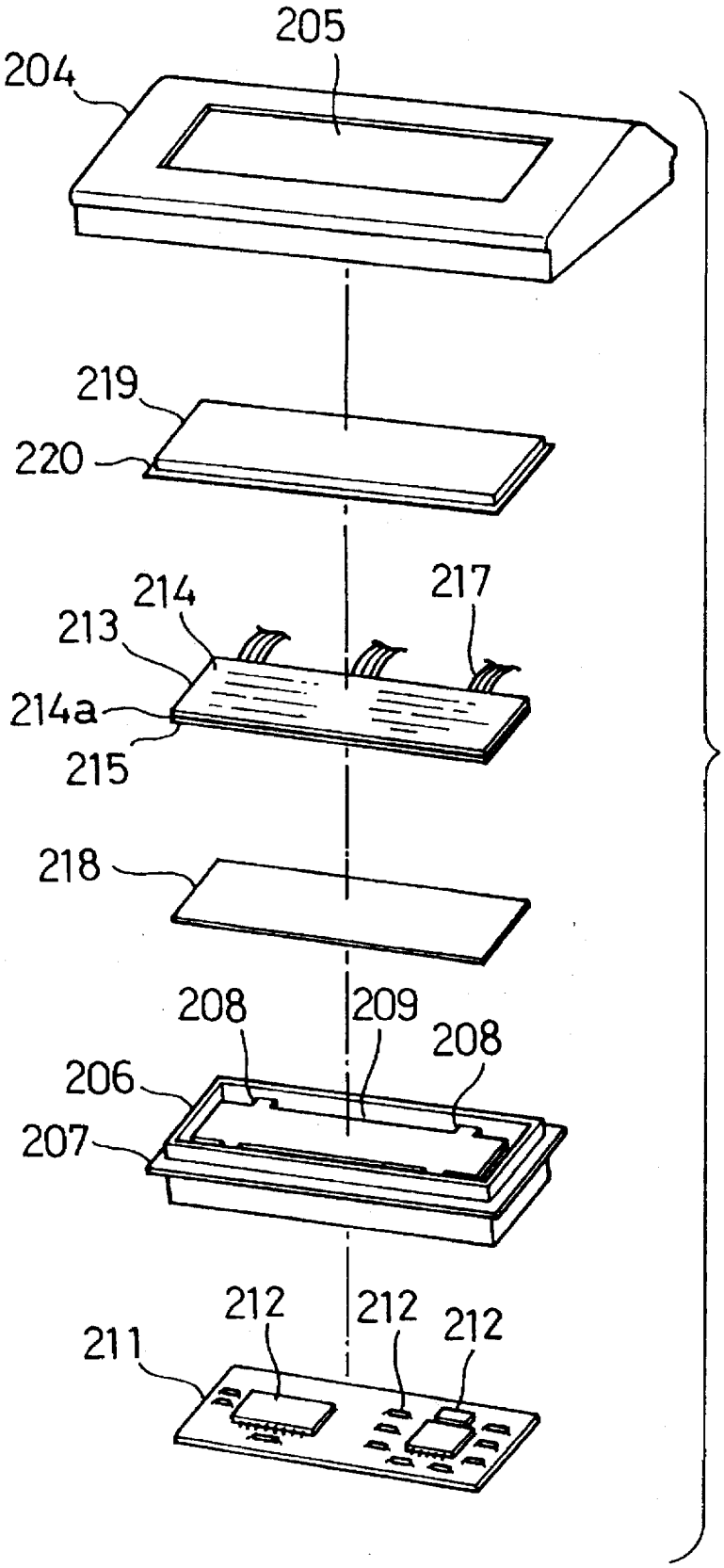
FIG. 38 is an exploded perspective view of an ornamental panel and the display device.
Figure 39:
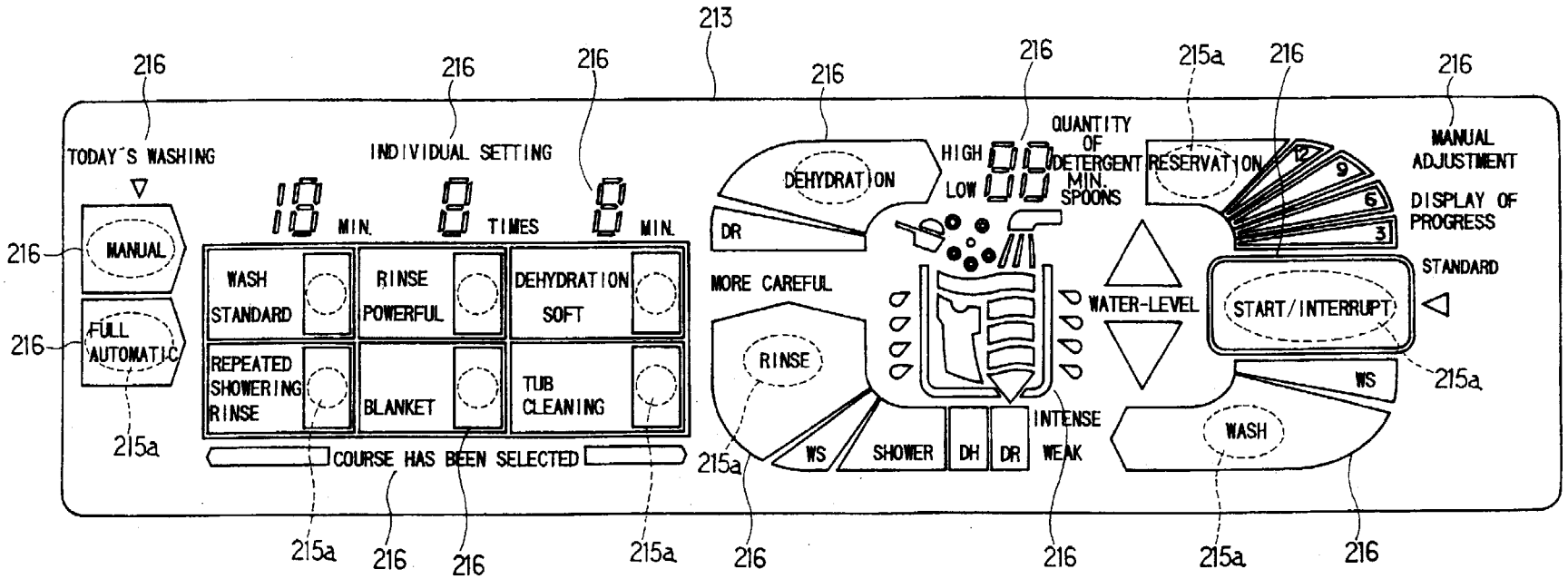
FIG. 39 is a plan view of a liquid crystal display panel.

FIGS. 37 to 39 illustrate an eleventh embodiment of the invention. Referring to FIG. 37, a top cover 203 having an access opening 202 is mounted to the top of the outer cabinet 201. An ornamental panel 204 is mounted to the front of the top cover 203. The ornamental panel 204 has a centrally formed rectangular opening 205 as shown in FIG. 38.

A casing 206 is formed into a rectangular box slightly smaller than the opening 205 of the ornamental panel 204. The casing 206 has a flange 207 protruding from the middle outer periphery thereof. The flange 207 is larger than the opening 205 of the ornamental panel 204. The casing 206 further has a plurality of connecting ribs 208 formed on the periphery of the bottom and an opening 209. The casing 206 further has a plurality of receiving portions 210 formed in the inner periphery thereof, as shown in FIG. 37.

Electronic components 212 constituting an operation control circuit are mounted on both sides of a circuit board 211. A liquid crystal display panel 213 comprises the NCAP liquid crystal panel 214, a reflecting plate 214*a*, and a flat membrane switch 215 serving as the switch means as shown in FIG. 38. The reflecting plate 214*a* and the membrane switch 215 are bonded to the NCAP liquid crystal panel 214 in turn so as to be laid one upon the other. The liquid crystal display panel 213 includes a plurality of display sections 216 having indications of characters and figures as shown in FIG. 39. Unit switches 215*a* of the membrane switch 215 are provided on the back of the display sections 216 that also serve as operation sections. Flat package cables (FPC's) serving as lead wires extend out of the liquid crystal display panel 213. A metal plate 218 such as a stainless steel plate or a galvanized sheet iron is formed into a rectangular shape, having the same size as the liquid crystal display panel 213. A cover 219 is made of polyethylene terephthalate or polycarbonate, for example. The cover 219 has approximately the same configuration as the upper portion of the casing 206 extending from the upper surface of the flange 207. The cover 219 has a flange 220 which is the same as the flange 207.

The circuit board 211 is placed on the receiving portions 210 in the casing 206 to be fixed in position as shown in FIG. 37. The metal plate 218 is laid on the outer bottom of the casing 206 to be fixed in position. The liquid crystal display panel 213 is further laid on the metal plate 218 to be fixed in position. One ends of FPC's 217 of the liquid crystal display panel 213 extend through the opening 209 of the casing 206 to be connected to lead terminals of the circuit board 211. The cover 219 is attached so as to be held on the flange 207 of the casing 206, whereupon the liquid crystal display panel 213 is covered by the cover 219. The outer periphery of the cover 219 is bonded to the outer periphery of the casing 206. In this state, a dampproofing material 221 such as urethane resin is put into the casing 206 so that the circuit board 211 is enclosed in the dampproofing material 221. A part of the dampproofing material 221 is caused to further get into the opening 209, thereby enclosing FPC's 217. Consequently, an electronic unit 222 is constituted.

The electronic unit 222 is forced into the opening 205 of the ornamental panel 204 from below the panel, thereby being mounted thereon. In this case, the outer periphery of the casing 206 of the electronic unit 222 is pushed against the peripheral edge of the opening 205 of the ornamental panel 204 so that the electronic unit 222 is secured to the ornamental panel 204 and so that the outer periphery of the cover 219 is held between the peripheral edge of the opening 205 and the casing 206. The circuit board 211 constitutes a first circuit board. The electronic components mounted on the circuit board 211 are DC components for the liquid crystal display panel 213. On the other hand, a second circuit board 224 is provided, and AC electronic components 223 including a transformer are mounted on the second circuit board 224. The second circuit board 224 is accommodated in another casing 225 and the dampproofing material 226 is put into the casing 225 so that the second circuit board 224 is enclosed in the material. The casing 225 accommodating the second circuit board 224 is located in a concave portion 227 of the top cover 203 inside the ornamental panel 204 mounted on thereon to thereby be fixed in position.

According to the above-described construction, the cover 219 covering the liquid crystal display panel 213 is secured to the casing 206. The outer periphery of the cover 219 is held between the peripheral edge of the opening 205 of the ornamental panel 204 and the casing 206. Consequently, water can be more reliably prevented from entering the casing 206 to thereby reach the liquid crystal display panel 213 and the circuit board 211. Thus, the above-described construction provides a more reliable sealing as compared with the prior art construction wherein the peripheral edge of the liquid crystal display panel is sealed. In particular, FPC's 217 extending through the opening 209 of the casing 206 are used to connect between the liquid crystal display panel 213 and the circuit board 211. Furthermore, FPC's are enclosed in the dampproofing material 221 which is accommodated in the casing 206 and is caused to get into the opening 209. Consequently, FPC's 217 can be reliably waterproofed and moreover, the dampproofing material provided for the purpose of the dampproofing of the circuit board 211 can be used for waterproof of FPC's 217. Furthermore, the liquid crystal display panel 213 is provided with the membrane switch 215 and the metal plate 218 is laid between the membrane switch 215 and the bottom of the casing 206. Since the operating pressure applied to the membrane switch 215 can be received by the metal plate 218, the membrane switch 215 can be reliably operated.

Figure 40:
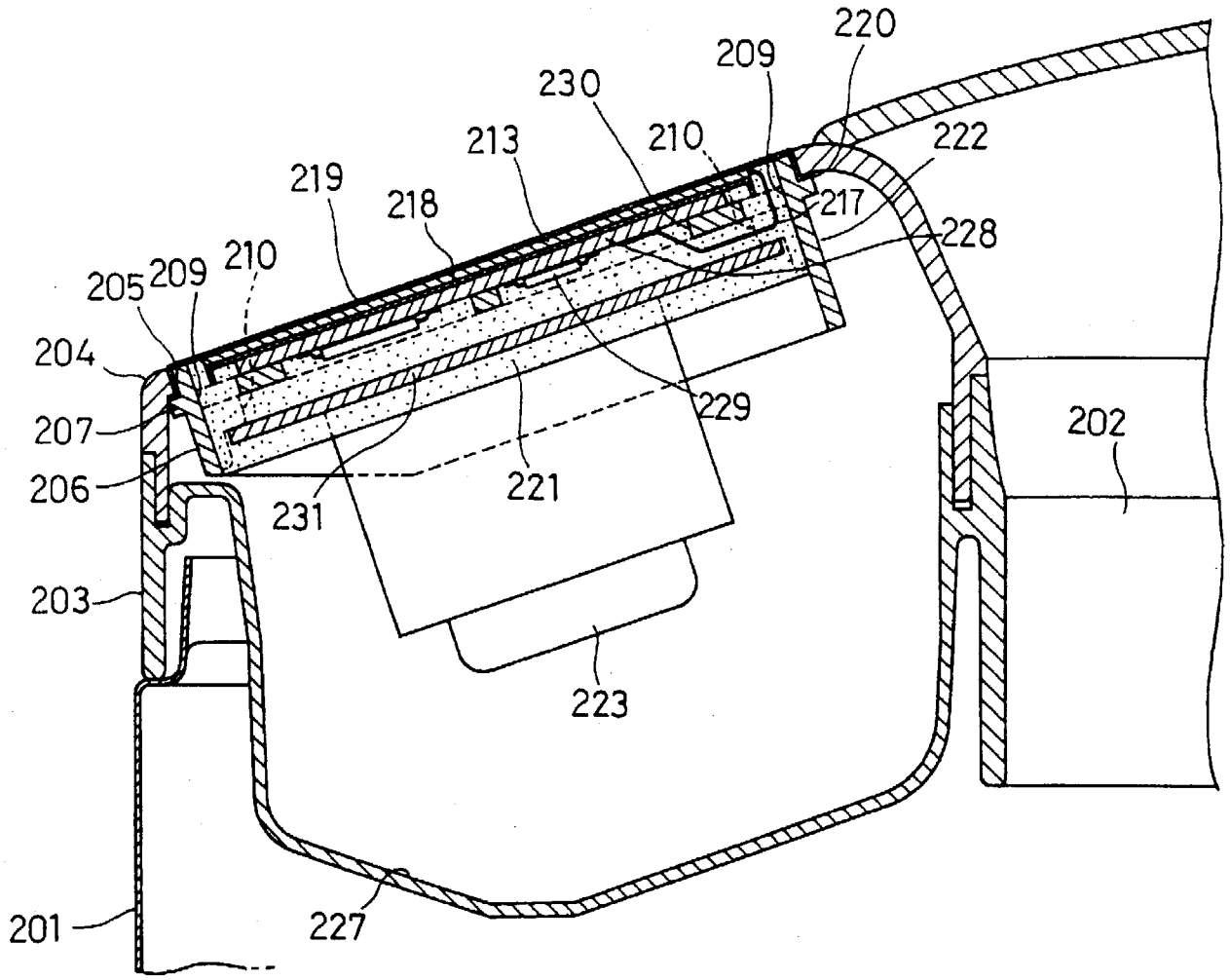
FIG. 40 is a longitudinally sectional side view of the display device employed in a washing machine of a twelfth embodiment in accordance with the invention.
Figure 41:
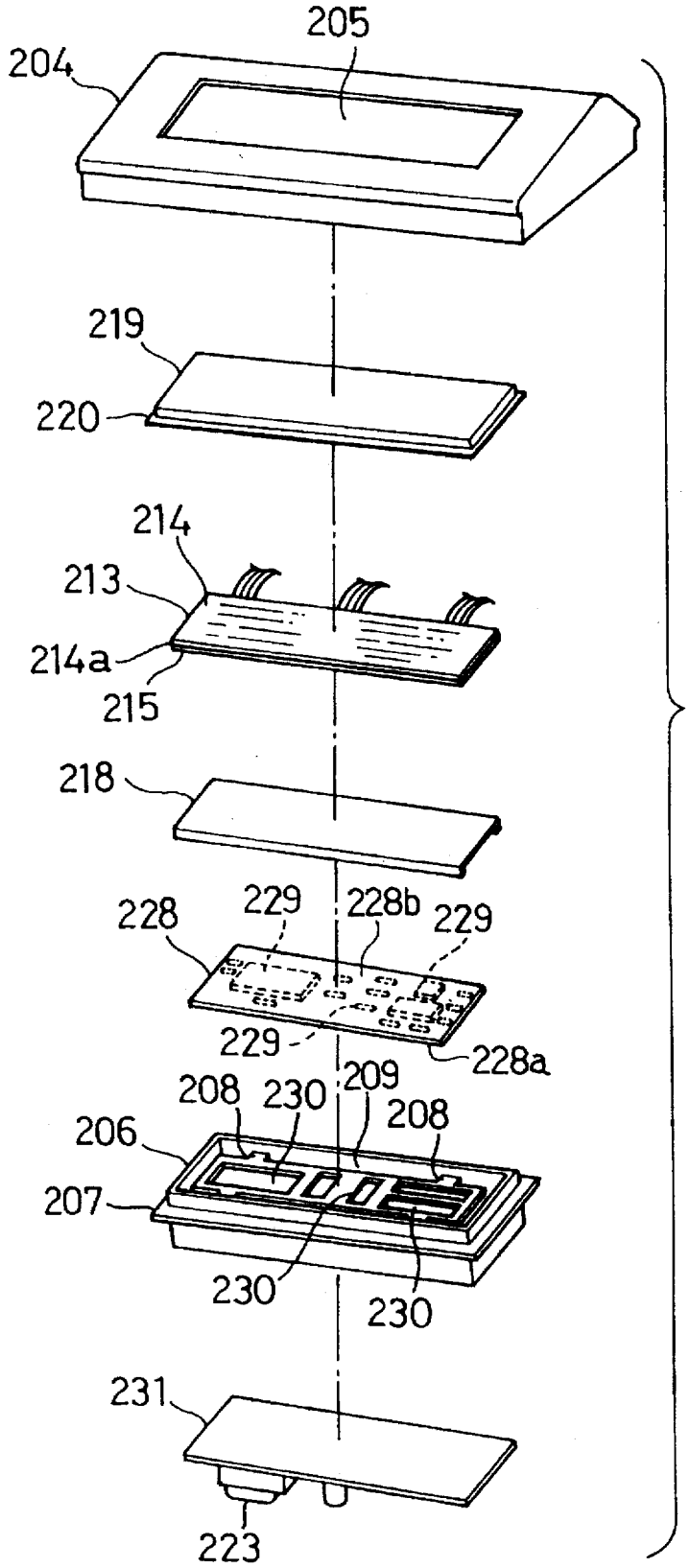
FIG. 41 is an exploded perspective view of an ornamental panel and the display device.

FIGS. 40 and 41 illustrate a twelfth embodiment of the invention. The difference between the eleventh and twelfth embodiments will be described. The first circuit board 228 is disposed between the metal plate 218 and the bottom of the casing 206. The electronic components 229 are mounted only on one side surface 228*a* of the circuit board 228. The circuit board 228 is disposed inside out in an opening 230 formed in the bottom of the casing 206. The casing 206 further accommodates the second circuit board 231, which is fixed therein. Thus, since the two circuit boards 228 and 231 can be provided in the single casing 206, the casing 225 employed in the eleventh embodiment can be eliminated in the twelfth embodiment.

The circuit board 228 is disposed in the opening 230 of the casing 206 inside out with respect to the liquid crystal display panel 213 having the membrane switch 215 laid on the panel. Accordingly, the positioning of the components 229 on the first circuit board 228 in the opening 230 can be achieved only by turning over the circuit board 228. Furthermore, the first circuit board 228 can support on the backside thereof the metal plate 218 which is subjected to the operating pressure applied to the membrane switch 215. More specifically, the components 229 are mounted on the surface of the first circuit board 228, and the metal plate 218 is laid on the resultant flat backside 228*b* of the circuit board 228. Consequently, the flat backside 228*b* of the circuit board 228 can reliably support the metal plate 218 receiving the operating pressure applied to the membrane switch 215.

Figure 42:
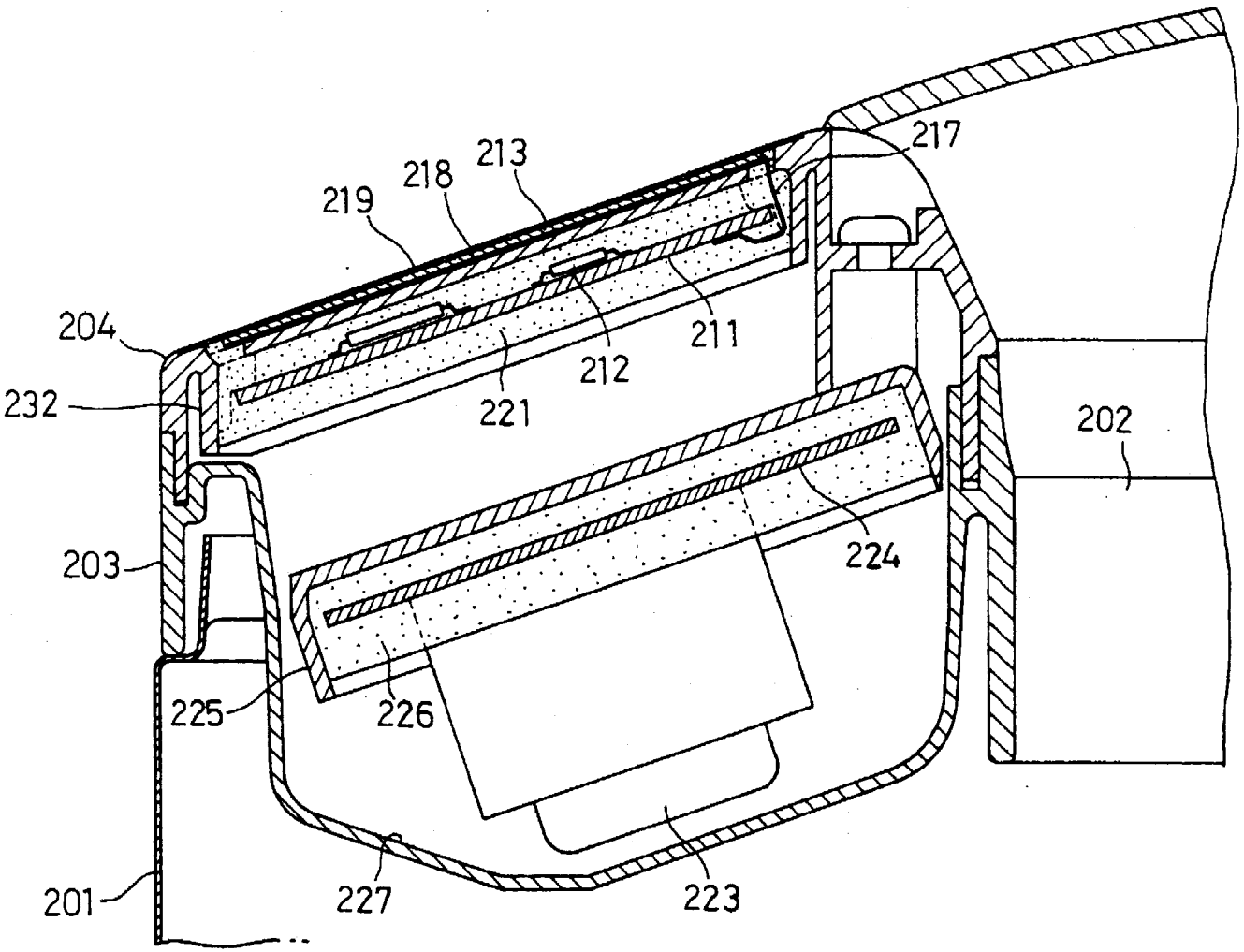
FIG. 42 is a longitudinally sectional side of a display device employed in a washing machine of a thirteenth embodiment in accordance with the present invention.
Figure 43:
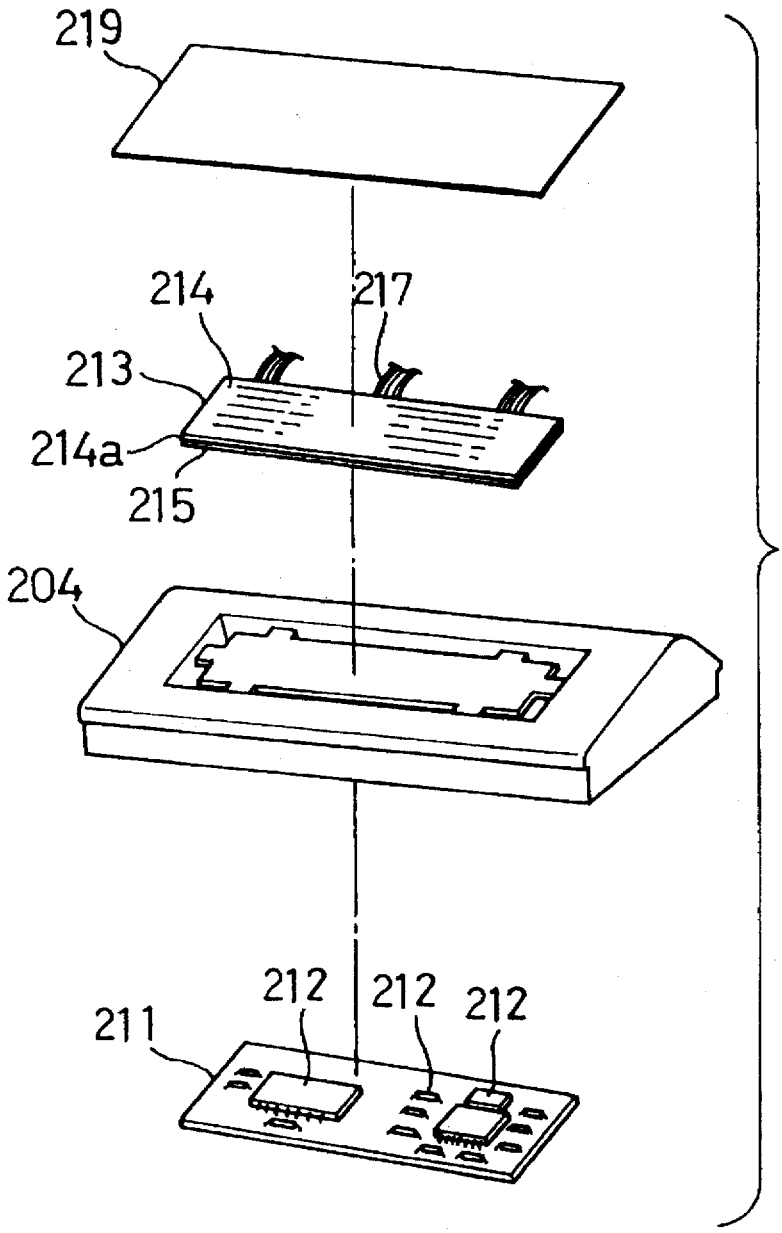
FIG. 43 is an exploded perspective view of an ornamental panel and the display device.

FIGS. 42 and 43 illustrate a thirteenth embodiment of the invention. The difference between the eleventh and thirteenth embodiments will be described. In the thirteenth embodiment, the liquid crystal display panel 213 is laid on the metal plate 218, and the cover 219 is then attached to the surface of the ornamental panel 204. An enclosure 232 is formed inside the ornamental panel 204 by a rib integrally formed with the panel 204. The first circuit board 211 is disposed inside the enclosure 232 to be fixed in position. Consequently, since the liquid crystal display panel 213 and the circuit board 211 can be directly mounted in the ornamental panel 204, the casing 206 employed in the eleventh embodiment can be eliminated. Furthermore, since the casing 206 is eliminated, the ornamental panel 204 has no joints resulting from the connection between the same and the casing. Consequently, the liquid crystal panel 213 and the circuit board 211 can be prevented from being subjected to water entering the inside of the ornamental panel through the joints.

Figure 44:
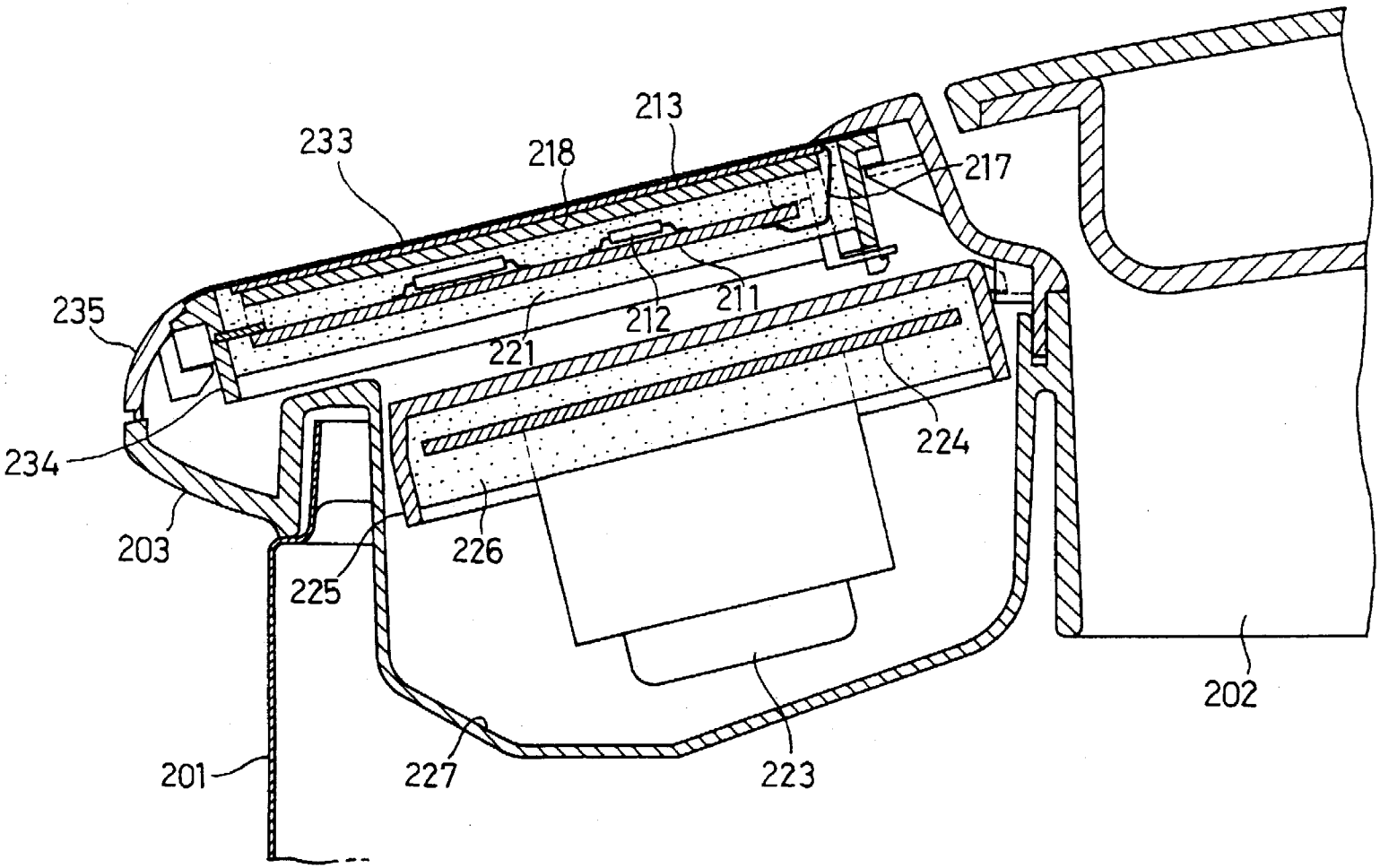
FIG. 44 is a longitudinally sectional side view of the display device employed in a washing machine of a fourteenth embodiment in accordance with the present invention.
Figure 45:
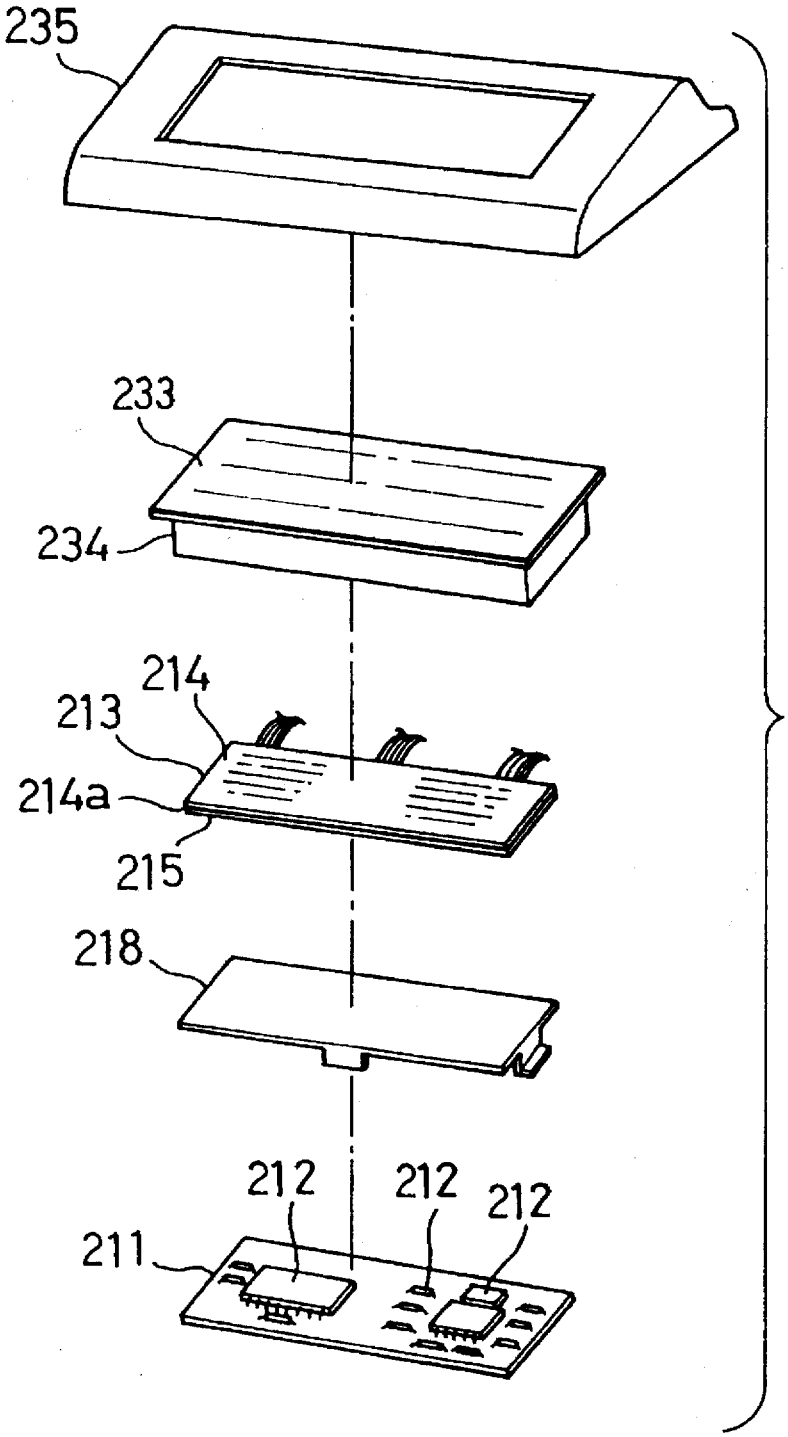
FIG. 45 is an exploded perspective view of an ornamental panel and the display device.

FIGS. 44 and 45 illustrate a fourteenth embodiment of the invention. The cover 233 is integrally formed with the casing 234 in a mold for the latter. The outer periphery of the casing 234 is pushed against the peripheral edge of the opening 236 of the ornamental panel 235 so that the outer periphery of the cover 233 is held between the peripheral edge of the opening 236 and the casing 234. Consequently, since close adhesion between the cover 233 and the casing 234 and durability against breakaway can be improved, the liquid crystal panel 213 and the circuit board 211 can be further prevented from being subjected to water entering the inside of the ornamental panel through the joints.

Figure 46:
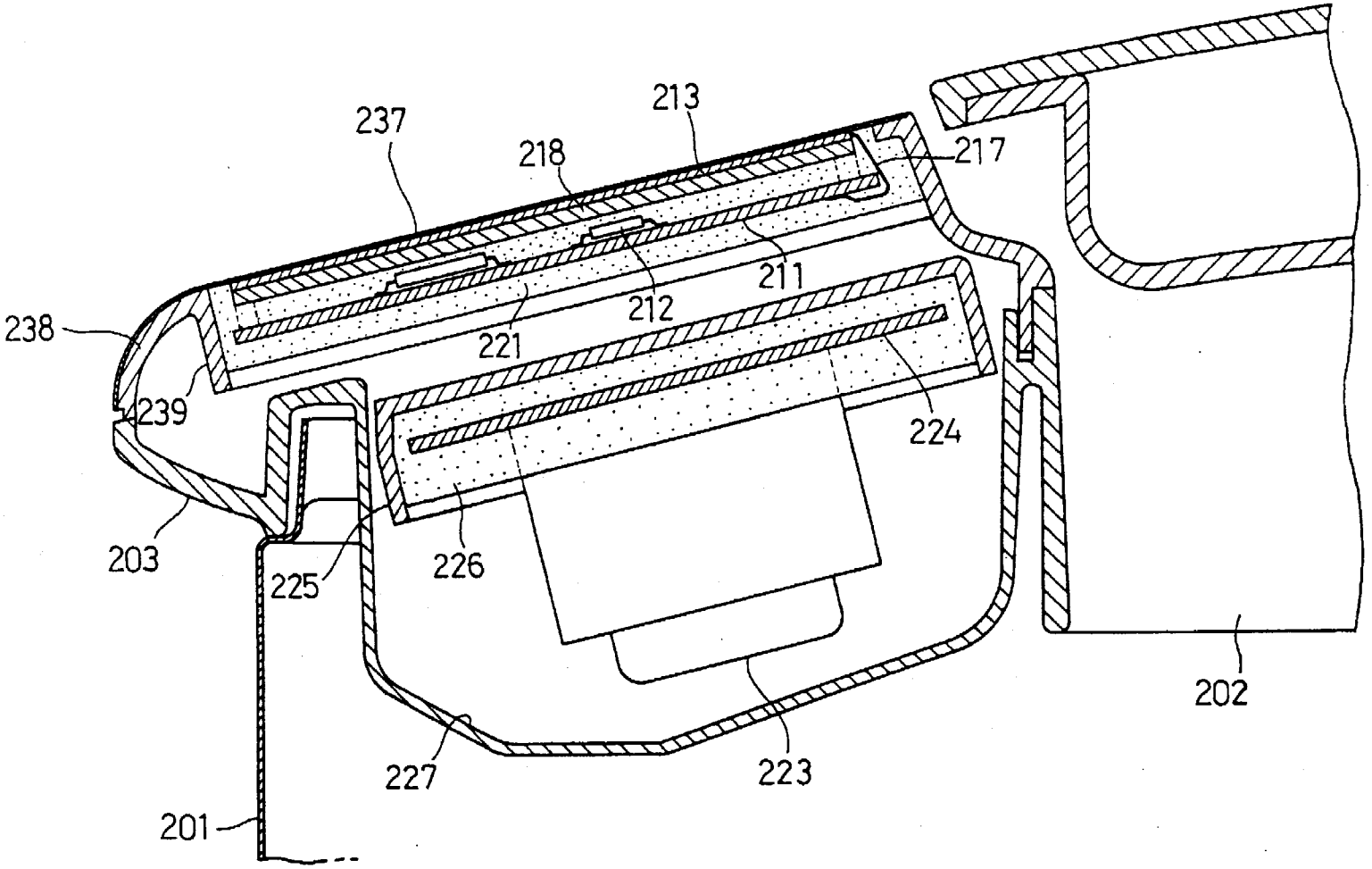
FIG. 46 is a longitudinally sectional side view of the display device employed in a washing machine of a fifteenth embodiment in accordance with the present invention.
Figure 47:
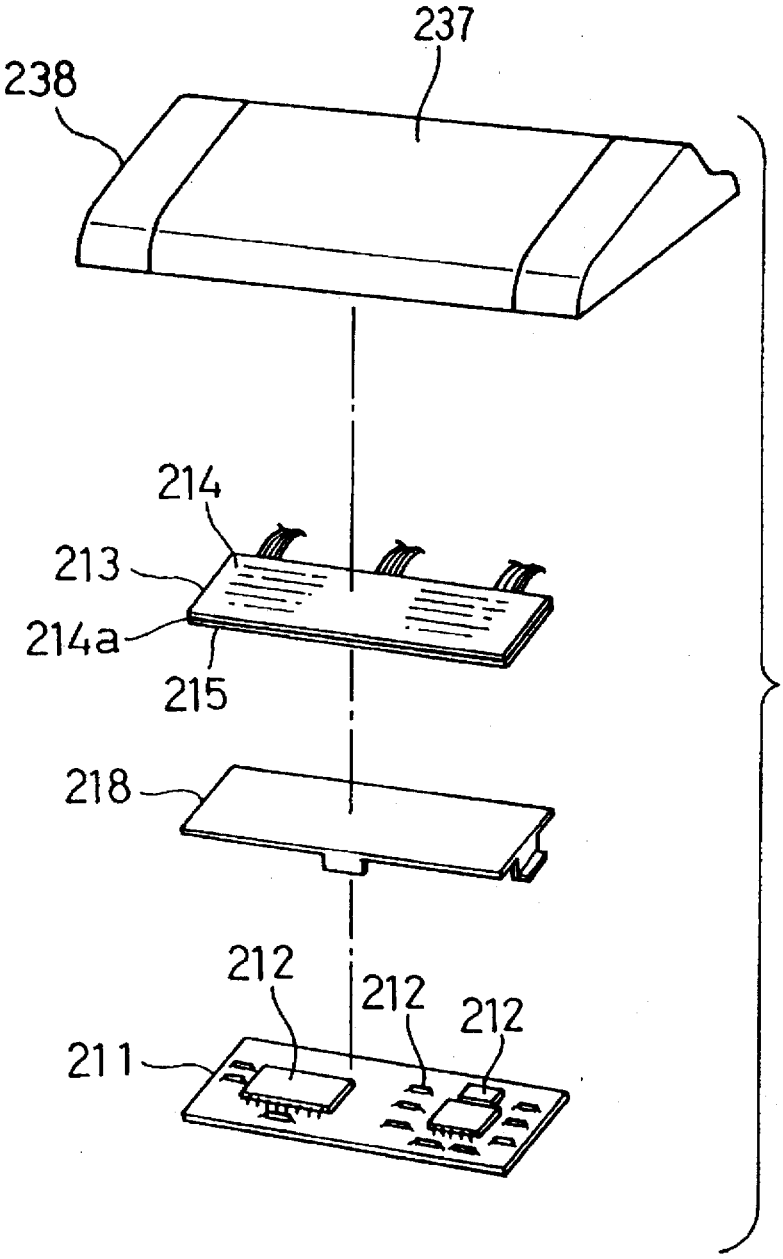
FIG. 47 is an exploded perspective view of an ornamental panel and the display device.

FIGS. 46 and 47 illustrate a fifteenth embodiment of the invention. The cover 237 is integrally formed with the ornamental panel 238 in a mold for the latter. The enclosure 239 is formed inside the ornamental panel 238 by a rib integrally formed with the panel 238. The first circuit board 211 is disposed inside the enclosure 239 to be fixed in position. In this construction, too, close adhesion between the cover 233 and the ornamental panel 238 and durability against breakaway can be improved. Consequently, the liquid crystal panel 213 and the circuit board 211 can be further prevented from being subjected to water entering the inside of the ornamental panel through the joints.

Figure 48:
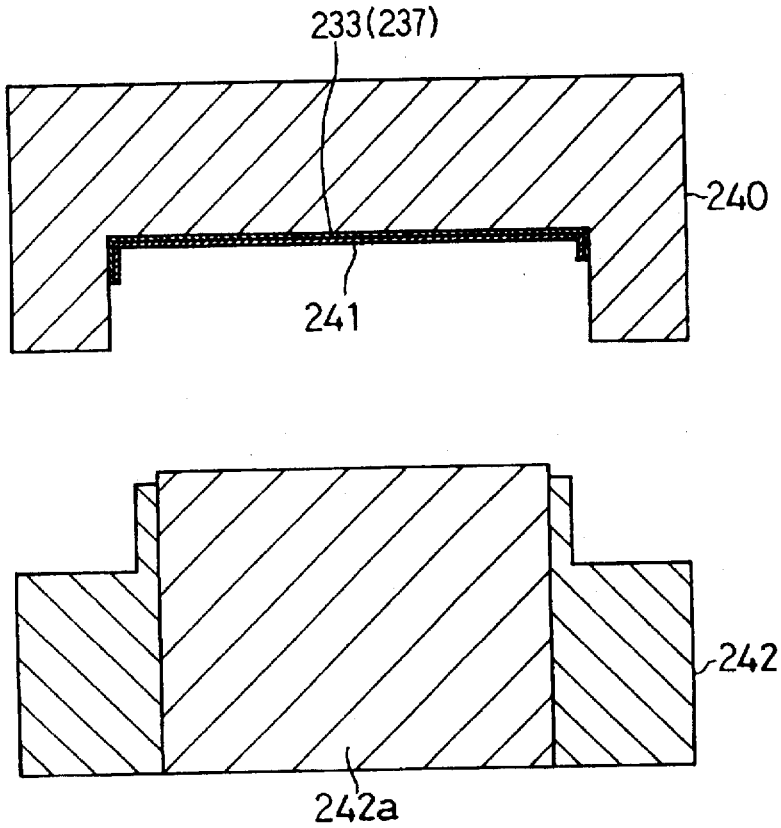
FIG. 48 is a longitudinal section of molds for the integral forming of the cover with the casing or the ornamental panel in the state prior to the forming.
Figure 49:
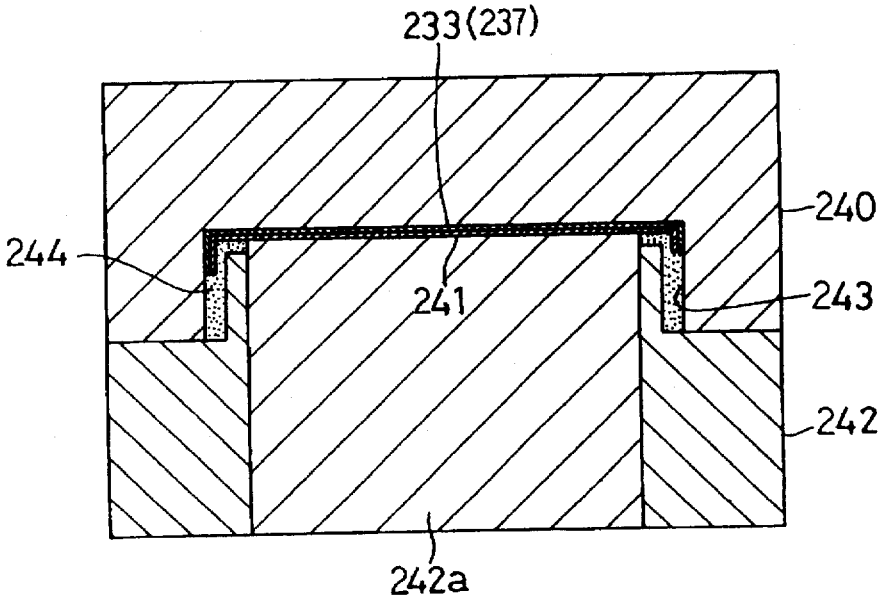
FIG. 49 is a longitudinal section of the molds during the forming.

FIGS. 48 and 49 illustrate a manner for integrating the covers 233 and 237 with the casing 234 and the ornamental panel 238 in the fourteenth and fifteenth embodiments respectively. The cover 233 or 237 is first set in one mold 240 such that a print and binder layer provided on the backside of the cover is disposed inside as shown in FIG. 48. The other mold 242 having an insert die 242*a* is then combined with the mold 240. A molding material 244 for the casing 234 or the ornamental panel 238 is poured into a molding cavity 243. The binder of the print and binder layer 214 is melted by heat from the molding material 244, being thereby mixed with the molding material 244. The mixture is then solidified into the casing 234 with the integrated cover 233 or the ornamental panel 238 with the integrated cover 237.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. A washing machine comprising:

a display device provided for displaying information about a washing operation and including an NCAP liquid crystal panel permitting light to pass therethrough when a voltage is applied thereto and having elasticity, and light-reflecting means disposed in a rear of the NCAP liquid crystal panel, the display device having a plurality of unit display areas displaying a plurality of pieces of information, respectively, about the washing operation, the light-reflecting means having portions corresponding to each unit display area and colored by a plurality of colors;

switch means disposed in a rear of the display device so as to be operated in response to a depressing operation to the display device, the switch means including a plurality of key switches corresponding to the unit display areas of the display devices respectively; and control means for controlling the display device so that one or more of the unit display areas display the information when the corresponding key switches are operated.

2. A washing machine according to claim 1, wherein the plurality of the unit display areas include another plurality of unit display areas for displaying progress of steps of the washing operation, and the control means controls the display device so that only one of said another plurality of unit display areas corresponding to the step being currently executed performs the displaying operation.

3. A washing machine according to claim 2, wherein the plurality of unit display areas include another plurality of unit display areas for displaying progress of steps of the washing operation, and the control means controls the display device so that said another plurality of unit display areas are switched to the displaying state during the washing operation and so that an intermittent displaying operation is performed only by one of said another plurality of unit display areas corresponding to the step being currently executed.

4. A washing machine according to claim 1, further comprising an overlay covering a surface of the NCAP liquid crystal panel, the overlay being printed with contents displayed by the NCAP liquid crystal panel.

5. A washing machine according to claim 4 wherein the overlay includes a predetermined portion to which a luminous agent is applied.

6. A washing machine according to claim 1, wherein the light-reflecting means is printed with contents displayed by the NCAP liquid crystal panel.

7. A washing machine according to claim 1, wherein the light-reflecting means includes a predetermined portion to which a luminous agent is applied.

* * * * *